US010301829B2

(12) United States Patent
Schneider et al.

(10) Patent No.: US 10,301,829 B2
(45) Date of Patent: May 28, 2019

(54) FRAMING SYSTEM AND METHOD OF ASSEMBLY THEREOF

(71) Applicant: BARRETTE OUTDOOR LIVING, INC., Middleburg Heights, OH (US)

(72) Inventors: Christopher Michael Schneider, Middleburg Heights, OH (US); Patrick Bertke, Middleburg Heights, OH (US); Wayne Elbert Dixon, Middleburg Heights, OH (US); Christopher Terrels, Middleburg Heights, OH (US)

(73) Assignee: BARRETTE OUTDOOR LIVING, INC., Middleburg Heights, OH (US)

( * ) Notice: Subject to any disclaimer, the term of this patent is extended or adjusted under 35 U.S.C. 154(b) by 0 days.

(21) Appl. No.: 15/944,818

(22) Filed: Apr. 4, 2018

(65) Prior Publication Data

US 2019/0127987 A1 May 2, 2019

Related U.S. Application Data

(60) Provisional application No. 62/580,120, filed on Nov. 1, 2017.

(51) Int. Cl.
*E04B 1/00* (2006.01)
*E04F 13/08* (2006.01)

(52) U.S. Cl.
CPC ..... *E04F 13/0803* (2013.01); *E04B 1/003* (2013.01)

(58) Field of Classification Search
CPC ..... E04F 13/0803; E04B 1/003; E04B 1/19; E04B 2001/2415
See application file for complete search history.

(56) References Cited

U.S. PATENT DOCUMENTS 4,464,074 A * 8/1984 Green ..... E04B 1/2403 403/192
5,192,056 A * 3/1993 Espinueva ..... E04H 17/1421 256/59
5,289,665 A * 3/1994 Higgins ..... E04B 1/2403 211/191
7,806,630 B2 * 10/2010 Hawkins ..... E02B 3/068 405/220
7,938,373 B2 * 5/2011 Nevins ..... F28F 9/002 165/67
9,765,805 B2 * 9/2017 Pond ..... F16B 17/00
9,932,734 B1 * 4/2018 Winter ..... E04B 1/2403

* cited by examiner

*Primary Examiner* — Patrick J Maestri
(74) *Attorney, Agent, or Firm* — John Maldjian; Maldjian Law Group LLC

(57) ABSTRACT

A framing system includes a corner bracket having a first planar portion and a second planar portion. The first planar portion and the second planar portion are configured to at least partially receive a corner post therebetween. The corner bracket also includes a first attachment portion and a second attachment portion. The first attachment portion is attachable to a first joist of a deck. The second attachment portion is attachable to a second joist of the deck. The framing system also includes a corner profile attachable to the corner bracket and the corner post. The framing system further includes at least one horizontal profile attachable to the corner profile. The framing system also includes at least one panel attachable to the corner profile.

20 Claims, 53 Drawing Sheets

114

114

126

126

126

2600

4400

FRAMING SYSTEM AND METHOD OF ASSEMBLY THEREOF

CROSS-REFERENCE TO RELATED APPLICATIONS

This application claims the benefit of U.S. Provisional Application Ser. No. 62/580,120, filed Nov. 1, 2017, entitled "FRAMING SYSTEM AND METHOD OF ASSEMBLY THEREOF," which is incorporated herein by reference in its entirety.

FIELD OF THE INVENTION

Embodiments of the present disclosure generally relate to a framing system. In particular, embodiments relate to a framing system for supporting a plurality of panels, and a method of assembling the framing system.

BACKGROUND

Frame assemblies are used extensively for a variety of functional purposes, for example, to prevent entry into a specified area or support an overlying structure. Under deck frames are specifically used for covering a gap underneath a deck structure.

Users often have a preference regarding aesthetic features of under deck frames. Lattice panels having various designs are typically provided to cater to such user preferences. However, assembling lattice panels to under deck frames may be a cumbersome and time-consuming task.

Under deck structures may also be susceptible to decay due to contact with the ground and moisture. Under deck frames may also have insufficient strength or rigidity.

For the foregoing reasons, there is a need for a framing system that will allow for an efficient assembly. There is a further need for a framing system that is resistant to decay and has sufficient strength.

SUMMARY

Embodiments of the present disclosure provide a framing system that can be easily assembled.

Embodiments disclosed herein relate to a framing system for a deck having a first joist, a second joist, a corner post, and a corner bracket to allow easy installation of one or more lattice panels.

The framing system, as disclosed by the present disclosure, can be used underneath a deck substrate to cover a gap between the deck substrate and the ground. Different styles of lattice panels may be used with the framing system based on the requirements of a user.

The framing system, as disclosed by the present disclosure, includes components made of materials which are resistive to any decay when in contact with the ground or moisture.

The framing system, as disclosed by the present disclosure, also includes a corner bracket. The corner bracket enables easy installation of a corner profile to the corner post. Further, the corner bracket may enhance flexibility for the user during installation.

The framing system, as disclosed by the present disclosure, includes one or more beams to impart additional strength and rigidity to the framing system.

Embodiments of the present disclosure may provide a framing system which define a grid-like structure for receiving one or more lattice panels.

Embodiments, in accordance with the present invention, are directed to a framing system. The framing system includes a corner bracket attached to a corner post and a corner profile attached to the corner bracket. The framing system also includes at least one horizontal profile attached to the corner profile, at least one main bracket attached to a joist and at least one vertical profile attached to the main bracket. The framing system also includes at least one panel attached to the corner profile and the at least one vertical profile.

The framing system further includes a least one stake adapter configured to couple a stake to the at least one horizontal profile.

Embodiments, in accordance with the present invention, are directed to a framing system for a deck having a first joist, a second joist and a corner post. The framing system includes a corner bracket. The corner bracket includes a first planar portion, and a second planar portion extending from and perpendicular to the first planar portion. The first planar portion and the second planar portion are configured to at least partially receive the corner post therebetween. The corner bracket also includes a first attachment portion extending from and perpendicular to the first planar portion. The first attachment portion defines a first slot configured to receive a first fastener therethrough to couple the first attachment portion to the first joist of the deck. The corner bracket further includes a second attachment portion extending from and perpendicular to the second planar portion. The second attachment portion defines a second slot configured to receive a second fastener therethrough to couple the second attachment portion to the second joist of the deck. The framing system also includes a corner profile. The corner profile includes a first elongate portion attachable to the first planar portion of the corner bracket and the corner post. The corner profile also includes a second elongate portion extending from and perpendicular to the first elongate portion. The second elongate portion is attachable to the second planar portion of the corner bracket and the corner post. The framing system further includes at least one horizontal profile attachable to the first elongate portion of the corner profile. The framing system also includes at least one panel attachable to the corner profile.

Embodiments, in accordance with the present invention, are further directed to a framing system for a deck having a first joist, a second joist and a corner post. The framing system includes a corner bracket. The corner bracket includes a first planar portion, and a second planar portion extending from and perpendicular to the first planar portion. The first planar portion and the second planar portion are configured to at least partially receive the corner post therebetween. The corner bracket also includes a first attachment portion extending from and perpendicular to the first planar portion. The first attachment portion defines a first slot configured to receive a first fastener therethrough to couple the first attachment portion to the first joist of the deck. The corner bracket further includes a second attachment portion extending from and perpendicular to the second planar portion. The second attachment portion defines a second slot configured to receive a second fastener therethrough to couple the second attachment portion to the second joist of the deck. The framing system also includes a corner profile. The corner bracket includes a first elongate portion attachable to the first planar portion of the corner bracket and the corner post. The corner bracket also includes a second elongate portion extending from and perpendicular to the first elongate portion. The second elongate portion is attachable to the second planar portion of the corner bracket and the corner post. The framing system further includes at least one horizontal profile attachable to the first elongate portion of the corner profile. The framing system also includes at least one main bracket attachable to the first joist of the deck. The main bracket includes a first section defining a pair of slots. Each of the pair of slots is configured to receive a fastener therethrough to couple the first section to the first joist. The main bracket also includes a second section extending from and perpendicular to the first section. The framing system also includes at least one vertical profile attachable to the second section of the at least one main bracket and the at least one horizontal profile. The framing system further includes at least one panel attachable to the corner profile and the at least one vertical profile.

Embodiments, in accordance with the present invention, further provide a framing system for a deck having a first joist, a second joist and a corner post. The framing system includes a corner bracket. The corner bracket includes a first planar portion, and a second planar portion extending from and perpendicular to the first planar portion. The first planar portion and the second planar portion are configured to at least partially receive the corner post therebetween. The corner bracket also includes a first attachment portion extending from and perpendicular to the first planar portion. The first attachment portion defines a first slot configured to receive a first fastener therethrough to couple the first attachment portion to the first joist of the deck. The corner bracket further includes a second attachment portion extending from and perpendicular to the second planar portion. The second attachment portion defines a second slot configured to receive a second fastener therethrough to couple the second attachment portion to the second joist of the deck. The framing system also includes a corner profile defining a longitudinal axis. The corner profile includes a first elongate portion attachable to the first planar portion of the corner bracket and the corner post. The corner profile also includes a second elongate portion extending from and perpendicular to the first elongate portion. The second elongate portion is attachable to the second planar portion of the corner bracket and the corner post. The framing system further includes at least one horizontal profile attachable to the first elongate portion of the corner profile. The at least one first horizontal profile is oriented perpendicularly with respect to the longitudinal axis. The framing system also includes an inclined profile spaced apart from the at least one horizontal profile and attachable to the first elongate portion of the corner profile. The inclined profile is oriented at an oblique angle with respect to the longitudinal axis. The framing system further includes at least one main bracket attachable to the first joist of the deck. The main bracket includes a first section defining a pair of slots. Each of the pair of slots is configured to receive a fastener therethrough to couple the first section to the first joist. The main bracket also includes a second section extending from and perpendicular to the first section. The framing system also includes at least one vertical profile attachable to the second section of the at least one main bracket and the at least one horizontal profile. The framing system further includes at least one panel attachable to the corner profile and the at least one vertical profile. The at least one panel includes an edge that is oriented at the oblique angle relative to the longitudinal axis.

Embodiments of the present disclosure may provide a number of advantages depending on its particular configuration. It is an object of the present disclosure to provide a framing system, a framing system kit, a method of manufacturing the framing system kit and methods for assembling the framing system, that simplify an on-site assembly of a frame configured to cover a gap underneath a deck substrate, enhance safety during the on-site assembly and improve the aesthetic appeal of the frame in the assembled state.

These and other advantages will be apparent from the present application of the embodiments described herein.

The preceding is a simplified summary to provide an understanding of some embodiments of the present disclosure. This summary is neither an extensive nor exhaustive overview of the present disclosure and its various embodiments. The summary presents selected concepts of the embodiments of the present disclosure in a simplified form as an introduction to the more detailed description presented below. As will be appreciated, other embodiments of the present disclosure are possible utilizing, alone or in combination, one or more of the features set forth above or described in detail below.

BRIEF DESCRIPTION OF THE DRAWINGS

The foregoing and other aspects of the embodiments disclosed herein are best understood from the following detailed description when read in connection with the accompanying drawings. For the purpose of illustrating the embodiments disclosed herein, there is shown in the drawings embodiments that are presently preferred, it being understood, however, that the embodiments disclosed herein are not limited to the specific instrumentalities disclosed. Included in the drawings are the following figures.

Figure 1:
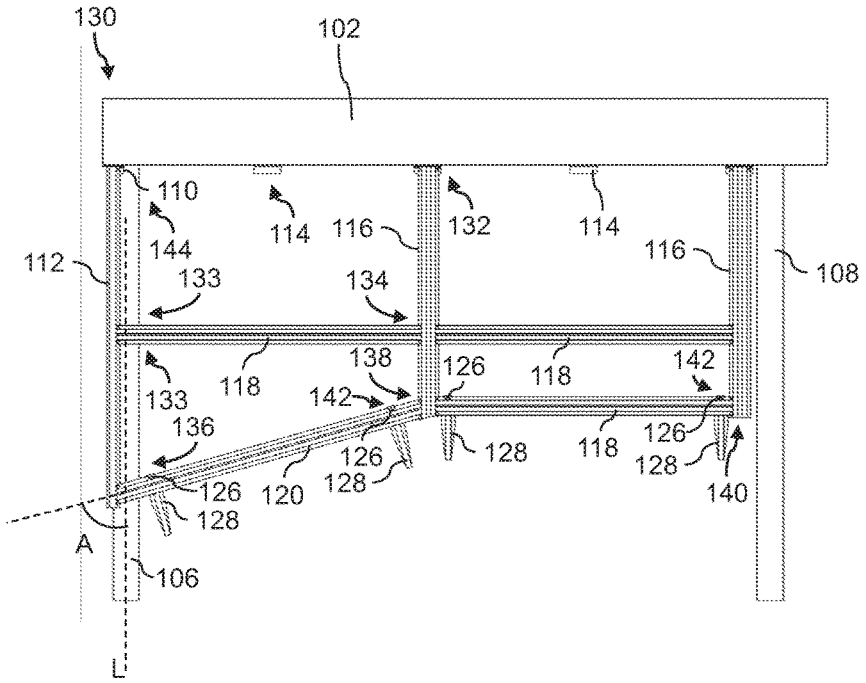
FIG. 1 illustrates a front view of a framing system, in accordance with an embodiment of the present disclosure.

While embodiments of the present disclosure are described herein by way of example using several illustrative drawings, those skilled in the art will recognize the present disclosure is not limited to the embodiments or drawings described. It should be understood the drawings and the detailed description thereto are not intended to limit the present disclosure to the particular form disclosed, but to the contrary, the present disclosure is to cover all modifications, equivalents and alternatives falling within the spirit and scope of embodiments of the present disclosure as defined by the appended claims.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

Embodiments of the present disclosure will be described below in conjunction with exemplary framing systems and methods of assembling framing systems.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

FIG. 1 illustrates a front view of a framing system or assembly 100, in accordance with an embodiment of the present disclosure. The framing system 100 can be installed in any outdoor region including, but not limited to, yards, lawns, gardens, outdoor decks, porches, stairway and the like. In an embodiment, the framing system 100 may be an under deck framing system configured to be installed beneath a deck substrate (not shown). In an exemplary embodiment, the framing system 100 may cover a gap underneath the deck substrate (interchangeably referred to as "the deck").

The framing system 100 includes a first joist 102, a second joist (not shown), a corner post 106, one or more posts 108, a corner bracket 110, a corner profile 112, at least one main bracket 114, at least one vertical profile 116, at least one horizontal profile 118, at least one inclined profile 120, at least one I-beam (not shown in FIG. 1), at least one panel (shown in FIG. 2), at least one stake adapter 126 and at least one stake 128. In the illustrated embodiment of FIG. 1, the framing system 100 includes multiple main brackets 114, multiple vertical profiles 116, multiple horizontal profiles 118, multiple lattice panels, multiple stake adapters 126 and multiple stakes 128.

In some embodiments, the first joist 102 and the second joist may intersect each other at a corner 130. In an embodiment, the first joist 102 and the second joist may be coupled to each other at the corner 130 by any suitable attachment methods such as, mechanical fasteners, adhesives, brazing, welding and so forth. The fasteners may include screws, nut and bolts, studs, and the like. In another embodiment, the first joist 102 may be a rim joist. Further, the second joist may be an end joist or a side joist. Each of the first joist 102 and the second joist may have a solid configuration. In an alternative embodiment, each of the first joist 102 and the second joist may have a hollow configuration. In a further embodiment, each of the first joist 102 and the second joist may be an elongate member having dimensions of 2 inches× 10 inches. Embodiments are intended to cover any suitable dimensions of each of the first joist 102 and the second joist as per requirements. In an embodiment, each of the first joist 102 and the second joist may be a part of the deck substrate.

The corner post 106 and the posts 108 may be anchored to a solid surface, such as a side of a building, or may be sunk into a ground surface (not shown) for support. In an embodiment, the corner post 106 and the posts 108 may have a substantially similar configuration. In a further embodiment, the corner post 106 and each of the posts 108 may have a solid configuration. In an alternative embodiment, the corner post 106 and each of the posts 108 may have a hollow configuration. In a further embodiment, the corner post 106 and each of the posts 108 may have dimensions of 4 inches×4 inches. In an alternative embodiment, the corner post 106 and each of the post 108 may have any suitable dimensions as per requirements. In an embodiment, the corner post 106 and the posts 108 may be connected to the first joist 102 and/or the second joist by various methods, such as, but not limited to, welding, adhesives, brazing, mechanical joints, fasteners, and so forth. The fasteners may include screws, nut and bolts, studs, and the like.

In an exemplary embodiment, the corner bracket 110 may be attached to the first joist 102 and the second joist. In some embodiments, the corner bracket 110 is attached to an underside of each of the first joist 102 and the second joist by various methods, such as, but not limited to, welding, adhesives, brazing, mechanical joints, fasteners, and so forth. The fasteners may include screws, nut and bolts, studs, and the like.

In an embodiment, the corner bracket 110 is attachable to the corner profile 112 and/or the corner post 106. In some embodiments, the corner bracket 110 is coupled to the corner profile 112 and/or the corner post 106 by various methods, such as, but not limited to, welding, adhesives, brazing, mechanical joints, fasteners, and so forth. The fasteners may include screws, nut and bolts, studs, and the like.

In an exemplary embodiment, the corner bracket 110 may include a first planar portion (not shown in FIG. 1) and a second planar portion (not shown in FIG. 1) extending from and perpendicular to the first planar portion. In an embodiment, the first planar portion and the second planar portion at least partially receive the corner post 106 therebetween. The corner bracket 110 may further include a first attachment portion (not shown in FIG. 1) extending from and perpendicular to the first planar portion. In some embodiments, the first attachment portion may be coupled to the first joist 102 by various methods, such as, but not limited to, welding, adhesives, brazing, mechanical joints, fasteners, and so forth. In an embodiment, the first attachment portion may define a first slot configured to receive a first fastener (not shown in FIG. 1) therethrough to couple the first attachment portion to the first joist 102 of the deck. The corner bracket 110 may also include a second attachment portion (not shown in FIG. 1) extending from and perpendicular to the second planar portion. In some embodiments, the second attachment portion may be couple to the second joist by various methods, such as, but not limited to, welding, adhesives, brazing, mechanical joints, fasteners, and so forth. In an embodiment, the second attachment portion may define a second slot configured to receive a second fastener (not shown in FIG. 1) therethrough to couple the second attachment portion to the second joist of the deck.

In some embodiments, the framing system 100 includes the corner profile 112 attachable to the corner post 106 and/or the corner bracket 110. In an embodiment, the corner profile 112 may include a first elongate portion attachable to the first planar portion of the corner bracket 110 and the corner post 106. The corner profile 112 may further include a second elongate portion (not shown in FIG. 1) extending from and perpendicular to the first elongate portion. In an embodiment, the second elongate portion may be attached to the second planar portion of the corner bracket 110 and the corner post 106. In some embodiments, the corner profile 112 may be attached to the corner post 106 and/or the corner bracket 110 by various methods, such as, but not limited to, welding, adhesives, brazing, mechanical joints, fasteners, and so forth.

The corner profile 112 further defines a longitudinal axis "L". The corner profile 112 may extend along the longitudinal axis "L". In an embodiment, the corner post 106 and the posts 108 may also be oriented substantially parallel to the longitudinal axis "L". The first joist 102 may be oriented substantially perpendicular to the longitudinal axis "L".

In an embodiment, one or more of the horizontal profiles 118 is attachable to the corner profile 112. In some embodiments, one or more of the horizontal profiles 118 is coupled to the corner profile 112 by various methods, such as, but not limited to, welding, adhesives, brazing, mechanical joints, fasteners, and so forth. The fasteners may include screws, nut and bolts, studs, and the like. In an exemplary embodiment, one or more of the horizontal profiles 118 is coupled to the first elongate portion of the corner profile 112 via a pair of fasteners (not shown in FIG. 1). In other embodiments, one or more of the horizontal profiles 118 may be coupled to second elongate portion of the corner profile via a pair of fasteners. Each of the horizontal profiles 118 may be oriented substantially perpendicular to the longitudinal axis "L".

In an embodiment, the inclined profile 120 is attachable to the corner profile 112. The inclined profile 120 may be located proximal to the ground surface. In some embodiments, the inclined profile 120 is coupled to the corner profile 112 by various methods, such as, but not limited to, welding, adhesives, brazing, mechanical joints, fasteners, and so forth. The fasteners may include screws, nut and bolts, studs, and the like. In an embodiment, the inclined profile 120 is inclined at an oblique angle "A" relative to the longitudinal axis "L". Specifically, the inclined profile 120 is inclined at the angle "A" with respect to the corner profile 112. The angle "A" may be based on a grade of the ground surface beneath the framing system 100. In an embodiment, the inclined profile 120 may have a configuration that is substantially similar to the horizontal profile 118. Further, the inclined profile 120 may be angle cut to match the grade of the ground surface.

In an embodiment, each of the main brackets 114 is attachable to the first joist 102. In some other embodiments, one or more of the main brackets 114 may be attached to the second joist. In some embodiments, each of the main brackets 114 is coupled to the first joist 102 by various methods, such as, but not limited to, welding, adhesives, brazing, mechanical joints, fasteners, and so forth. The fasteners may include screws, nut and bolts, studs, and the like. In an exemplary embodiment, each of the main brackets 114 includes a first section (not shown in FIG. 1) defining a pair of slots. Each of the pair of slots is configured to receive a fastener therethrough to couple the first section to the first joist 102. Each of the pair of main bracket 114 further includes a second section 115 extending from and perpendicular to the first section. In an embodiment, the second section 115 of each of the main brackets 114 is configured to be attached to the vertical profile 116. In some embodiments, the second section 115 of each of the main brackets 114 may be couple to the vertical profile 116 by various methods, such as, but not limited to, welding, adhesives, brazing, mechanical joints, fasteners, and so forth. The fasteners may include screws, nut and bolts, studs, and the like. In an exemplary embodiment, the second section 115 of each of the main brackets 114 may be coupled to the vertical profile 116 via a pair of fasteners (not shown in FIG. 1). In alternative embodiments, the second section 115 of each of the main brackets 114 may define a pair of holes (not shown) configured to receive the pair of fasteners to couple the vertical profile 116 to the main bracket 114.

In an embodiment, each of the vertical profiles 116 is attachable to the corresponding main bracket 114. In some embodiments, each of the vertical profiles 116 is coupled to the corresponding main bracket 114 by various methods, such as, but not limited to, welding, adhesives, brazing, mechanical joints, fasteners, and so forth. The fasteners may include screws, nut and bolts, studs, and the like.

In an embodiment, the at least one horizontal profile 118 may be coupled to the at least one vertical profile 116 by various methods, such as, but not limited to, welding, adhesives, brazing, mechanical joints, fasteners, and so forth. In an exemplary embodiment, the at least one horizontal profile 118 may be coupled to the at least one vertical profile 116 via a pair of fasteners (not shown in FIG. 1).

In some embodiments, the at least one panel may be coupled to the at least one corner profile 112 and the at least one vertical profile 116 by various methods, such as, but not limited to, welding, adhesives, brazing, mechanical joints, fasteners, and so forth. In an exemplary embodiment, the at least one panel may be coupled to the at least one corner profile 112 and the at least one vertical profile 116 by a plurality of fasteners.

In an embodiment, the at least one I-beam may be coupled to the respective vertical profile 116 by various methods, such as, but not limited to, welding, adhesives, brazing, mechanical joints, fasteners, and so forth. In some embodiments, the at least one I-beam may act as a reinforcing member to allow installation of the at least the vertical profile 116 having a length greater than a threshold value. The threshold value may be about 4 feet.

The framing system 100 further includes at least one stake adapter 126 configured to couple a corresponding stake 128 to the at least one horizontal profile 118. The at least one stake adapter 126 may include a coupling portion (not shown in FIG. 1) configured to receive a fastener therethrough to couple the stake adapter 126, the stake 128 and at least one horizontal profile 118 to each other. The stake adapter also includes a pair of angled portions (not shown in FIG. 1) inclined at an angle relative to the coupling portion. In an embodiment, the pair of angled portions and at least one horizontal profile 118 at least partially receive the stake 128 therebetween. In some embodiments, the stake 128 may be insertable into the ground surface. The stake 128 may provide additional stability to the framing system 100.

The framing system 100 further includes at least one top joint 132, a first middle joint 134, a second middle joint 135, a first bottom joint 136, a second bottom joint 138, a third bottom joint 140, at least one stake joint 142 and at least one corner joint 144.

In various embodiments, the components of the framing system 100, namely, the corner bracket 110, the corner profile 112, the main brackets 114, the vertical profiles 116, the horizontal profiles 118, the inclined profiles 120, the I-beam, and the panels may be made of different materials, such as, but not limited to, plastic, metal or metal alloys, wood, composites, and so forth. In an embodiment, the vertical profiles 116, the horizontal profiles 118, the inclined profile 120, the I-beam and the corner bracket may be made primarily of aluminum instead of wood. Therefore, the framing system 100 may not decay when in contact with the ground and moisture.

Figure 2:
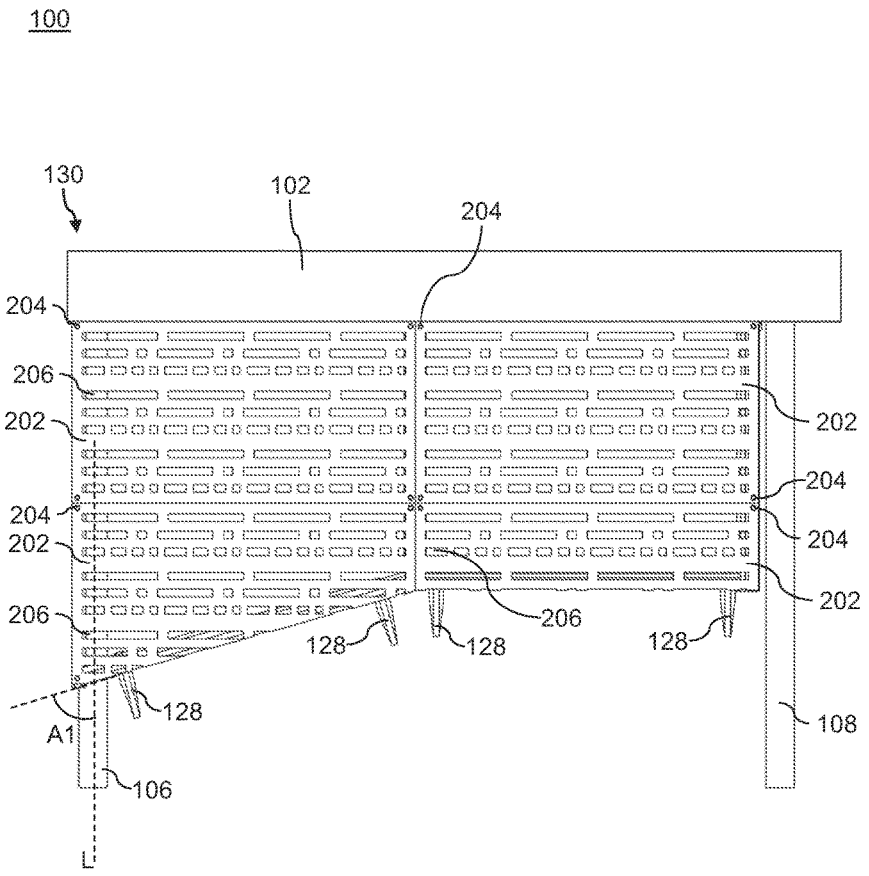
FIG. 2 illustrates another front view of the framing system with panels attached to the framing system, in according with an embodiment of the present disclosure.

FIG. 2 illustrates another front view of the framing system 100 with lattice panels 202 (hereinafter referred to as "the panels 202") attached to the framing system 100, in according with an embodiment of the present disclosure. In an embodiment, at least one of the panels 202 is attachable to the corner profile 112 (shown in FIG. 1). In an embodiment, at least one of the panels 202 may be coupled to the corner profile 112 and the at least one vertical profile 116 (shown in FIG. 1) via a plurality of fasteners 204. In alternative embodiments, at least one of the panels 202 may be coupled to the corner profile 112 and the at least one vertical profile 116 by various methods, such as, but not limited to, welding, adhesives, brazing, mechanical joints, and so forth. In some embodiments, one or more of the panels 202 may be coupled to the at least one vertical profile 116 and the at least one horizontal profile 118 by the plurality of fasteners 204.

In an embodiment, each of the panel 202 may define at least one cavity (not shown) configured to receive one of the fasteners 204 therethrough. In some embodiments, the at least one cavity may be defined at an appropriate position, proximal to a corner of the panel 202. In some embodiments, one or more of the panels 202 may include an edge that is oriented at an oblique angle "A1" relative to the longitudinal axis "L". In some embodiments, the oblique angle "A1", as defined by the edge of one or more of the panels 202, may be substantially equal to the oblique angle "A" (shown in FIG. 1) defined by the inclined profile 120 relative to the longitudinal axis "L".

In various embodiments, each of the panels 202 may have different designs, for example, but not limited to, Morse sheeting, Celtic sheeting, fretwork sheeting, sprig sheeting, and so forth. Each of the panels 202 may have multiple openings 206 having one or more shapes. In some embodiments, one or more of the panels 202 may be cut to match the grade of the ground surface and secured to the framing system 100.

Figure 3A:
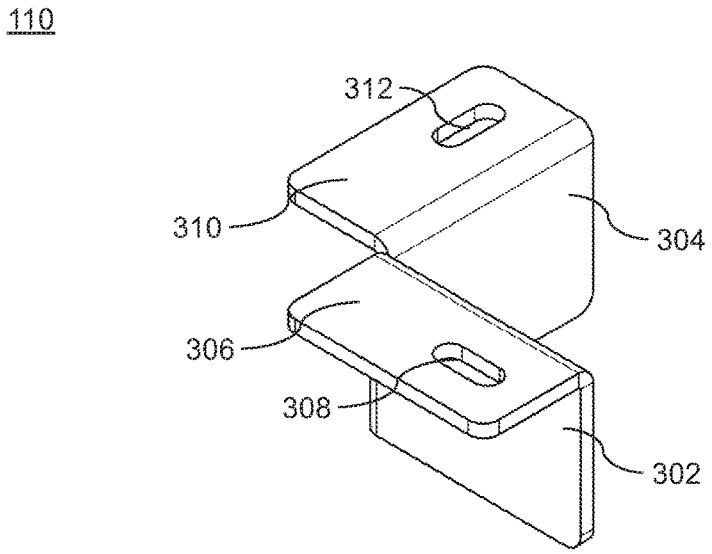
FIGS. 3A to 3C are different views of a corner bracket for use with the framing system, in accordance with an embodiment of the present disclosure.
Figure 3B:
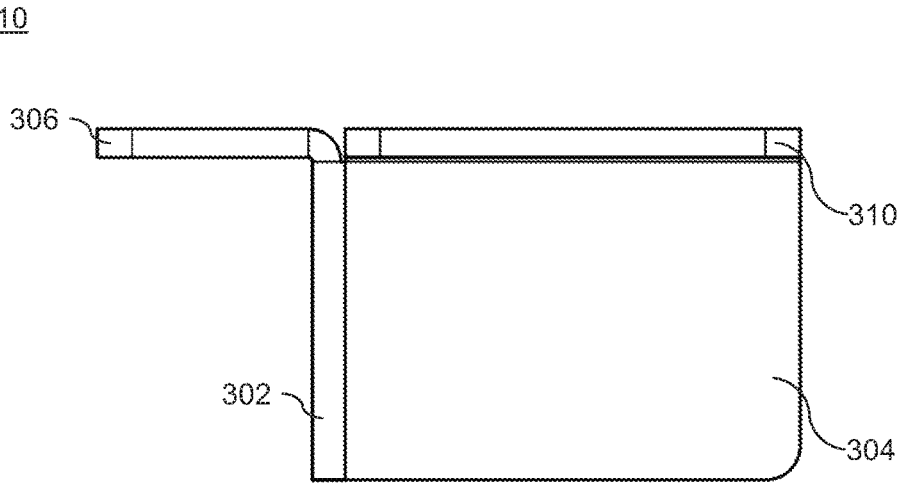
Figure 3C:
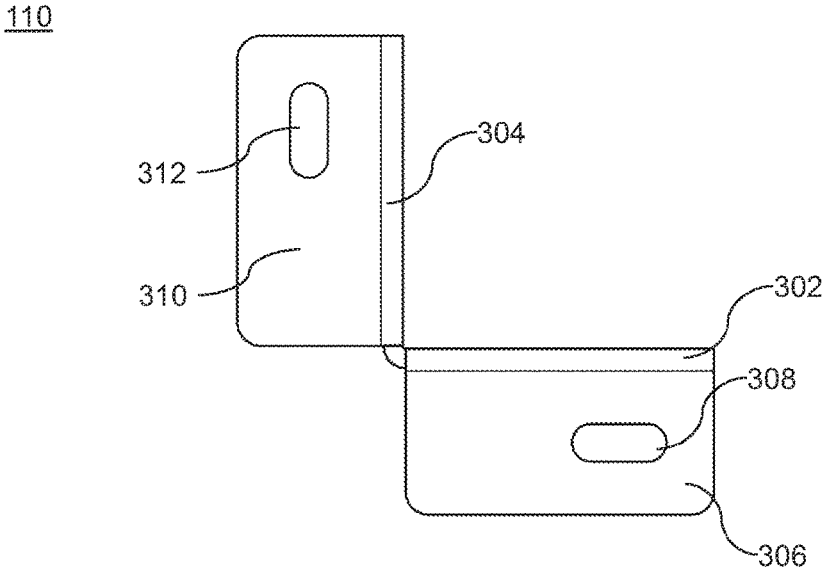

FIGS. 3A to 3C are different views of the corner bracket 110 for use with the framing system 100 (shown in FIG. 1), in accordance with an embodiment of the present disclosure. In an embodiment, the corner bracket 110 includes a first planar portion 302, and a second planar portion 304 extending from and perpendicular to the first planar portion 302. In some embodiments, the first planar portion 302 and the second planar portion 304 are configured to at least partially receive the corner post 106 (shown in FIG. 1), therebetween.

The corner bracket 110 further includes a first attachment part 306 extending from and perpendicular to the first planar portion 302. In an embodiment, the first attachment part 306 may be attached to the first joist 102 (shown in FIG. 1). In an exemplary embodiment, the first attachment part 306 may define a first slot 308 configured to receive a first fastener (not shown in FIG. 3) therethrough to couple the first attachment part 306 to the first joist 102 of the deck. In alternative embodiments, the first attachment part 306 may be attached the first joist 102 by various attachment methods, such as, but not limited to, welding, brazing, adhesive, or a combination thereof. In an embodiment, the corner bracket 110 may also include a second attachment part 310 extending from and perpendicular to the second planar portion 304. The second attachment part 310 may be attached to the second joist. In some embodiments, the second attachment part 310 may also define a second slot 312 configured to receive a second fastener (not shown in FIG. 3) therethrough to couple the second attachment part 310 to the second joist of the deck. In alternative embodiments, the second attachment part 310 may be attached the second joist by various attachment methods, such as, but not limited to, welding, brazing, adhesive, or a combination thereof.

In some embodiments, a material of the corner bracket 110 may include aluminum. In an embodiment, the corner bracket 110 may be treated, using a mechanical tool or a chemical solvent, to break sharp edges, which may otherwise harm a user while installation. In some embodiments, the corner bracket 110 may undergo a power coating process in order to obtain a desired color. In an embodiment, the color of the corner bracket 110 may match a color of each of the different components of the framing system 100. In some embodiments, the corner bracket 110 may be provided with a lead-free coating. In an embodiment, the corner bracket 110 may undergo various corrosion tests such as, a salt spray test, to maintain strength of the framing system 100. In some embodiments, the corner bracket 110 may be coated with a glossy material to enhance the aesthetic features of the framing system 100.

Figure 4:
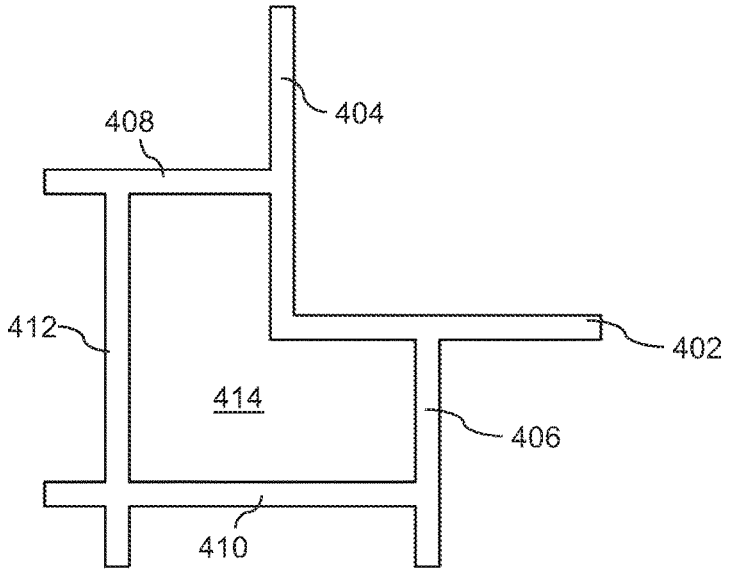
FIG. 4 is a front view of a corner profile for use with the framing system, in accordance with an embodiment of the present disclosure.
Figure 5A:
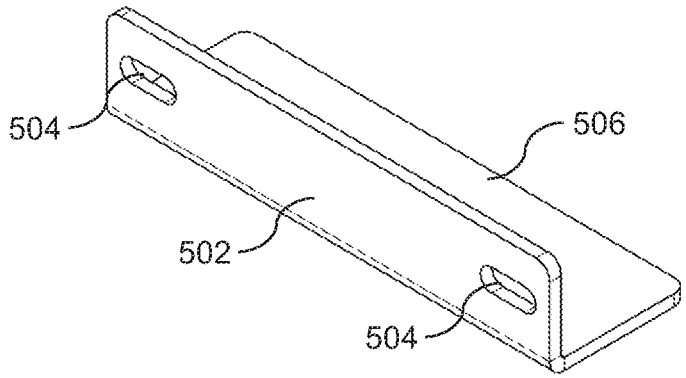
FIG. 5A to 5D are different views of a main bracket for use with the framing system, in accordance with an embodiment of the present disclosure.
Figure 5B:
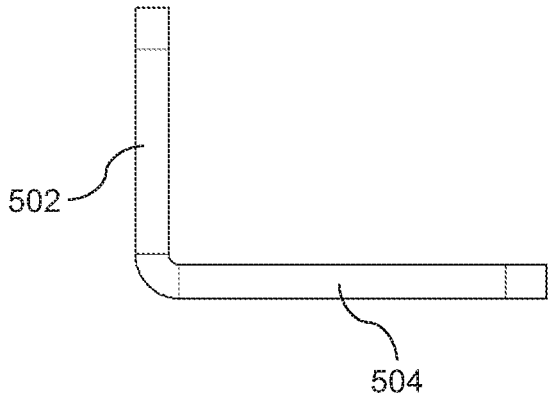
Figure 5C:
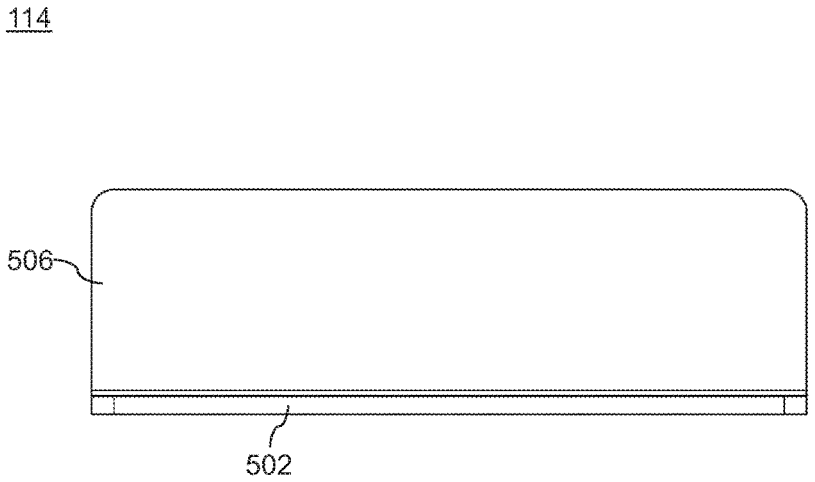
Figure 5D:
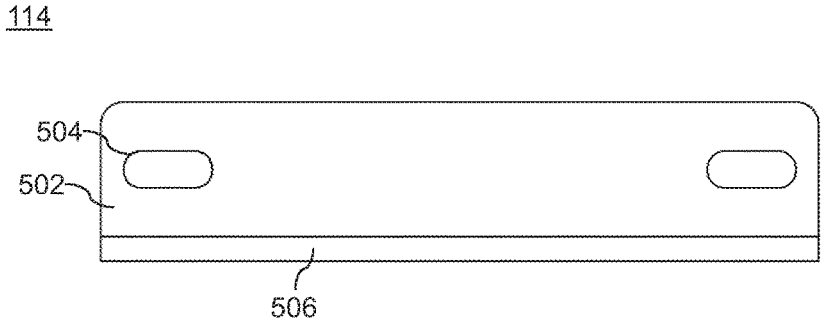

FIG. 4 is a front view of the corner profile 112 for use with the framing system 100, in accordance with an embodiment of the present disclosure. In some embodiments, a material of the corner profile 112 may include aluminum. In an exemplary embodiment, the corner profile 112 includes a first attachment portion 402 attachable to the first planar portion 302 of the corner bracket 110 (shown in FIGS. 3A to 3C) and the corner post 106 (shown in FIG. 1). In some embodiments, the first attachment portion 402 may be attached to the first planar portion 302 and the corner post 106 by various methods, such as, but not limited to, welding, adhesives, brazing, mechanical joints, fasteners, and so forth. The corner profile 112 further includes a second attachment portion 404 extending from and perpendicular to the first attachment portion 402. In some embodiments, the second attachment portion 404 may be attachable to the second planar portion 304 of the corner bracket 110 and the corner post 106. In some embodiments, the second attachment portion 404 may be attached to the second planar portion 304 and the corner post 106 by various methods, such as, but not limited to, welding, adhesives, brazing, mechanical joints, fasteners, and so forth. The corner profile 112 also includes a first lateral portion 406 extending outwardly and perpendicularly from the first attachment portion 402.

The corner profile 112 further includes a second lateral portion 408 extending outwardly and perpendicularly from the second attachment portion 404. In an exemplary embodiment, the corner profile 112 also includes a first outer portion 410 extending perpendicularly from the first lateral portion 406 and is parallel to the first attachment portion 402. The corner profile 112 further includes a second outer portion 412 extending perpendicularly from the second lateral portion 408 and is parallel to the second attachment portion 404. In an embodiment, at least a part of each of the first attachment portion 402, the second attachment portion 404, the first lateral portion 406, the second lateral portion 408, the first outer portion 410 and the second outer portion 412 may define a central cavity 414.

In an embodiment, one or more of the panels 202 (shown in FIG. 2) may be attached to the corner profile 112 via one or more of the fasteners 204. The fasteners 204 may extend through the panel 202, through the first outer surface 410 or the second outer surface 412, and into the central cavity 414. In some embodiments, each of the first outer surface 410 and the second outer surface 412 may define an aperture (not shown) configured to receive the fastener 204 therethrough.

FIG. 5A to 5D are different views of the main bracket 114 for use with the framing system 100 (shown in FIG. 1), in accordance with an embodiment of the present disclosure. In an embodiment, the main bracket 114 may be attached to the first joist 102 (shown in FIG. 1) of the deck. In another embodiment, the main bracket 114 may be attached to the second joist of the deck. In an exemplary embodiment, the main bracket 114 includes a first section 502. The first section 502 may be configured to be attached to the first joist 102 by various methods, such as, but not limited to, welding, adhesives, brazing, mechanical joints, fasteners, and so forth. In an exemplary embodiment, the first section 502 may define a pair of slots 504. Each of the pair of slots 504 may be configured to receive a fastener (not shown in FIG. 5) therethrough to couple the first section 502 to the first joist 102. The main bracket 114 further includes a second section 506 extending from and perpendicular to the first section 502. In some embodiments, one or more of the vertical profiles 116 may be attached to the second section 506 by various methods, such as, but not limited to, welding, adhesives, brazing, mechanical joints, fasteners, and so forth. In an embodiment, the second section 506 may also define a pair of slots (not shown), each slot being configured to receive a fastener therethrough to couple the vertical profile 116 to the second section 506.

In an embodiment, a material of the main bracket 114 may include aluminum. In an embodiment, the main bracket 114 may be treated, using a mechanical tool or a chemical solvent, to break sharp edges, which may otherwise harm a user while installation. In some embodiments, the main bracket 114 may undergo a power coating process in order to obtain a desired color. In an embodiment, the color of the main bracket 114 may match a color of each of the different components of the framing system 100. In some embodiments, the main bracket 114 may be provided with a lead-free coating. In an embodiment, the main bracket 114 may undergo various corrosion tests such as, a salt spray test, to maintain strength of the framing system 100. In some embodiments, the main bracket 114 may be coated with a glossy material to enhance the aesthetic features of the framing system 100.

Figure 6:
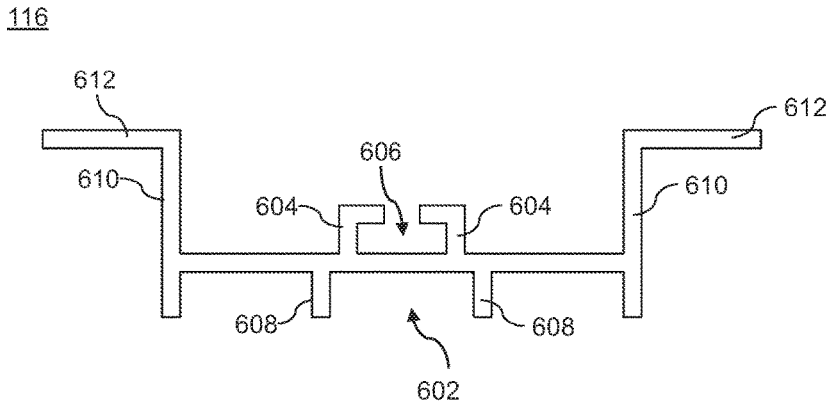
FIG. 6 is a front view of a vertical profile for use with the framing system, in accordance with an embodiment of the present disclosure.

FIG. 6 is a front view of the vertical profile 116 for use with the framing system 100, in accordance with an embodiment of the present disclosure. In an exemplary embodiment, the vertical profile 116 may be attachable to the second section 506 (shown in FIG. 5) of the main bracket 114 and at least one of the horizontal profiles 118. In an embodiment, the vertical profile 116 may be an extruded profile. Further, a material of the vertical profile 116 may include aluminum. The vertical profile 115 includes a middle portion 602, a pair of central coupling portions 604, a pair of reinforcement portions 608 and a pair of lateral coupling portions 612. The vertical profile 116 also includes a pair of connecting portions 610. In an exemplary embodiment, the pair of central coupling portions 604 may define a central channel 606. In an exemplary embodiment, the vertical profile 116 may include a pair of connecting portions 610, extending perpendicularly from corresponding ends of the middle portion 602. In some embodiments, the pair of lateral coupling portions 612 may extend perpendicularly from the pair of connecting portions 610.

In an embodiment, the central channel 606 may receive an I-beam (not shown in FIG. 6). In some embodiments, the pair of lateral coupling portions 612 may be attachable to the main bracket 114, the horizontal profile 118 and the inclined profile 120. In an embodiment, each of the pair of lateral coupling portions 612 may define a plurality of holes (not shown) configured to receive a plurality of fasteners to couple the vertical profile 116 to the at least one main bracket 114, the horizontal profile 118 and the inclined profile 120.

Figure 7:
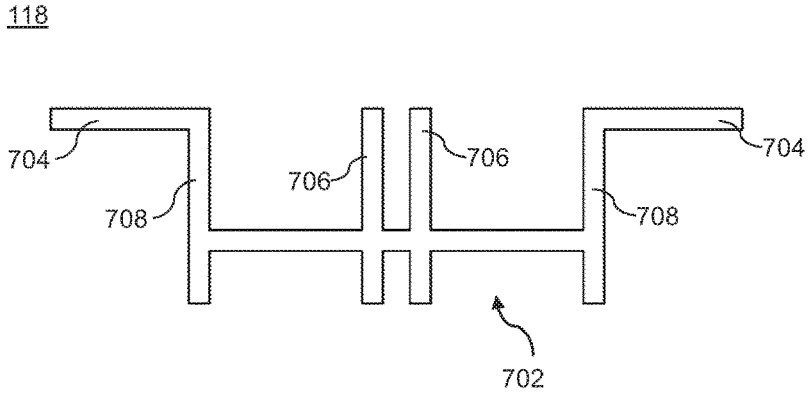
FIG. 7 is a front view of a horizontal profile for use with the framing system, in accordance with an embodiment of the present disclosure.

FIG. 7 is a front view of the horizontal profile 118 for use with the framing system 100, in accordance with an embodiment of the present disclosure. In an embodiment, the horizontal profile 118 may be an extruded profile. Further, a material of the horizontal profile 118 may include aluminum. In an exemplary embodiment, the horizontal profile 118 may include a central part 702, a pair of lateral connecting parts 704, and a pair of strengthening parts 706. In some embodiments, the pair of strengthening parts 706 may extend perpendicularly from a middle of the central part 702. In an embodiment, the horizontal profile 118 may include a pair of connecting parts 708 extending perpendicularly from the ends of the central part 702. Further, each of the pair of lateral connecting parts 704 may extend perpendicularly from the corresponding connecting part 708. In some embodiments, the horizontal profile 118 may be coupled to the corner profile 112 and the vertical profile 116 (shown in FIG. 6). In some other embodiments, the horizontal profile 118 may be coupled to a pair of the vertical profiles 116. In an exemplary embodiment, the pair of lateral connecting parts 704 may be attached to one of the first attachment portion 402 or the second attachment portion 404 of the corner profile 112 (shown in FIG. 4). The pair of lateral connecting parts 704 may also be attached to one of the pair of lateral coupling portions 612 of the vertical profile 116. In an embodiment, the pair of lateral connecting parts 704 may be attached to the corner profile 112 or the vertical profile 116 by various methods, such as, but not limited to, mechanical fasteners, welding, brazing, and so forth. In some embodiments, each of the pair of lateral connecting parts 704 may define a plurality of holes (not shown) configured to receive a plurality of fasteners to couple the horizontal profile 118 to the corner profile 112 or the vertical profile 116. In an embodiment, the inclined profile 120 may have a configuration that is substantially similar to the horizontal profile 118. Further, the inclined profile 120 may be angle cut to match the grade of the ground surface.

Figure 8:
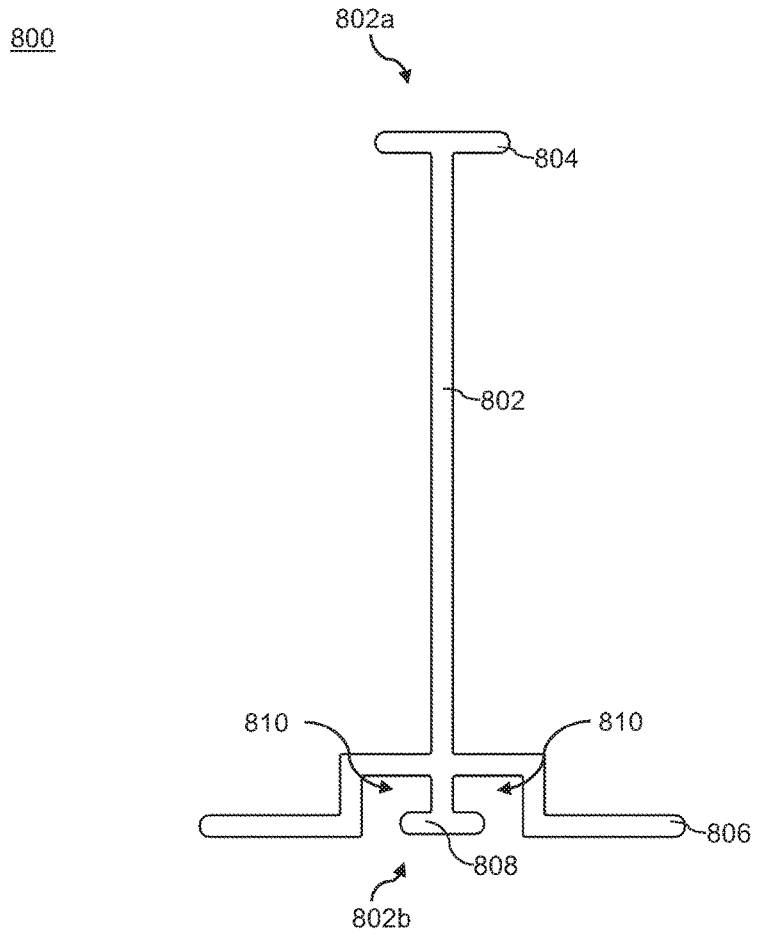
FIG. 8 is a front view of an I-beam for use with the framing system, in accordance with an embodiment of the present disclosure.
Figure 9A:
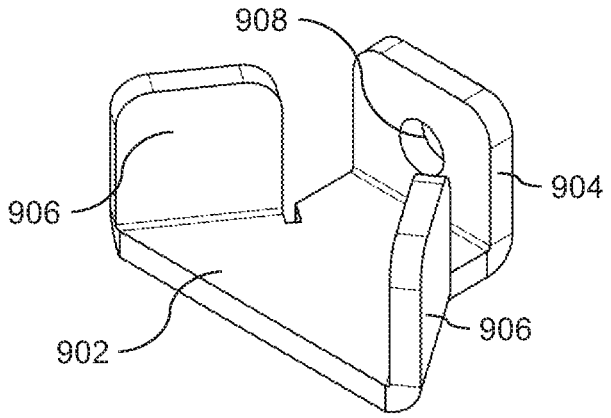
FIG. 9A to 9E are different views of a stake adapter for use with the framing system, in accordance with an embodiment of the present disclosure.
Figure 9B:
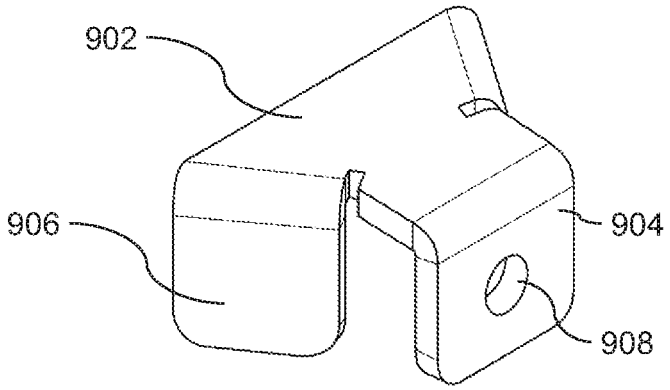
Figure 9C:
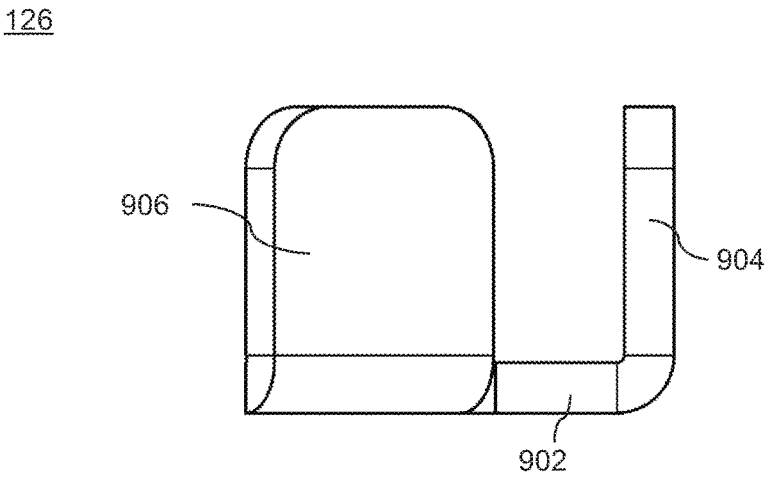
Figure 9D:
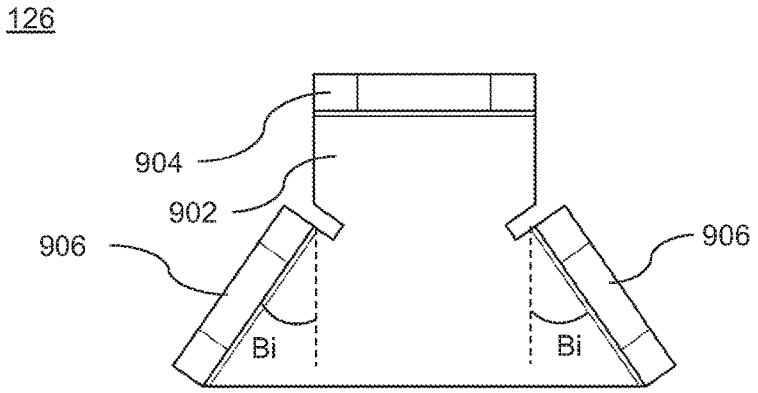
Figure 9E:
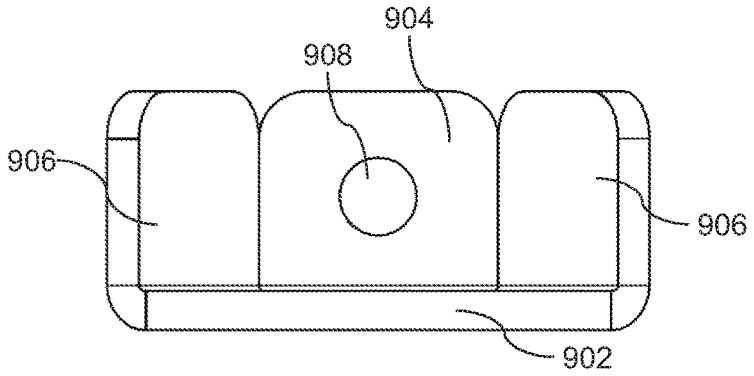

FIG. 8 is a front view of an I-beam 800 for use with the framing system 100, in accordance with an embodiment of the present disclosure. The I-beam 800 includes a longitudinal part 802, a first transverse part 804, a second transverse part 806, and a third transverse part 808. In an embodiment, the first transverse part 804 may be disposed at a first end 802*a* of the longitudinal part 802. The third transverse part 808 may be disposed at a second end 802*b* of the longitudinal part 802. Further, the second transverse part 806 may be disposed proximal to the third transverse part 808. In an exemplary embodiment, the second transverse part 806 and the third transverse part 808 may define a pair of beam channels 810. In an embodiment, the I-beam 800 may be attached to the vertical profile 116. In an exemplary embodiment, the third transverse part 808 may slidably received within the central channel 606 of the vertical profile 116 (shown in FIG. 6). In an embodiment, the I-beam 800 may provide strength and rigidity to the framing system 100. Further, a material of the I-beam 800 may include aluminum.

FIG. 9A to 9E are different views of the stake adapter 126 for use with the framing system 100, in accordance with an embodiment of the present disclosure. The stake adapter 126 includes a supporting surface 902, a coupling portion 904, and a pair of angled portions 906. In an embodiment, the coupling portion 904 may define a hole 908. In some embodiments, the stake adapter 126 may be used to couple the stake 128 to the horizontal profile 118. In an embodiment, the hole 908 may be configured to receive a fastener (not shown in FIG. 9A-9E) therethrough to couple the stake adapter 126, the stake 128 and at least one horizontal profile 118 to each other. In an embodiment, each of the pair of angled portions 906 is inclined at an angle "Bi" relative to the coupling portion 904. In an exemplary embodiment, the pair of angled portions 906 and at least one horizontal profile 118 at least partially receive the stake 128 therebetween.

In an embodiment, the stake adapter 126 may be made of a die cast alloy with a coating. In an embodiment, a plurality of the stake adapters 126 may be coupled to the horizontal profile 118 of the framing system 100. In alternative embodiments, the stake adapter 126 may be coupled to the horizontal profile 118 by various attachment methods such as, but not limited to, welding, adhesives, brazing, mechanical joints, and so forth.

In some embodiments, a material of the stake adapters 126 may include aluminum. In an embodiment, the stake adapters 126 may be treated, using a mechanical tool or a chemical solvent, to break sharp edges, which may otherwise harm a user while installation. In some embodiments, the stake adapters 126 may undergo a power coating process in order to obtain a desired color. In an embodiment, the color of the stake adapters 126 may match a color of each of the different components of the framing system 100. In some embodiments, the stake adapters 126 may be provided with a lead-free coating. In an embodiment, the stake adapters 126 may undergo various corrosion tests such as, a salt spray test, to maintain strength of the framing system 100. In some embodiments, the stake adapters 126 may be coated with a glossy material to enhance the aesthetic features of the framing system 100.

Figure 10:
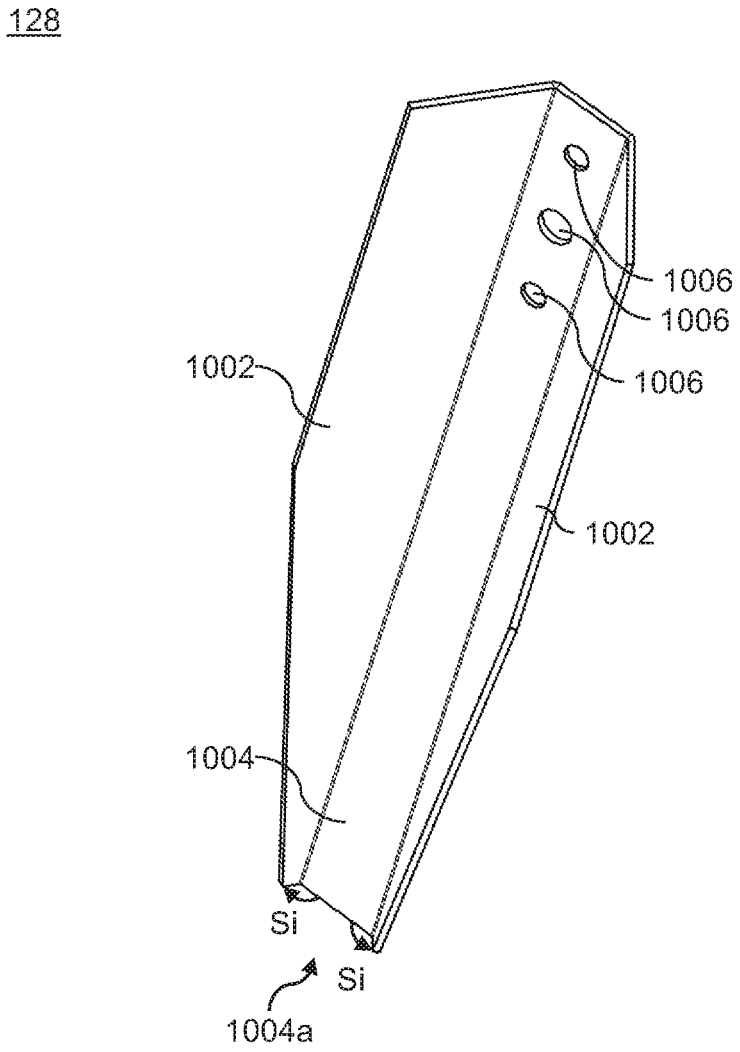
FIG. 10 is a perspective view of a stake for use with the framing system, in accordance with an embodiment of the present disclosure.

FIG. 10 is a perspective view of the stake 128 for use with the framing system 100, in accordance with an embodiment of the present disclosure. The stake 128 may include a pair of angled components 1002 and a coupling component 1004. In an embodiment, each of the pair of angled components 1002 is inclined at an angle "Si" relative to the coupling component 1004. In some embodiments, the angle "Si" may be substantially equal to the angle "Bi" between each of the angled portions 906 and the coupling portion 904 of the stake adapter 126 (shown in FIG. 9). In an embodiment, the coupling component 1004 may define a plurality of apertures 1006, vertically aligned at different heights relative to an edge 1004*a* of the coupling component 1004. One of the apertures 1006 may be selected to receive a fastener (not shown in FIG. 10) in order to couple the stake 128 to the horizontal profile 118 and the stake adapter 126 at a desired height. In an embodiment, the stake may be slidably received between the pair of angled portions 906 and the horizontal profile 118. In some embodiments, the stake 128 may be appropriately positioned, such that one of the apertures 1006 may be aligned with the hole 908 of the stake adapter 126, in order to couple the stake 128 to the horizontal profile 118 and the stake adapter 126. In an embodiment, each of the angled components 1002 may have a tapered edge to allow the stake to be easily inserted within the ground surface. In some embodiments, a material of the stake 128 may include aluminum. Further, the stake 128 may be provided with a corrosion resistive coating. In an embodiment, the stake 128 may be coated with a color similar to the other components of the framing system 100 to enhance the aesthetic appeal of the framing system 100.

Figure 11:
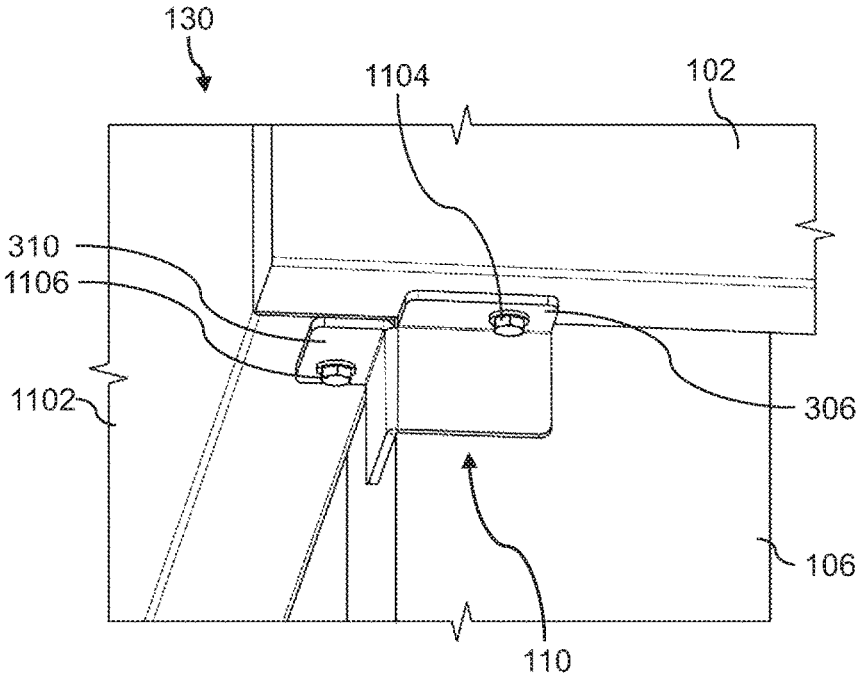
FIG. 11 is a detailed view of a corner of the framing system, in accordance with an embodiment of the present disclosure.

FIG. 11 is a detailed view of the corner 130 of the framing system 100, in accordance with an embodiment of the present disclosure. The first joist 102 and the second joist 1102 intersect each other at the corner 130. Further, the first joist 102 may be attached to a second joist 1102. In an embodiment, the second joist 1102 may be disposed perpendicularly with respect to the first joist 102. In some embodiments, the first joist 102 and the second joist 1102 may be coupled to each other by various methods, such as, but not limited to, welding, brazing, mechanical fasteners, adhesive and so forth. In an exemplary embodiment, the first attachment portion 306 of the corner bracket 110 may be coupled to the first joist 102 by a first fastener 1104. In an exemplary embodiment, the first fastener 1104 may be a self-drilling screw. The first fastener 1104 may extend through the first slot 308 and into the first joist 102 to couple the first attachment portion 306 to the first joist 102. In an exemplary embodiment, the second attachment portion 310 of the corner bracket 110 may be coupled to the second joist 1102 by a second fastener 1106. In an exemplary embodiment, the second fastener 1106 may be a self-drilling screw. The second fastener 1106 may extend through the second slot 312 and into the second joist 1102 to couple the second attachment portion 310 to the second joist 1102. In further embodiments, the first planar portion 302 and the second planar portion 304 may at least partially receive the corner post 106 therebetween. In some embodiments, the corner post 106 may be attached to the corner bracket 110 by various methods, such as, but not limited to, welding, brazing, mechanical fasteners, adhesive and so forth.

Figure 12:
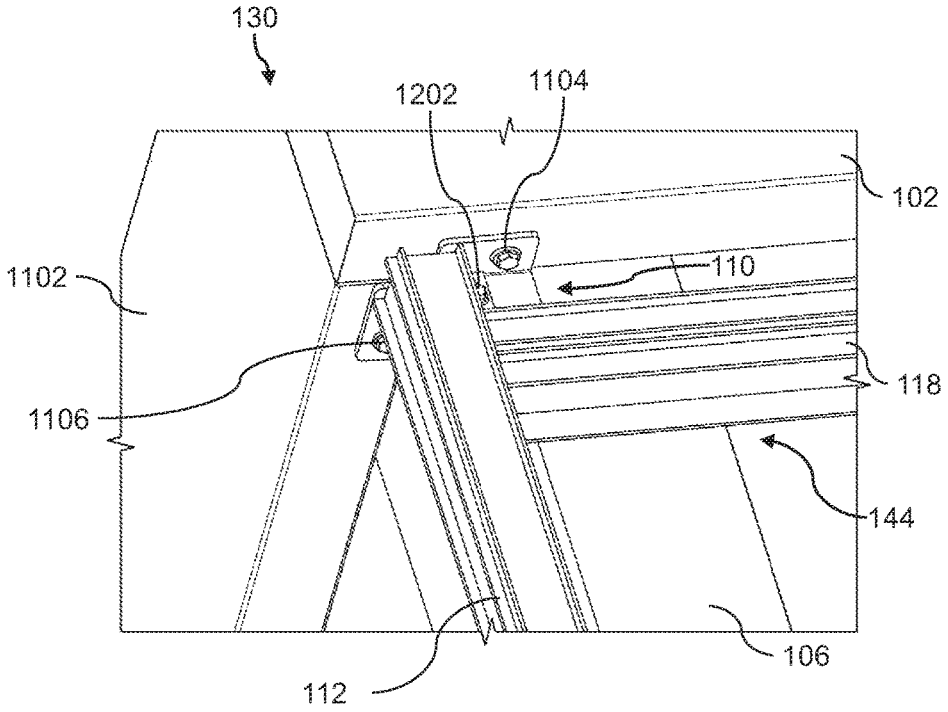
FIG. 12 is a perspective view of a corner joint of the framing system, in accordance with an embodiment of the present disclosure.

FIG. 12 is a perspective view of the corner joint 144 with the corner profile 112 and one of the horizontal profile 118, in accordance with an embodiment of present disclosure. The corner joint 144 is disposed at the corner 130. Further, the corner joint 144 includes the corner bracket 110 coupled to the corner post 106 and the corner profile 112. The first and second fasteners 1104, 1106 couple the corner bracket 110 to the first and second joists 102, 1102, respectively. Further, at least one fastener 1202 may couple the corner profile 112 to the corner bracket 110 and/or the corner post 106. Further, the horizontal profile 118 may be coupled to the corner bracket 110 and/or the corner profile 112 via one or more fasteners (not shown).

Figure 13:
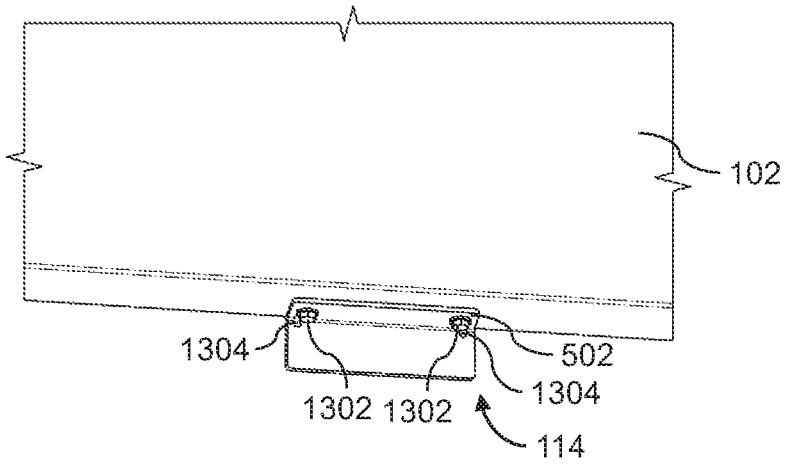
FIG. 13 illustrates a detailed perspective view of a main bracket attached to a first joist, in accordance with an embodiment of the present disclosure.

FIG. 13 illustrates a detailed perspective view of the main bracket 114 attached to the first joist 102, in accordance with an embodiment of the present disclosure. In another embodiment, the main bracket 114 may be attached to the second joist 1102 (shown in FIG. 11). In an exemplary embodiment, the first section 502 of the main bracket 114 may be attached to the first joist 102. In some embodiments, the first section 502 may be coupled to the first joist 102 by a pair of fasteners 1302. In an embodiment, the main bracket 114 may define a pair of extension slots (not shown) which may enhance the strength and/or safety of the main bracket 114. In an embodiment, the main bracket 114 may be attached to the bottom of the first joist 102 at a predetermined distance (for example, four feet) from the corner 130 (shown in FIG. 12). Further, multiple such main brackets 114 may be attached to the first joist 102 and separated from each other by the predetermined distance. The predetermined distance may depend on a size of each of the panels 202 (shown in FIG. 2) and a number of the panels 202. The size and number of the panels 202 may depend on the size of the deck. The main bracket 114 may be oriented such that heads of the pair of fasteners 1302 are visible on the outside of the deck. This may provide accessibility to the fasteners 1302. In an embodiment, one of the vertical profiles 116 (shown in FIG. 1) is attached to the main bracket 114.

Figure 14:
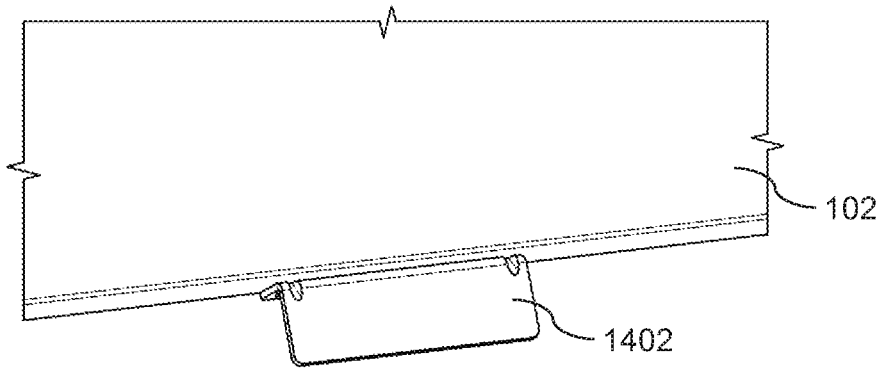
FIG. 14 illustrates a detailed perspective view of an additional main bracket attached to a first joist, in accordance with an embodiment of the present disclosure.

FIG. 14 illustrates a detailed perspective view of an additional main bracket 1402 attached to the first joist 102, in accordance with an embodiment of the present disclosure. The additional main bracket 1402 may be identical to the main bracket 114 (shown in FIG. 13). In an embodiment, if at least one of the panels 202 (shown in FIG. 2) has a length greater than two feet, the additional main bracket 1402 is secured to the first joist 102, thereby proving a mounting point for a fastener at a center of the panel 202, as opposed to only at the four corners. Further, the additional main bracket 1402 may be attached to the first joist 102 via a pair of fasteners (not shown). The additional main bracket 1402 may be oriented so that heads of the pair of fasteners are not visible from the outside of the deck.

Figure 15:
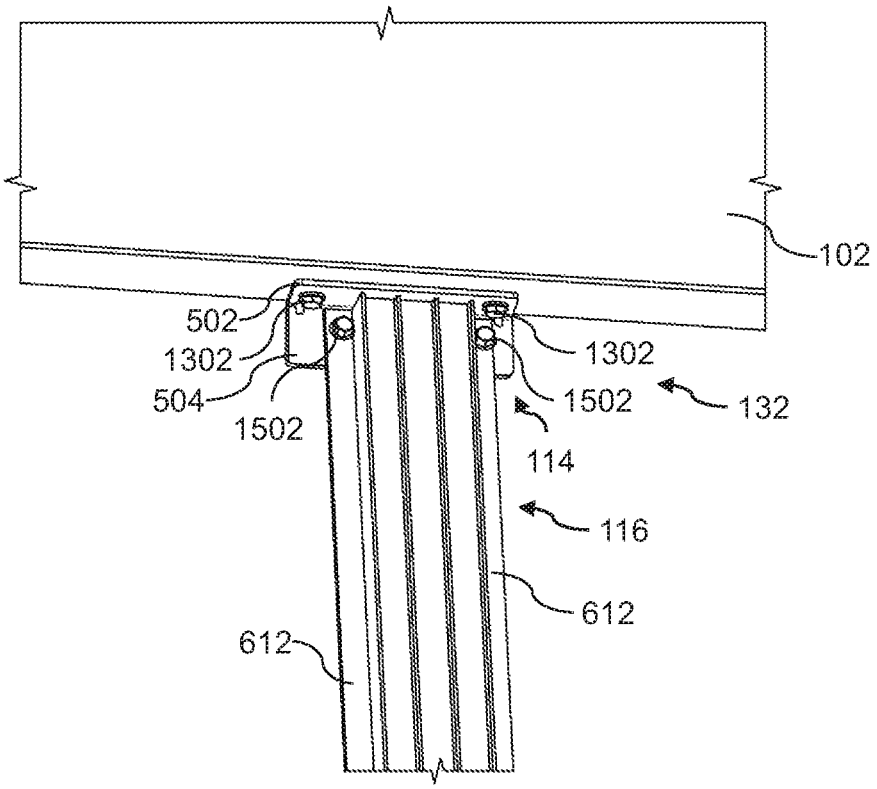
FIG. 15 is a perspective view of a top joint of the framing system, in accordance with an embodiment of the present disclosure.

FIG. 15 is a perspective view of a top joint 132, in accordance with an embodiment of the present disclosure. The top joint 132 includes the vertical profile 116 attached to the main bracket 114. In an exemplary embodiment, the vertical profile 116 may be attached to the main bracket 114 via a pair of fasteners 1502. As illustrated in FIG. 15, the first section 502 of the main bracket 114 is attached to the first joist 102 via the pair of fasteners 1302. In an embodiment, the lateral coupling portions 612 of the vertical profile 116 are attached to the second section 504 of the main bracket 114 by the pair of fasteners 1302. In alternative embodiments, the lateral coupling portions 612 may be attached to the second section 504 by various other methods, such as, but not limited to, welding, brazing, adhesive or a combination thereof. In some embodiments, the second section 504 of the main bracket 114 and each of the lateral coupling portions 612 may define corresponding openings (not shown) for the fasteners 1502. In an embodiment, each of the pair of fasteners 1502 may be a self-drilling screw.

Figure 16:
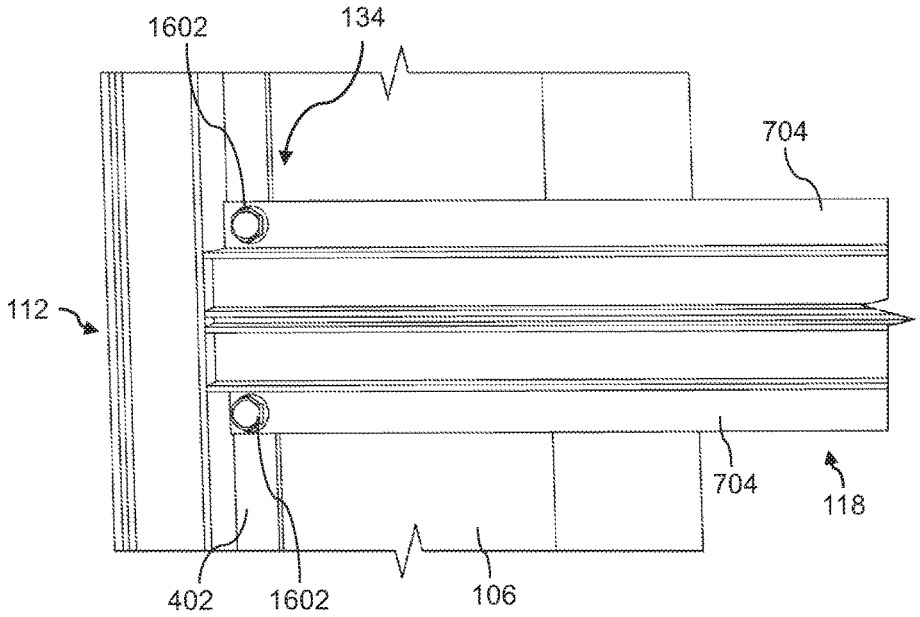
FIG. 16 is a perspective view of a middle joint of the framing system, in accordance with an embodiment of the present disclosure.

FIG. 16 is a perspective view of the first middle joint 134, in accordance with an embodiment of the present disclosure. The first middle joint 134 includes the horizontal profile 118 attached to the corner profile 112. The horizontal profile 118 may be attached to the corner profile 112 by a pair of fasteners 1602. In some embodiments, the fasteners 1602 may couple the horizontal profile 118 to the corner profile 112 as well as the corner post 106. In an exemplary embodiment, the lateral connecting parts 704 of the horizontal profile 118 may be attached to the first attachment portion 402 of the corner profile 112 by the pair of fastener 1602. In alternative embodiments, the lateral connecting parts 704 of the horizontal profile 118 may be attached to the second attachment portion 404 (not shown in FIG. 16) of the corner profile 112 by the pair of fasteners 1602. In some embodiments, each of the pair of fasteners 1602 may pass through the corresponding lateral connecting part 704 of the horizontal profile 118, the first attachment portion 402 of the corner profile 112 and extend into the corner post 106. In an embodiment, each of the pair of fasteners 1602 may be a self-drilling screw. In alternative embodiments, the lateral connecting parts 704 of the horizontal profile 118 may be attached to the corner profile 112 and/or the corner post 106 by various methods, such as, but not limited to, welding, brazing, adhesive or a combination thereof.

Figure 17:
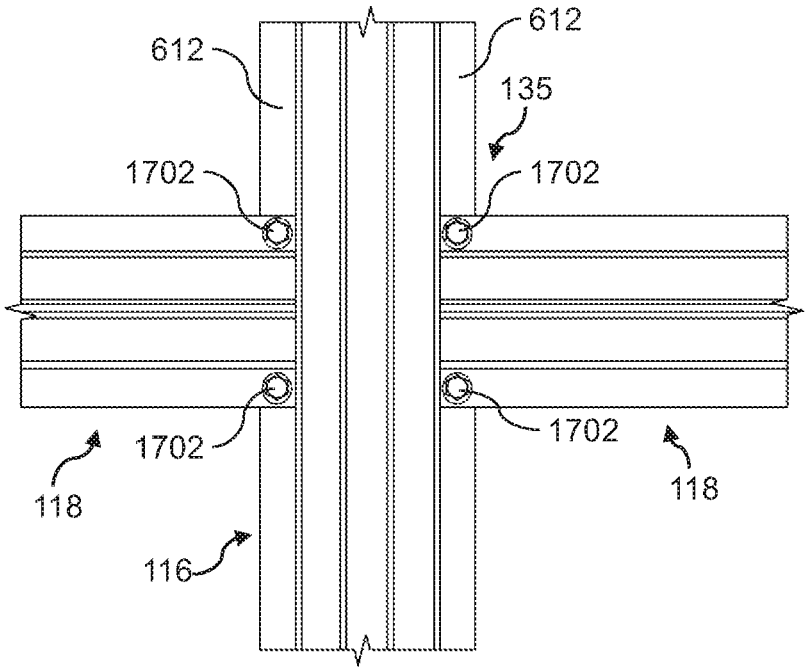
FIG. 17 is a perspective view of another middle joint of the framing system, in accordance with an embodiment of the present disclosure.

FIG. 17 is a perspective view of the second middle joint 135, in accordance with an embodiment of the present disclosure. In an exemplary embodiment, two of the horizontal profiles 118 may be attached to the vertical profile 116 by a plurality of fasteners 1702. The horizontal profiles 118 are connected to the vertical profile 116 at opposite sides. In some embodiments, the lateral connecting parts 704 of each of the horizontal profiles 118 may be attached to the corresponding lateral coupling portion 612 of the vertical profile 116. In some embodiments, each of the plurality of the fasteners 1702 may extend through the corresponding lateral connecting part 704 of the horizontal profile 118 and into the corresponding lateral coupling portion 612 of the vertical profile 116. In an embodiment, each of the plurality of fasteners 1702 may be a self-drilling screw. As illustrated in FIG. 17, each of the horizontal profiles 118 may be attached to the vertical profile 116 via two of the fasteners 1702. A number of the horizontal profiles 118 may be determined a number and a length of each of the vertical profiles 116. Further, a location of the second middle joint 135 may be determined by a height of each of the panels 202 (shown in FIG. 2). The second middle joint 135 and the first middle joint 134 may be located at a similar height.

Figure 18:
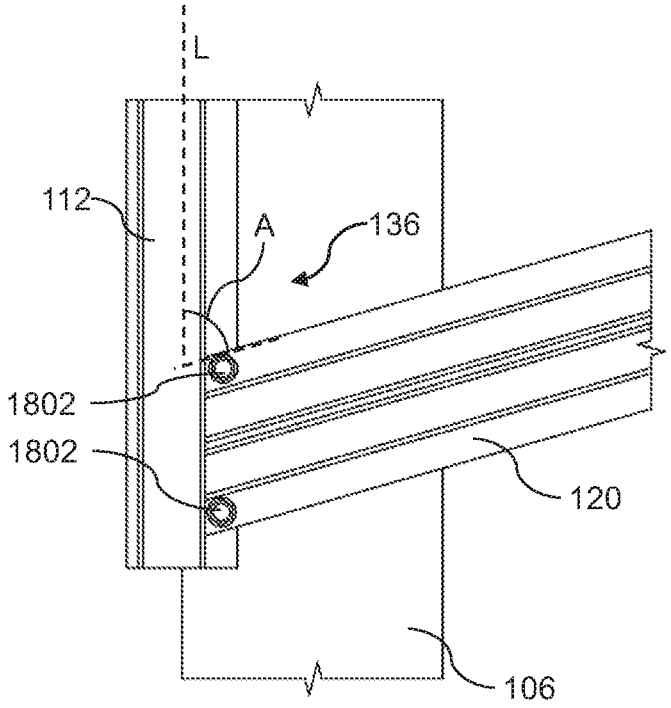
FIG. 18 is a perspective view of a first bottom joint of the framing system, in accordance with an embodiment of the present disclosure.

FIG. 18 is a perspective view of the first bottom joint 136, in accordance with an embodiment of the present disclosure. The first bottom joint 136 includes the inclined profile 120 attached to the corner profile 112. The inclined profile 120 may be attached to the corner profile 112 by a pair of fasteners 1802. In some embodiments, the fasteners 1802 may couple the inclined profile 120 to the corner profile 112 as well as the corner post 106. In an embodiment, each of the pair of fasteners 1802 may be a self-drilling screw. In an embodiment, one of the horizontal profiles 118 may be angle cut to match the grade of the ground surface, thereby forming the inclined profile 120. Moreover, the inclined profile 120 may be inclined at the oblique angle "A" with respect to the longitudinal axis "L".

Figure 19:
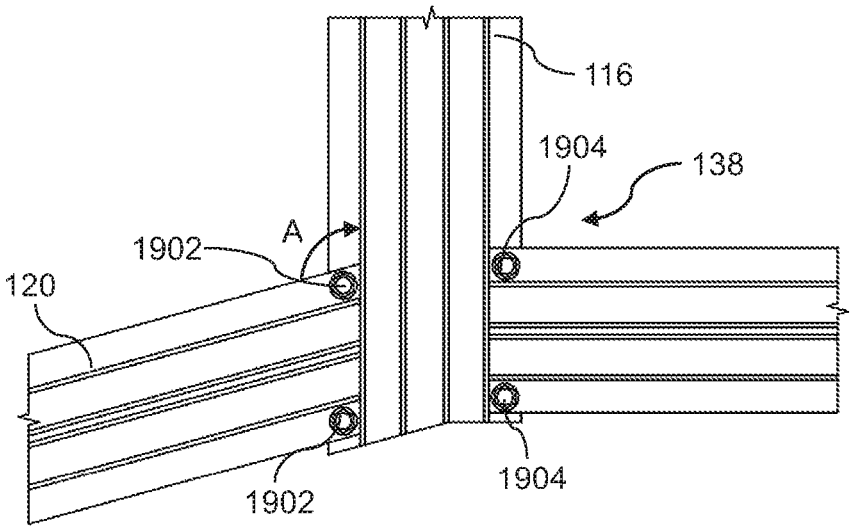
FIG. 19 is a perspective view of another bottom joint of the framing system, in accordance with an embodiment of the present disclosure.

FIG. 19 is a perspective view of the second bottom joint 138, in accordance with an embodiment of the present disclosure. The second bottom joint 138 includes the inclined profile 120 and one of the horizontal profiles 118 attached to the vertical profile 116. The inclined profile 120 may be attached to the vertical profile 116 by a pair of fasteners 1902. Similarly, the horizontal profile 118 is attached to the vertical profile 116 by a pair of fasteners 1904. In an embodiment, each of the plurality of fasteners 1902, 1904 may be a self-drilling screw. The inclined profile 120 and the horizontal profile 118 are connected to opposite sides of the vertical profile 116. Moreover, the inclined profile 120 may be inclined at the oblique angle "A" with respect to the vertical profile 116. On the other hand, the horizontal profile 118 may be oriented substantially perpendicular with respect to the vertical profile 116.

Figure 20:
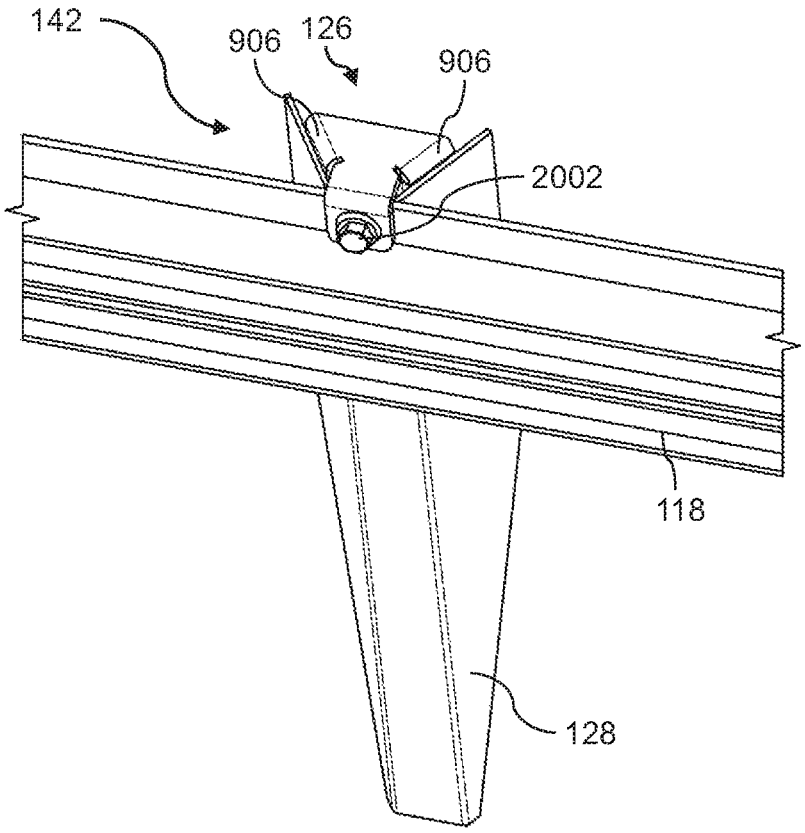
FIG. 20 is a perspective view of a stake joint of the framing system, in accordance with an embodiment of the present disclosure.

FIG. 20 is a perspective view of the stake joint 142, in accordance with an embodiment of the present disclosure. The stake joint 142 includes the stake 128, the stake adapter 126 and one of the horizontal profiles 118. The stake 128 may be slidably received between the angled portions 906 of the stake adapter 126 and the horizontal profile 118. Further, a fastener 2002 may be inserted into the hole 908 (shown in FIGS. 9A to 9D), through the horizontal profile 118 and one of the apertures 1006 (shown in FIG. 10) of the stake 128. One of the apertures 1006 may be selected based on a desired height of the stake 128. One or more washers (not shown) may also be used in the stake joint 142. In an embodiment, the fastener 2002 may be a self-drilling screw. Another stake 128 may be similarly coupled to the inclined profile 120.

Figure 21:
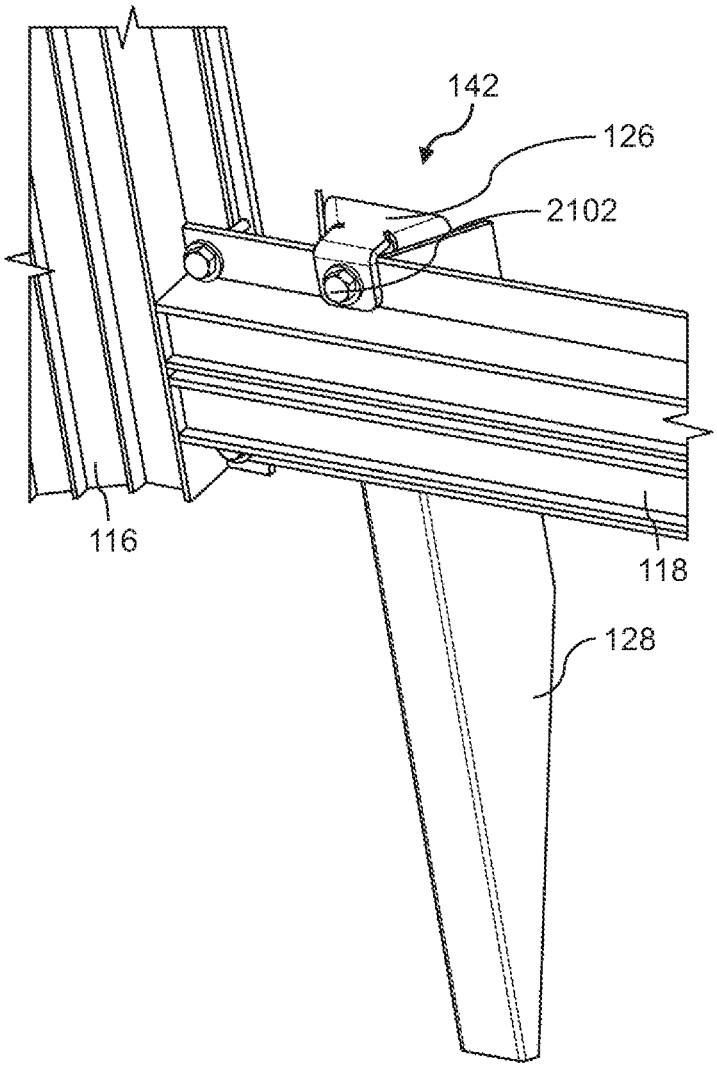
FIG. 21 is a perspective view of another stake joint of the framing system, in accordance with an embodiment of the present disclosure.

FIG. 21 is a perspective view of another stake joint 142 adjacent to the second bottom joint 138, in accordance with an embodiment of the present disclosure. As illustrated in FIG. 21, a fastener 2102 is used in the stake joint 142. The stake joint 142 attaches the stake 128 with one of the horizontal profiles 118 at one side of the second bottom joint 138. Similarly, another stake 128 may be attached to the inclined profile 120 (shown in FIG. 1) at another side of the second bottom joint 138. In an embodiment, at least one of the stakes 128 may be used for each of the vertical profiles 116. Further, the framing system 100 may include multiple such stake joints 142 based on a horizontal distance between two adjacent vertical profiles 116. Moreover, a number of stake joints 142 may also be based on a horizontal distance between the corner profile 112 and the adjacent vertical profile 116.

Figure 22:
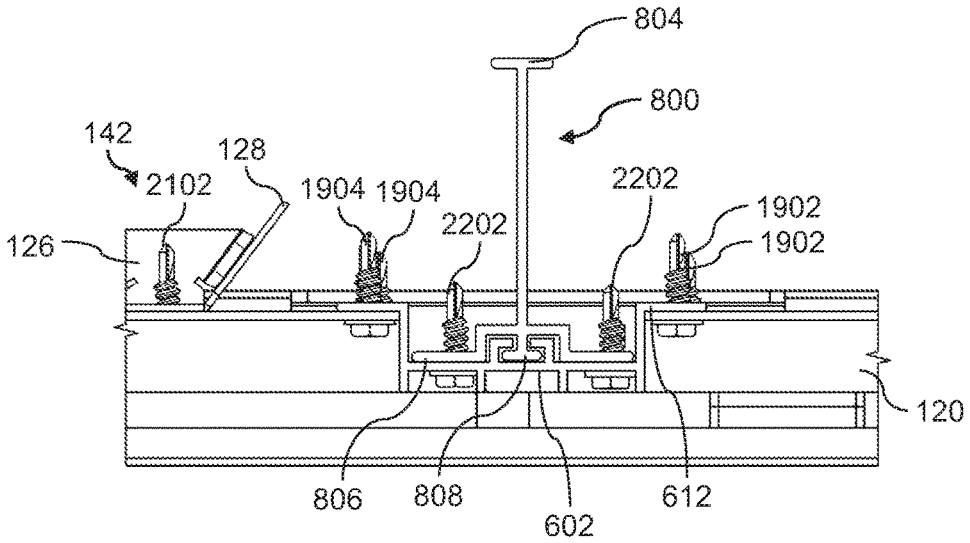
FIG. 22 is a bottom view of a bottom joint of the framing system, in accordance with an embodiment of the present disclosure.

FIG. 22 is a bottom view of the second bottom joint 138, in accordance with an embodiment of the present disclosure. As illustrated in FIG. 22, the fasteners 1902 couple the inclined profile 120 to one of the lateral coupling portions 612 of the vertical profile 116. Further, the fasteners 1904 couple the respective lateral connecting parts 704 of the horizontal profile 118 to another lateral coupling portion 612 of the vertical 116. The stake joint 142 is used to attach the stake 128 to the horizontal profile 118 via the stake adapter 126 and the fastener 2102. Further, the third transverse portion 808 of the I-beam 800 is slidably received within the central channel 606 of the vertical profile 116. The central coupling portions 604 may be at least partially received within respective beam channels 810 (shown in FIG. 8) of the I-beam 800. The I-beam 800 may impart additional rigidity to the framing system 100. Further, a pair of fasteners 2202 may be used to attach the corresponding second transverse portions 806 of the I-beam 800 to the middle portion 602 of the vertical profile 116. In an embodiment, each of the fasteners 2202 may be a self-drilling screw.

Figure 23:
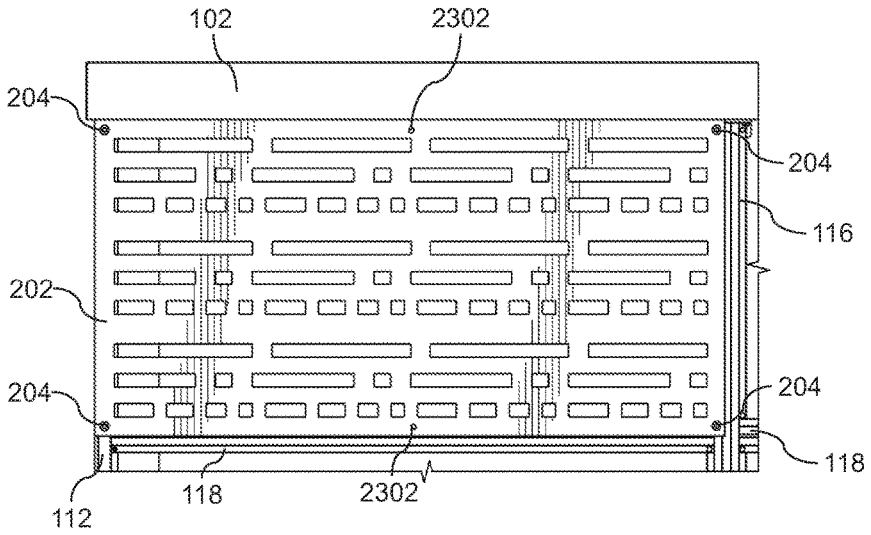
FIG. 23 is a partial front view of the framing system with a panel, in accordance with an embodiment of the present disclosure.

FIG. 23 illustrates a partial front view of the framing system 100 with one of panels 202 attached, in accordance with an embodiment of present disclosure. In some embodiments, the panel 202 may be attached to the corner profile 112 via the fasteners 204. Further, the panel 202 may be attached to the vertical profile 116 and the horizontal profile 118 via the fasteners 204. In an exemplary embodiment, the panel 202 may include a pair of additional holes 2302 configured to receive a pair of fasteners (not shown) to hold the panel 202 more securely. In some embodiments, a number of the additional holes 2302 may depend upon a length of the panel 202. In an embodiment, one of the additional holes 2302, proximal to the first joist 102, may allow the panel 202 to be attached to one of the additional main bracket 1402 (shown in FIG. 14), while another additional hole 2302 may allow the panel 202 to be attached to the horizontal profile 118.

Figure 24:
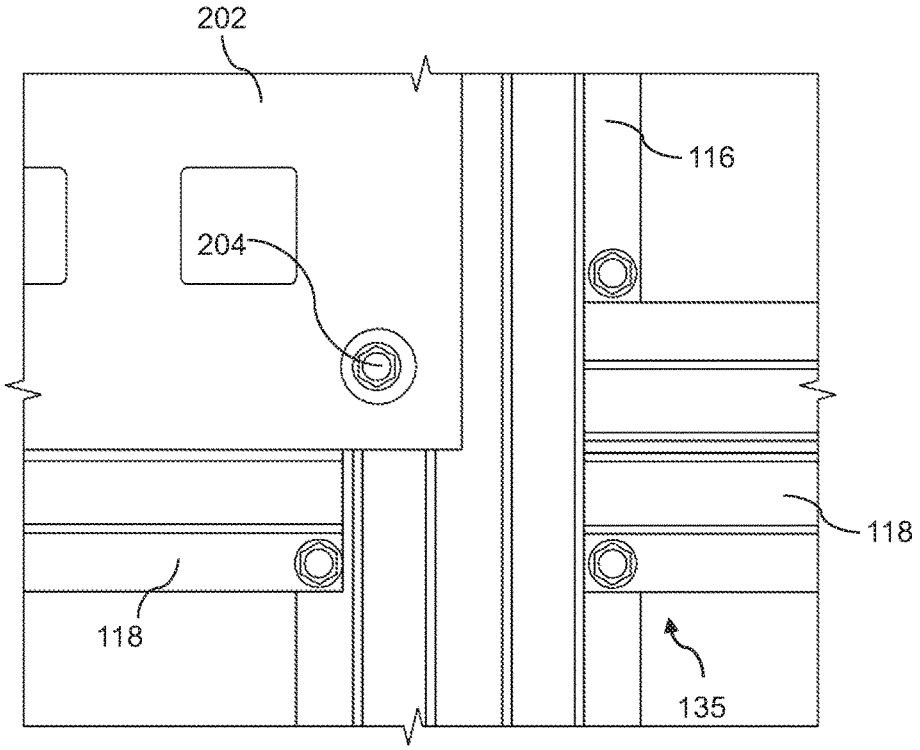
FIG. 24 is a front view of a middle joint of the framing system, in accordance with an embodiment of the present disclosure.

FIG. 24 is detailed front view of the second middle joint 135, in accordance with an embodiment of present disclosure. The panel 202 is connected to the vertical profile 116 via the fastener 204. In an embodiment, the panel 202 may include an indentation (not shown) at a corner for indicating a recommended fastener location. For installation, a hole (not shown) may be drilled in the center of the indentation. The fastener 204 may be inserted through the hole and an aligned hole (not shown) in the vertical profile 116 in order to secure the panel 202 to the vertical profile 116. The fastener 204 may be a screw. In some embodiments, a fastener cover (not shown) may be placed over the fastener 204 to hide the fastener 204. In an embodiment, the fastener 204 may extend into the vertical profile 116 and/or the horizontal profile 118 for improved retention of the panel 202

Figure 25:
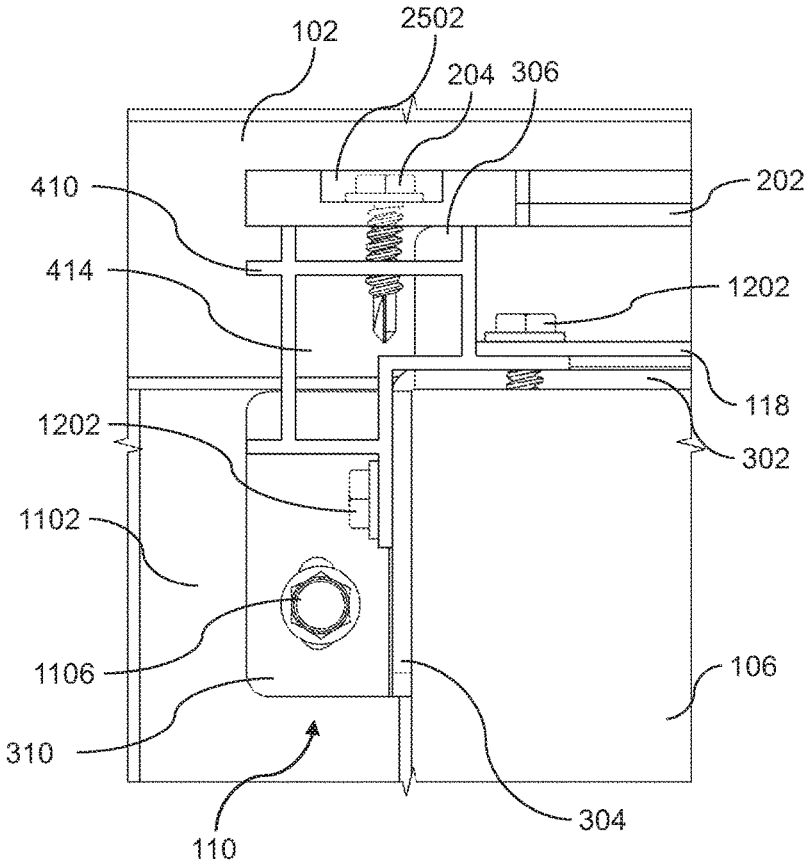
FIG. 25 is a bottom view of a corner joint of the framing system, in accordance with an embodiment of the present disclosure.

FIG. 25 illustrates a bottom view of the corner joint 144, in accordance with an embodiment of present disclosure. As illustrated in FIG. 25, the corner bracket 110 is connected to first joist 102 and the second joist 1102. The first attachment part 306 of the corner bracket 110 is attached to the first joist 102 via the first fastener 1104 (shown in FIG. 11). The second attachment part 310 of the corner bracket 110 is attached to the second joist 1102 via the second fastener 1106. Further, the first planar portion 302 and the second planar portion 304 of the corner bracket 110 at least partially receive the corner post 106 therebetween. The corner profile 112 is attached to the corner bracket 110 and/or the corner post 106. In an exemplary embodiment, the corner profile 112 is coupled to the corner bracket 110 and/or the corner post 106 via the fasteners 1202. In an embodiment, one of the fasteners 1202 may also couple the horizontal profile 118 to the corner profile 112, the corner bracket 110 and the corner post 106. In an exemplary embodiment, the panel 202 is attached to the corner profile 112 via the fastener 204. In an embodiment, the fastener 204 may pass through the panel 202, through the first outer portion 410 of the corner profile 112 and extend into the central cavity 414 of the corner profile 112. In some embodiments, a fastener cover 2502 may hide the fastener 204 to enhance an aesthetic appeal of the framing system 100.

Figure 26:
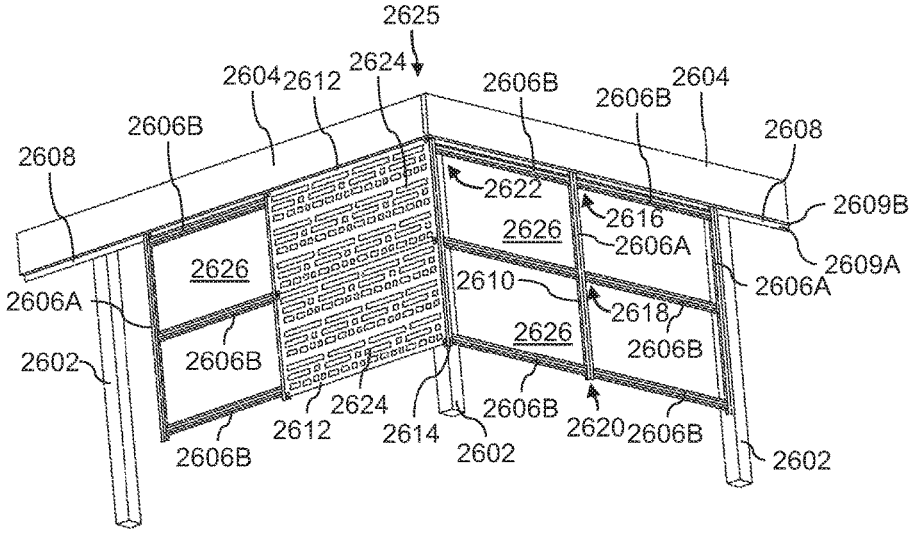
FIG. 26 illustrates a perspective view of a framing system, in accordance with an embodiment of the present disclosure.

FIG. 26 illustrates a perspective view of a framing system or assembly 2600, in accordance with an embodiment of the present disclosure. The framing system 2600 can be installed in any outdoor region including, but not limited to, yards, lawns, gardens, outdoor decks, porches, stairway and the like. In an embodiment, the framing system 2600 may be an under deck framing system configured to be installed beneath a deck substrate or frame (not shown). In an exemplary embodiment, the framing system 2600 may support a panel to cover a gap underneath the deck substrate (interchangeably referred to as "the deck"). Further, the framing system 2600 may also support the deck substrate.

The framing system 2600 includes multiple posts 2602, multiple top members 2604, at least one vertical elongate profile 2606A, at least one horizontal elongate profile 2606B, angled profiles 2608, at least one beam 2610, multiple lattice panels 2612 and at least one corner bracket 2614. In the illustrated embodiment of FIG. 26, the framing system 2600 includes multiple vertical elongate profiles 2606A and horizontal elongate profiles 2606B. Each of the vertical elongate profiles 2606A is connected to one or more of the horizontal elongate profiles 2606B. Further, the framing system 2600 is configured to support the lattice panels 2612.

The framing system 2600 further includes at least one top joint 2616, at least one middle joint 2618, at least one bottom joint 2620 and at least one corner joint 2622.

The posts 2602 may be anchored to a solid surface, such as a side of a building, or may be sunk into a ground surface for support. In an embodiment, each of the posts 2602 may have a solid configuration. In an alternative embodiment, each of the posts 2602 may have a hollow configuration. In a further embodiment, each of the posts 2602 may have dimensions of 4 inches×4 inches.

In an embodiment, each of the top members 2604 may have a solid configuration. Further, the top members 2604 may be joists of a deck. In an alternative embodiment, the each of the top members 2604 may have a hollow configuration. In a further embodiment, each of the top members may be an elongate member having dimensions of 2 inches× 10 inches. In an embodiment, each of the top members 2604 may be a part of the deck substrate. In another embodiment, each of the top members 2604 may be disposed between the overlying deck substrate and the angled profile 2608. In some embodiments, each of the top members 2604 may be secured to the deck substrate by any suitable attachment methods such as, mechanical fasteners, adhesives, brazing, welding and so forth.

In an embodiment, the posts 2602 may be connected to the respective top members 2604, the angled profiles 2608, the horizontal elongate profiles 2606B, the vertical elongate profiles 2606B and/or the corner bracket 2614 by various methods, such as, but not limited to, welding, adhesives, brazing, mechanical joints, fasteners, and so forth. The fasteners may include screws, nut and bolts, studs, and the like.

In an exemplary embodiment, each of the angled profiles 2608 may be attachable to the deck. Specifically, each of the angled profiles 2608 may be attachable to the respective top member 2604 of the deck. In some embodiments, each of the angled profiles 2608 may be coupled to a lower surface of the respective top member 2604 by various methods, such as, but not limited to, welding, adhesives, brazing, mechanical joints, fasteners, and so forth. In a further embodiment, the angled profiles 2608 may be coupled to the respective vertical elongate profiles 2606A by various methods, such as, but not limited to, welding, adhesives, brazing, mechanical joints, fasteners, and so forth. In an exemplary embodiment, each of the angled profiles 2608 includes a first portion 2609A attachable to the deck or a respective top member 2604. Each of the angled profiles may also include a second portion 2609B perpendicular to the first portion 2609A. The second portion 2609B may be attachable to the at least one vertical elongate profile 2606A. In some embodiments, the first portion 2609A of each of the angled profiles 2608 may define a plurality of apertures (not shown in FIG. 26) spaced apart from each other. Each of the plurality of apertures may be configured to receive a fastener therethrough to secure the first portion 2609A to the deck or the respective top member 2604. In an embodiment, the at least one vertical elongate profile 2606A may be attachable to the respective angled profile 2608 by various methods, such as, but not limited to, welding, adhesives, brazing, mechanical joints, fasteners, and so forth. In an exemplary embodiment, the at least one vertical elongate profile 2606A may include a pair of vertical lateral channels (not shown in FIG. 26). In some embodiments, each of the pair of vertical lateral channels may be configured to at least partly receive therein a pair of projecting portions of at least one connector sleeve (not shown in FIG. 26). In an embodiment, the at least one vertical elongate profile 2606A may be secured to the connector sleeve by any suitable attachment methods. The attachment methods may include, but not limited to, mechanical fasteners, adhesives, brazing, welding and so forth. In an exemplary embodiment, the framing system 2600 may include at least one first fastener (not shown in FIG. 26) configured to secure the at least one vertical elongate profile 2606A to the at least one connector sleeve. In an embodiment, the at least one vertical elongate profile 2606A may also include a central channel (not shown in FIG. 26). The central channel may be configured to slidably receive the beam 2610 in order to attach the beam 2610 to the at least one vertical elongate profile 2606A.

In an embodiment, the at least one horizontal elongate profile 2606B may be coupled to at least one vertical elongate profile 2606A by various methods, such as, but not limited to, welding, adhesives, brazing, mechanical joints, fasteners, and so forth. In some embodiments, the at least one horizontal elongate profile 2606B may include a pair of horizontal lateral channels (not shown in FIG. 26). Each of the pair of horizontal lateral channels may be configured to at least partially receive therein a corresponding projecting portion of the pair of projecting projections of the connector sleeve. In an embodiment, the connector sleeve may also include a clip portion connecting the pair of projecting portions to each other. In some embodiments, the clip portion and the pair of projecting portions may define a gap therebetween. In an exemplary embodiment, the at least one horizontal elongate profile 2606B may also include a pair of lower flanges (not shown in FIG. 26) configured to be slidably inserted into the space defined between the clip portion and the pair of projections of the connector sleeve. In an embodiment, the at least one horizontal elongate profile 2606B may be secured to the connector sleeve by any suitable attachment methods. The attachment methods may include, but not limited to, mechanical fasteners, adhesives, brazing, welding and so forth. In an exemplary embodiment, the framing system 2600 may include at least one second fastener (not shown in FIG. 26) configured to secure the at least one horizontal elongate profile 2606B to the at least one connector sleeve.

In an embodiment, the lattice panels 2612 (interchangeably referred to as "the panels 2612") may be coupled to the respective vertical elongate profile(s) 2606A and/or the horizontal elongate profile(s) 2606B by various methods, such as, but not limited to, welding, adhesives, brazing, mechanical joints, fasteners, and so forth.

In various embodiments, each of the lattice panels 2612 may have different designs, for example, but not limited to, Morse sheeting, Celtic sheeting, fretwork sheeting, sprig sheeting, and so forth. Each of the lattice panels 2612 may have multiple openings 2624 having one or more shapes. Each lattice panel 2612 may be a sheet having dimensions of 4 feet×2 feet×0.3 inch.

In an embodiment, the beam 2610 may be coupled to the respective vertical elongate profile(s) 2606A and/or the horizontal elongate profile(s) 2606B by various methods, such as, but not limited to, welding, adhesives, brazing, mechanical joints, fasteners, and so forth. The beam 2610 may have be substantially I-shaped. In an exemplary embodiment, the beam 2610 may include a longitudinal portion and a transverse portion perpendicular to the longitudinal portion. In some embodiments, the transverse portion may be configured to be slidably received within the central channel of the at least one vertical elongate profile 2606A. Further, the beam 2610 may act as a reinforcing member to allow installation of the framing system 2600 at beachside homes or structures which are typically elevated by at least one story with respect to the ground. Therefore, the beam 2610 may enable the framing system 2600 to support deck substrates or frames that are elevated by one or more stories with respect to the ground.

In an embodiment, the corner bracket 2614 may be used for connecting two straight sections of the framing system 2600 at an intersection or corner 2625. The straight sections may be defined by the top members 2604. Therefore, the corner bracket 2614 may enable installation of multiple straight sections as per requirements. In an exemplary embodiment, the corner bracket 2614 may include a pair of corner channels (not shown in FIG. 26) perpendicular to each other. In some embodiments, each of the pair of corner channels may at least partially receive therein a pair of projecting portions of at least one corner sleeve (not shown in FIG. 26). Further, the corner sleeve may attach the corresponding horizontal elongate profile 2606B to the corner bracket 2614. Consequently, the corner bracket 2614 may enhance flexibility for a user during installation. Further, the corner bracket 2614 may also reduce or limit Stock Keeping Units (SKUs), thereby reducing a number of distinct parts required for the framing system 2600. In an exemplary embodiment, the framing system 2600 may also include a corner cover (not shown in FIG. 26). The corner cover may be slidably received on the corner bracket 2614. In some embodiments, the corner cover may enhance the aesthetic appeal of the framing system 2600. In some other embodiments, the corner cover may protect the corner bracket 2614 from external elements (e.g., moisture, dust etc.).

In various embodiments, the components of the framing system 2600, namely, the posts 2602, the top members 2604, the vertical elongate profiles 2606A, the horizontal elongate profiles 2606B, the angled profiles 2608, the beam 2610, the panels 2612 and the corner bracket 2614 may be made of different materials, such as, but not limited to, plastic, metal or metal alloys, wood, composites, and so forth. In an embodiment, the vertical elongate profiles 2606A, the horizontal elongate profiles 2606B, the angled profiles 2608, the beam 2610 and the corner bracket 2614 may be made primarily of aluminum instead of wood. Therefore, the framing system 2600 may not decay when in contact with the ground and moisture.

In an embodiment, the framing system 2600 may also include at least one inclined elongate profile (not shown in FIG. 26) inclined at an oblique angle relative to the at least one vertical elongate profile 2606A. In some embodiments, the at least one inclined elongate profile includes a pair of lateral channels. The at least one inclined elongate profile may support one or more of the panels 2612. In some other embodiments, the framing system 2600 may also include at least one inclined connector sleeve (not shown in FIG. 26). In an embodiment, the at least one inclined connector sleeve may include a body having a rounded portion at a first end. In some embodiments, the body is configured to be at least partially received within one of the pair of lateral channels of the at least one inclined elongate profile. Further, the rounded portion of the body is configured to be received within one of the pair of vertical lateral channels of the at least one vertical elongate profile 2606A. In some embodiments, the rounded portion of the body may allow angular adjustment of the at least one inclined elongate profile during assembly. In alternative embodiments, the at least one inclined connector sleeve may be fixedly attached to the at least one vertical elongate profile 2606A. The at least one inclined connector sleeve further includes a clip connected to the body adjacent to a second end opposite to the first end. The clip is configured to secure the body to the at least one inclined elongate profile. In some embodiments, the at least one inclined connector sleeve may be attached to the vertical elongate profile 2606A and/or the at least one inclined elongate profile by any suitable attached methods such as, but not limited to, mechanical fasteners, welding, adhesives, brazing and so forth.

As illustrated in FIG. 26, the vertical and horizontal elongate profiles 2606A, 2606B define a grid having multiple rectangular sections 2626. Each rectangular section 2626 may receive at least one of the lattice panels 2612 thereon. Though only two lattice panels 2612 are shown in FIG. 26, the framing system 2600 may include eight lattice panels 2612 installed in the eight rectangular sections 2626. The framing system 2600 may be easy to install, and may not decay when in contact with the ground and moisture. Further, the framing system 2600 may have a modular configuration that encloses a gap underneath a deck substrate. For example, the number of rectangular sections 2626 may be changed based on a desired number of lattice panels 2612. The lattice panels 2612 may at least partly enclose the gap underneath the deck substrate. Further, the framing system 2600 may be able to receive additional components, such as drawers or boxes for storage. In an example, the additional components may be installed along an available length, of the top member 2604 and the corresponding angled profile 2608 that is not utilized for installing the lattice panels 2612.

In an embodiment, the angled profiles 2608 may be attached to the corresponding top members 2604. In another embodiment, the angled profiles 2608 may be pre-installed with the corresponding top members 2604. The vertical elongate profiles 2606A may be coupled to the corresponding angled profiles 2608 via fasteners (e.g., screws). The horizontal elongate profiles 2606B are attached to the corresponding vertical elongate profiles 2606A via one or more adapter clips (not shown in FIG. 26) to create the grid of rectangular sections 2626.

Figure 27:
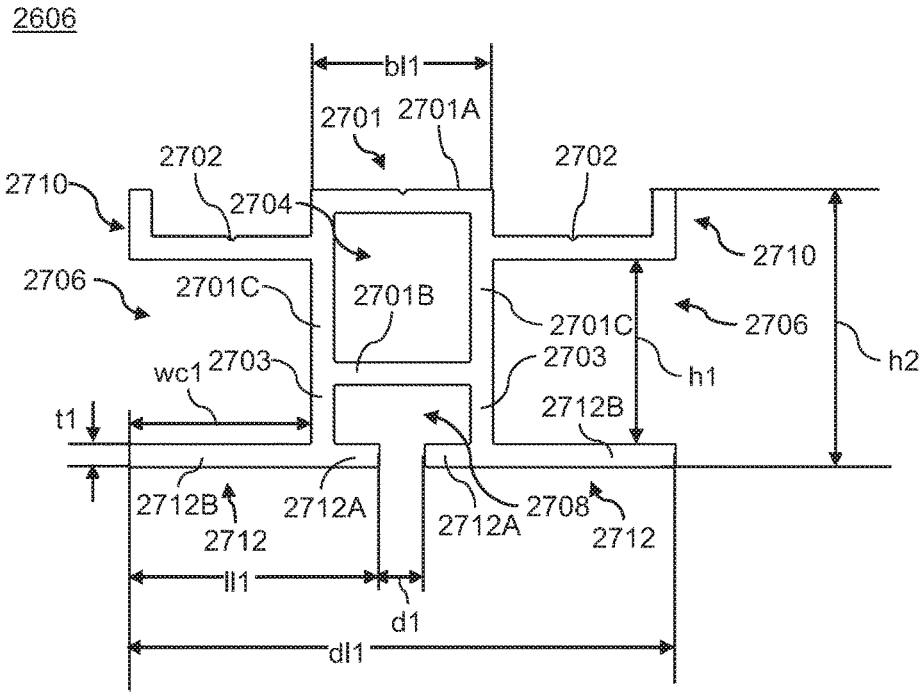
FIG. 27 is a front view of an elongate profile for use with the framing system, in accordance with an embodiment of the present disclosure.

FIG. 27 illustrates an elongate profile 2606, in accordance with an aspect of the present disclosure. The elongate profile 2606 may be the vertical elongate profile 2606A and/or the horizontal elongate profile 2606B of FIG. 26. In some embodiments, the elongate profile 2606 may be the inclined elongate profile. In an embodiment, the elongate profile 2606 may be an extruded profile. Further, a material of the elongate profile 2606 may include aluminum. In an embodiment, the elongate profile 2606 includes a main body 2701, a pair of upper flanges 2710 and a pair of lower flanges 2712. The main body 2701 may further include a first side 2701A, a second side 2701B opposite to the first side 2701A and a pair of lateral sides 2701C. In an exemplary embodiment, the first side 2701A, the second side 2701B, and the pair of lateral sides 2701C may together define a longitudinal opening 2704. In an embodiment, the main body 2701 may have a substantially rectangular shape. Further, the main body 2701 may have a width "bl1" corresponding to a length of each of the first and second sides 2701A, 2701B. In some embodiments, each of the pair of upper flanges 2710 may extend perpendicularly from respective lateral sides 2701C. In an embodiment, each of the pair of upper flanges 2710 may have a L-shaped structure. Further, each of the pair of upper flanges 2710 may include a screw locator groove 2702. The screw locator grooves 2702 may indicate drilling locations for screws during assembly. In an embodiment, an edge of each of the pair of upper flanges 2710 may be vertically aligned with the first side 2701A of the main body 2701.

In some embodiments, the elongate profile 2606 may include a pair of connecting members 2703 extending from the pair of lateral sides 2701C of the main body 2701. In an exemplary embodiment, each of the pair of lower flanges 2712 may be connected to the respective connecting member 2703. Moreover, each of the pair of lower flanges 2712 may be perpendicular to the respective connecting member 2703. Each of the lower flanges 2712 may have a length "111". Further, each of the pair of lower flanges 2712 is separated by a distance "d1". In an embodiment, the distance "d1" may lie within a range from about 0.1 to 0.2 inches. In an exemplary embodiment, the distance "d1" may be about 0.125 inches. In some embodiments, each of the pair of lower flanges 2712 may have a thickness "t1". In an embodiment, the thickness "t1" may lie within a range from about 0.05 to 0.07 inches. In an exemplary embodiment, the thickness "t1" may be about 0.063 inches. Further, the second side 2701B, the pair of connecting members 2703 and a first portion 2712A of each of the pair of lower flanges 2712 may define a central channel 2708. In an embodiment, each of the pair of upper flanges 2710, each of the pair of lateral sides 2701C, each of the pair of connecting members 2703, and a second portion 2712B of each of the pair of the lower flanges 2712 may define a lateral channel 2706. Therefore, the elongate profile 2606 includes a pair of lateral channels 2706. In an embodiment, the pair of lateral channels 2706 may correspond to the pair of vertical lateral channels of the vertical elongate profile 2606A, or the pair of horizontal lateral channels of the horizontal elongate profile 2606B. In another embodiment, the pair of lateral channels 2706 may further correspond to the pair of lateral channels of the at least one inclined elongate profile.

In an embodiment, each of the pair of the lateral channels 2706 may have a height "h1". In some embodiments, the height "h1" may lie within a range from about 0.25 to 0.75 inches. In an exemplary embodiment, the height "h1" may be about 0.500 inches. Further, the elongate profile 2606 may have a height "h2". The height "h2" may lie within a range from about 0.5 to 1 inches. In an exemplary embodiment, the height "h2" may be about 0.750 inches. Further, each of the lateral channels 2706 may have a width "wc1" corresponding to a length of the second portion 2712E of each of the lower flanges 2712. Further, a distance "dl1" between distal ends of the lower flanges 2712 may lie in a range from about 1 to 2 inches. In an exemplary embodiment, the distance "dl1" may be about 1.5 inches. The distance "dl1" may correspond to a maximum width of the elongate profile 2606.

Figure 28:
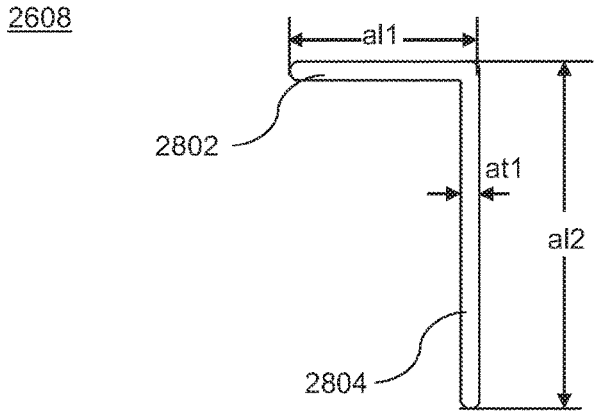
FIG. 28 is a front view of an angled profile for use with the framing system, in accordance with an embodiment of the present disclosure.

FIG. 28 illustrates the angled profile 2608, in accordance with an aspect of the present disclosure. The angled profile 2608 may be a substantially L-shaped member, and includes a first portion 2802 and a second portion 2804. Therefore, the angled profile 2608 may define a L-shaped channel. The first portion 2802 and the second portion 2804 may be substantially perpendicular to each other. In an embodiment, the first portion 2802 may be coupled to the lower surface of the respective top member 2604 (shown in FIG. 26) by various methods, such as, but not limited to, welding, adhesives, brazing, mechanical joints, fasteners, and so forth. In another embodiment, the second portion 2804 may be coupled to the respective horizontal elongate profiles 2606B and/or vertical elongate profiles 2606A by various methods, such as, but not limited to, welding, adhesives, brazing, mechanical joints, fasteners, and so forth. Further, a material of the angled profile 2608 may include aluminum.

In an embodiment, the first portion 2802 of the angled profile 2608 may have a length "al1" that lies in a range from about 0.5 to 1 inches. In an exemplary embodiment, the length "al1" may be about 0.83 inches. In another embodiment, the second portion 2804 of the angled profile 2608 may have a length "al2" that lies in a range from about 1 to 2 inches. In an exemplary embodiment, the length "al2" may be about 1.5 inches. In a further embodiment, a thickness "at1" of the angled profile 2608 may lie in a range from about 0.05 to 0.1 inches. In an exemplary embodiment, the thickness "an" may be about 0.08 inches.

Figure 29:
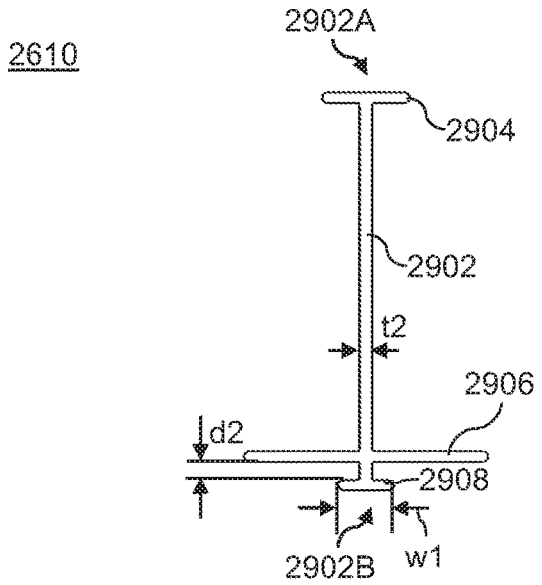
FIG. 29 is a front view of a beam for use with the framing system, in accordance with an embodiment of the present disclosure.

FIG. 29 illustrates the beam 2610, in accordance with an aspect of the present disclosure. The beam 2610 may be substantially I-shaped. The beam 2610 includes a longitudinal portion 2902, a first transverse portion 2904, a second transverse portion 2906 and a third transverse portion 2908. In an embodiment, the longitudinal portion 2902 may have a thickness "t2". In some embodiments, the thickness "t2" may lie within a range from about 0.05 to 0.1 inches. In an exemplary embodiment, the thickness "t2" may be about 0.07 inches. The first transverse portion 2904 may be disposed at a first end 2902A of the longitudinal portion 2902. Further, the third transverse portion 2908 may be disposed at a second end 2902B of the longitudinal portion 2902. The second transverse portion 2906 may be disposed proximate to the third transverse portion 2908. Further, the second transverse portion 2906 is separated from the third transverse portion 2908 by a distance "d2". In some embodiments, the distance "d2" may lie within a range from about 0.1 to 0.2 inches. In an exemplary embodiment, the distance "d2" may be about 0.125 inches. The distance "d2" may be greater than or equal to the thickness "t1" of each of the lower flanges 2712 of the elongate profile 2606 (shown in FIG. 27).

In an embodiment, the beam 2610 may be coupled to the respective vertical elongate profile(s) 2606A and/or horizontal elongate profile(s) 2606B (shown in FIG. 26). In a further embodiment, the beam 2610 may provide strength and rigidity to the framing system 2600. In an embodiment, the third transverse portion 2908 may be configured to be slidably received within the central channel 2708 of the elongate profile 2606 (shown in FIG. 27). To facilitate coupling between the beam 2610 and the respective vertical elongate profile(s) 2606A and/or horizontal elongate profile(s) 2606B, the thickness "t2" of the longitudinal portion 2902 may less than or equal to the distance "d1" between the pair of lower flanges 2712 of the elongate profile 2606. Therefore, at least a part of the longitudinal portion 2902 between the second and third transverse portions 2906, 2908 may be slidably received between the pair of lower flanges 2712 of the elongate profile 2606. Further, the third transverse portion 2908 may have a width "w1". The width "w1" may lie within a range from about 0.1 to 0.5 inches. In an embodiment, the width "w1" may be about 0.314 inches. The width "w1" may be greater than the distance "d1" between the pair of lower flanges 2712 of the elongate profile 2606. Moreover, the width "w1" may be equal to or lesser than a width of the central channel 2708 of the elongate profile 2606. This may enable the beam 2610 to be attached to the elongate profile 2606. Further, a material of the beam 2610 may include aluminum.

Figure 30:
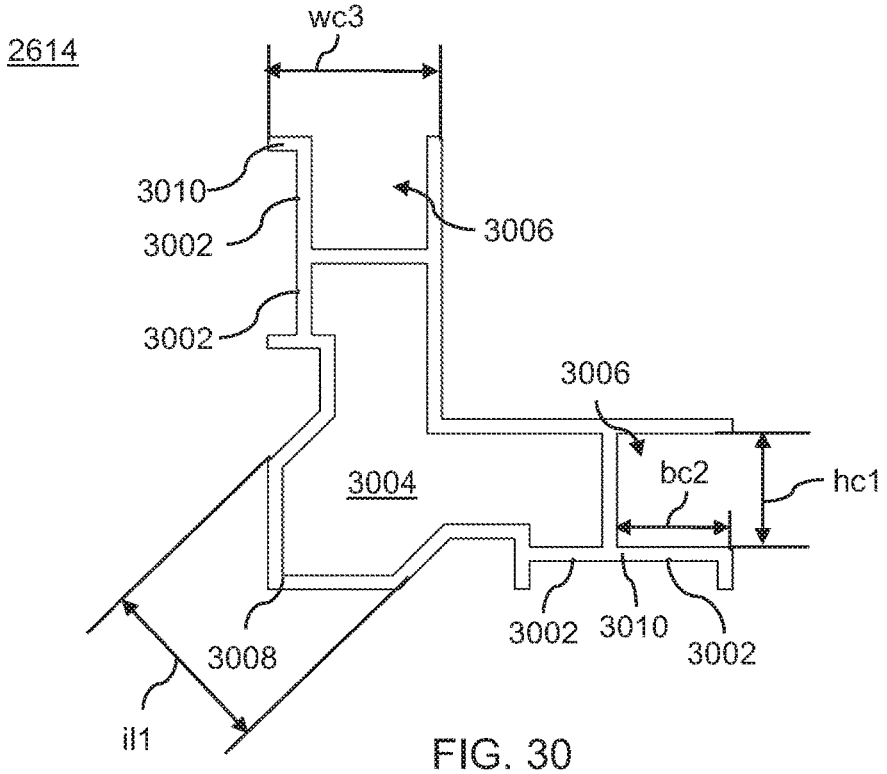
FIG. 30 a front view of a corner bracket for use with the framing system, in accordance with an embodiment of the present disclosure.
Figure 31A:
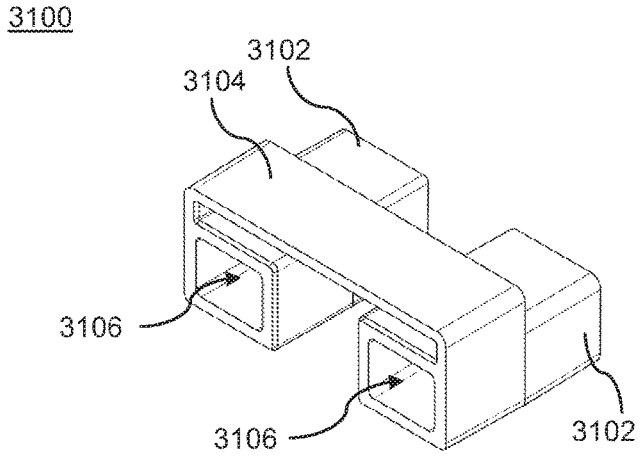
FIGS. 31A-31D are different views of a double connector sleeve for use with the framing system, in accordance with an embodiment of the present disclosure.
Figure 31B:
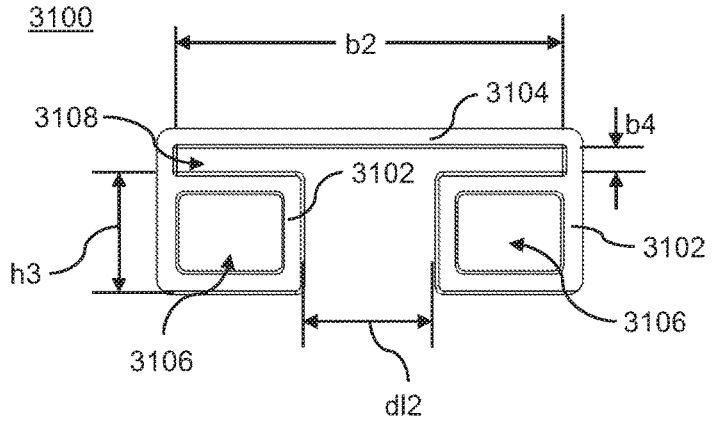
Figure 31C:
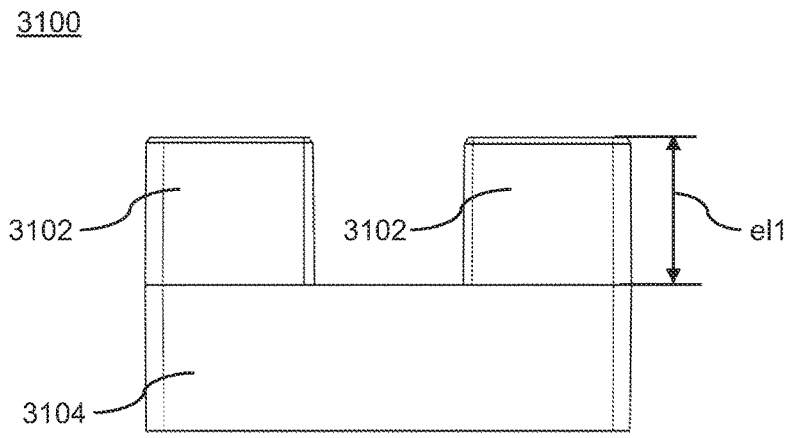
Figure 31D:
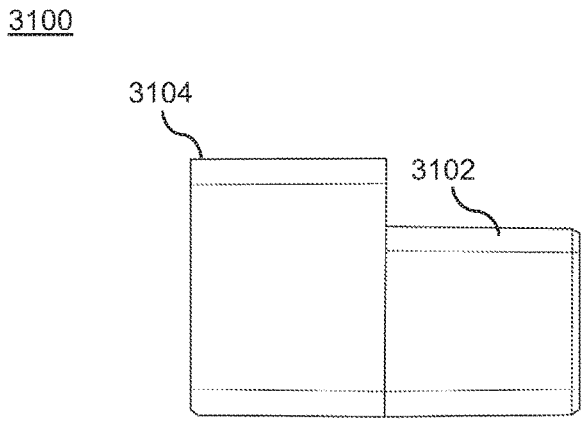

FIG. 30 illustrates a front view of the corner bracket 2614, in accordance with an aspect of the disclosure. In an embodiment, the corner bracket 2614 may be an extruded profile. Further, a material of the corner bracket 2614 may include aluminum. The corner bracket 2614 includes two pairs of screw locator grooves 3002. The screw locator grooves 3002 may indicate drilling locations for screws during assembly. Further, the corner bracket 2614 includes a longitudinal opening 3004, a pair of corner channels 3006 perpendicular to each other, exposed surfaces 3008 and a pair of attachment portions 3010 including the screw locator grooves 3002. Each of the pair of corner channels 3006 has a height "hc1" and a width "bc2". In an embodiment, the height "hc1" may be about 0.5 inches. Further, an inclined length "il1" of the exposed surfaces 3008 may be about 0.795 inches. Moreover, a width "wc3" of the corner bracket 2614 may be about 0.75 inches.

In an exemplary embodiment, each of the pair of corner channels 3006 may be configured to receive at least partially therein a pair of projecting portions of at least one corner sleeve (not shown in FIG. 30). In some embodiments, the corner bracket 2614 may be secured to the at least one corner sleeve within the respective corner channel 3006 by any suitable attachment methods. The attachment methods may include, but not limited to, mechanical fasteners, adhesives, brazing, welding and so forth. In an exemplary embodiment, a screw may pass through at least one of the pair of attachment portions 3010 and at least one of the pair of projecting portions of the at least one corner sleeve, to attach the corner sleeve to the corner bracket 2614. In an embodiment, the at least one corner sleeve is also attachable to the at least one horizontal elongate profile 2606B (shown in FIG. 26).

In alternative embodiments, the pair of corner channels 3006 may receive at least partially therein respective horizontal elongate profiles 2606B. Further, the corner bracket 2614 may be coupled to the respective horizontal elongate profiles 2606B by various methods, such as, but not limited to, welding, adhesives, brazing, mechanical joints, fasteners, and so forth. In a further embodiment, the attachment portions 3010 may be attached to other components (e.g., the post 2602, the angled profile 2608 etc.) via one or more fasteners (e.g., screws). Moreover, the corner bracket 2614 may be configured to attach two straight sections or modules of the framing system 2600 (shown in FIG. 26) at a corner or intersection, such as the intersection 2625. In an embodiment, a corner cover (not shown in FIG. 30) may be configured to be slidably received on the corner bracket 2614. In some embodiments, the corner cover may enhance the aesthetic appeal of the framing system 2600. In some other embodiments, the corner cover may protect the corner bracket 2614 from external elements (e.g., moisture, dust etc.).

FIGS. 31A-31D illustrate various views of a double connector sleeve 3100 (interchangeably referred to as "the connector sleeve 3100"), in accordance with an aspect of the present disclosure. The connector sleeve 3100 includes a pair of projecting portions 3102 spaced apart from each other. Each of the projecting portions 3102 has a hollow configuration with a connector opening 3106. Further, each of the projecting portions 3102 has a substantially rectangular shape. In an embodiment, the double connector sleeve 3100 may be made of a rigid plastic material that is formulated for outdoor Ultraviolet (UV) light exposure. In a further embodiment, the material of the double connector sleeve 3100 may include Polyvinyl Chloride (PVC).

In an embodiment, the pair of projecting portions 3102 is configured to be at least partially received within one of the pair of vertical lateral channels of the at least one vertical elongate profile 2606A. In an exemplary embodiment, the connector sleeve 3100 includes a clip portion 3104 connecting the pair of projecting portions 3102 to each other. In an embodiment, each of the pair of projecting portions 3102 may have a height "h3". In some embodiments, the height "h3" may lie within a range from about 0.3 to 0.5 inches. In an exemplary embodiment, the height "h3" may be about 0.480 inches. In an embodiment, the height "h3" may be less than or equal to the height "h1" of each of the lateral channels 2706 of the elongate profile 2606 (shown in FIG. 27). Therefore, the pair of projecting portions 3102 may be easily insertable within one of the lateral channels 2706 of the elongate profile 2606. As a result, the pair of projecting portions 3102 may be insertable within one of the vertical lateral channels of the vertical elongate profile 2606A. Moreover, the width "wc1" of each of the lateral channels 2706 may be substantially equal to a length "el1" by which each of the projecting portions 3102 extend from the clip portion 3104. This may prevent a gap or clearance between the clip portion 3104 and the vertical elongate profile 2606A when the projecting portions 3102 are inserted within one of the vertical lateral channels.

Further, each of the pair of projecting portions 3102 may be insertable within the respective horizontal lateral channel of the horizontal elongate profile 2606B. In an exemplary embodiment, the clip portion 3104 and the pair of projecting portions 3102 may define a gap 3108 therebetween. The gap 3108 may be configured to at least partially receive therein the pair of lower flanges 2712 of the elongate profile 2606. Specifically, a distance "b4" between each of the pair of projecting portions 3102 and the clip portion 3104 may be greater than or equal to the thickness "t1" of each of the lower flanges 2712 of the elongate profile 2606. Further, a length "b2" of the gap 3108 may be greater than or equal to the distance "dl1" between the distal ends of the lower flanges 2712 of the elongate profile 2606. Moreover, a distance "dl2" between proximal ends of the projecting portions 3102 may be greater than or equal to the width "bl1" of the main body 2701 of the elongate profile 2606. Therefore, the clip portion 3104 and the pair of projecting portions 3102 may secure the horizontal elongate profile 2606B to the connector sleeve 3100.

The connector sleeve 3100 may also be used as the corner sleeve that is configured to connect the corner bracket 2614 with the corresponding horizontal elongate profile 2606B. In an embodiment, the pair of projecting portions 3102 is configured to be at least partially received within one of the corner channels 3006 of the at least one corner bracket 2614 (shown in FIG. 30). In an embodiment, the height "h3" of each of the pair of projecting portions 3102 may be less than or equal to the height "hc1" of each of the corner channels 3006 of the corner bracket 2614. Therefore, the pair of projecting portions 3102 may be easily inserted within one of the corner channels 3006 of the corner bracket 2614. Moreover, the width "bc2" of each of the corner channels 3006 may be substantially equal to the length "el1" by which each of the projecting portions 3102 extend from the clip portion 3104. This may prevent a gap or clearance between the clip portion 3104 and the corner bracket 2614 when the projecting portions 3102 are inserted within one of the corner channels 3006. Therefore, at least one of the pair of corner channels 3006 is configured to be attachable to the at least one horizontal elongate profile 2606B via the connector sleeve 3100.

Figure 32:
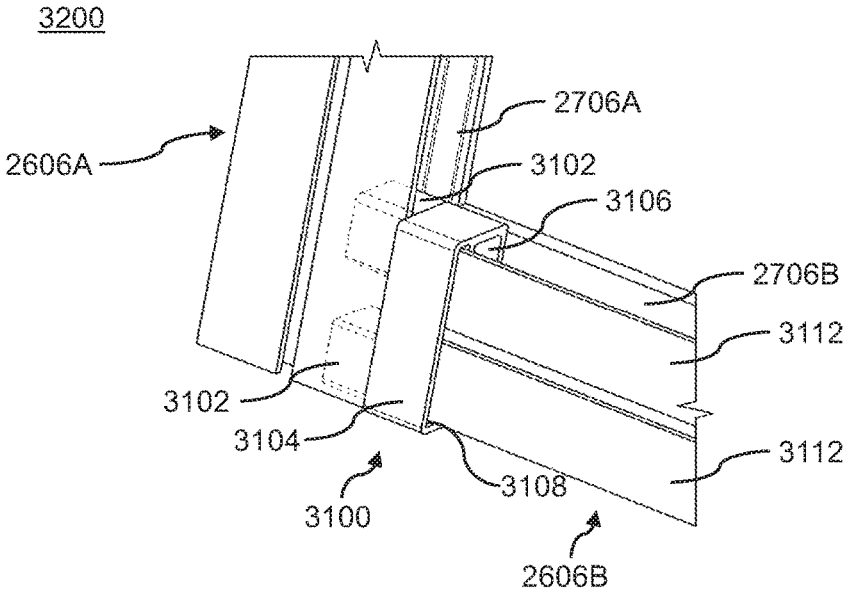
FIG. 32 is a perspective view of a double connector sleeve used for connecting two elongate profiles, in accordance with an embodiment of the present disclosure.

FIG. 32 illustrates a joint 3200 between one of the vertical elongate profiles 2606A (shown in FIG. 26) and one of the horizontal elongate profiles 2606B (shown in FIG. 26) using the connector sleeve 3100 (shown in FIGS. 31A-31D). Each of the vertical elongate profile 2606A and the horizontal elongate profile may be similar to the elongate profile 2606 (shown in FIG. 27). The connector sleeve 3100 may act as an adapter clip that secures the vertical elongate profile 2606A to the horizontal elongate profile 2606B. The projecting portions 3102 of the connector sleeve 3100 are partially inserted within a single vertical lateral channel 2706A of the vertical elongate profile 2606A. Further, each of the projecting portions 3102 is partially inserted within a respective horizontal lateral channel 2706B of the horizontal elongate profile 2606B. As shown in FIG. 32, the clip portion 3104 may secure the connector sleeve 3100 to the horizontal elongate profile 2606B. In an exemplary embodiment, a pair of lower flanges 3112 of the horizontal elongate profile 2606B are at least partially received between the clip portion 3104 and the pair of projecting portions 3102. Specifically, the pair of lower flanges 3112 are at least partially received within the gap 3108 between the clip portion 3104 and the pair of projecting portions 3102. Further, a width of the clip portion 3104 may control an extent to which each of the projecting portions 3102 are inserted within the vertical lateral channel 2706A of the vertical elongate profile 2606A.

An exemplary joint between the vertical elongate profile 2606A and the horizontal elongate profile 2606B is illustrated in FIG. 32. A reverse configuration may also be contemplated within the scope of the present disclosure. For example, the projecting portions 3102 of the connector sleeve 3100 may be partially inserted within one of the horizontal lateral channels 2706B of the horizontal elongate profile 2606B. Further, the projecting portions 3102 may be partially inserted within respective vertical lateral channels 2706A of the vertical elongate profile 2606A.

In an embodiment, the connector sleeve 3100 may be coupled to the vertical elongate profile 2606A and/or the horizontal elongate profile 2606B by various methods, such as, but not limited to, welding, adhesives, brazing, mechanical joints, fasteners, and so forth.

Figure 33:
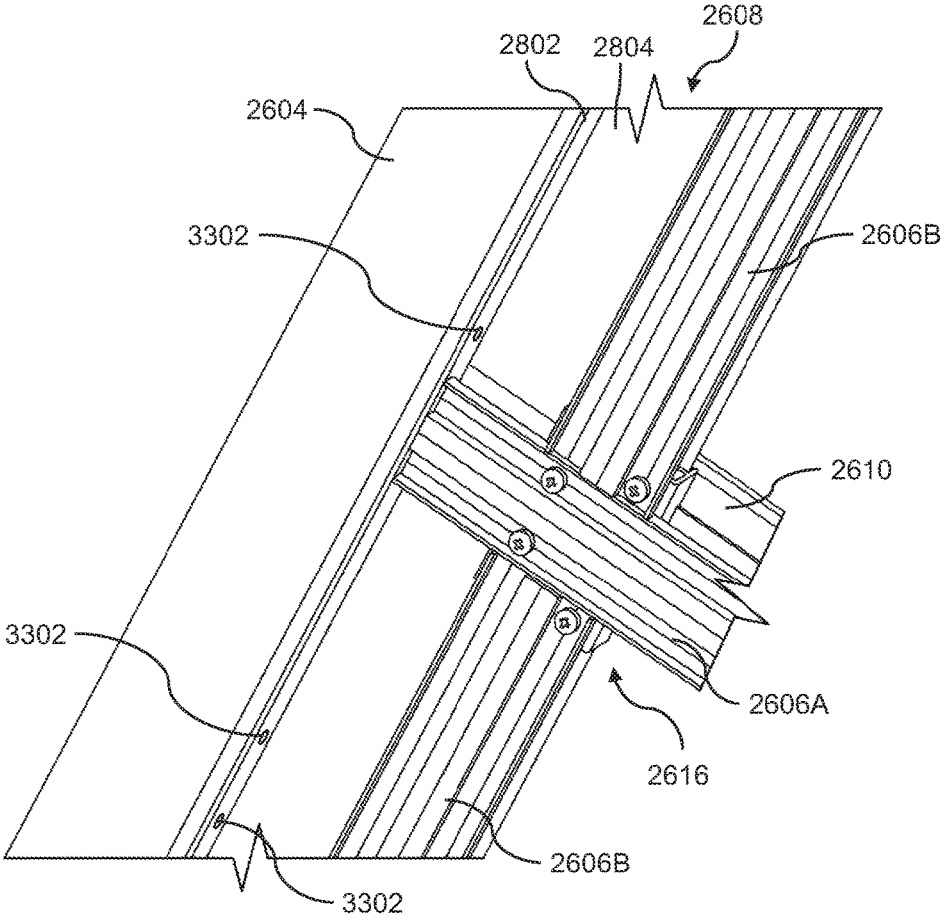
FIG. 33 is a perspective view of an angled profile connected to an elongate profile of the framing system, in accordance with an embodiment of the present disclosure.

FIG. 33 illustrates a perspective view of the angled profile 2608 attached to the vertical elongate profile 2606A, in accordance with an aspect of the disclosure. Further, the angled profile 2608 is connected to the top member 2604. In an embodiment, the first portion 2802 of the angled profile 2608 is attached to the top member 2604. In an exemplary embodiment, the first portion 2802 defines a plurality of apertures 3302 spaced apart from each other. In another embodiment, the apertures 3302 may be spaced uniformly along the length of the angled profile 2608. In an alternative embodiment, the apertures 3302 may be spaced irregularly along the length of the angled profile 2608. The apertures 3302 may have any shape, for example, but not limited to, circular, polygonal, elliptical, and so forth. In an embodiment, at least one of the plurality of apertures 3302 may be configured to receive a fastener (not shown) therethrough to secure the first portion to the deck or the top member 2604. The second portion 2804 is attached to the at least one vertical elongate profile 2606A. In a further embodiment, the apertures 3302 may also enable the angled profile 2608 and the vertical elongate profile 2606A to be connected to each other via one or more fasteners (not shown).

Figure 34:
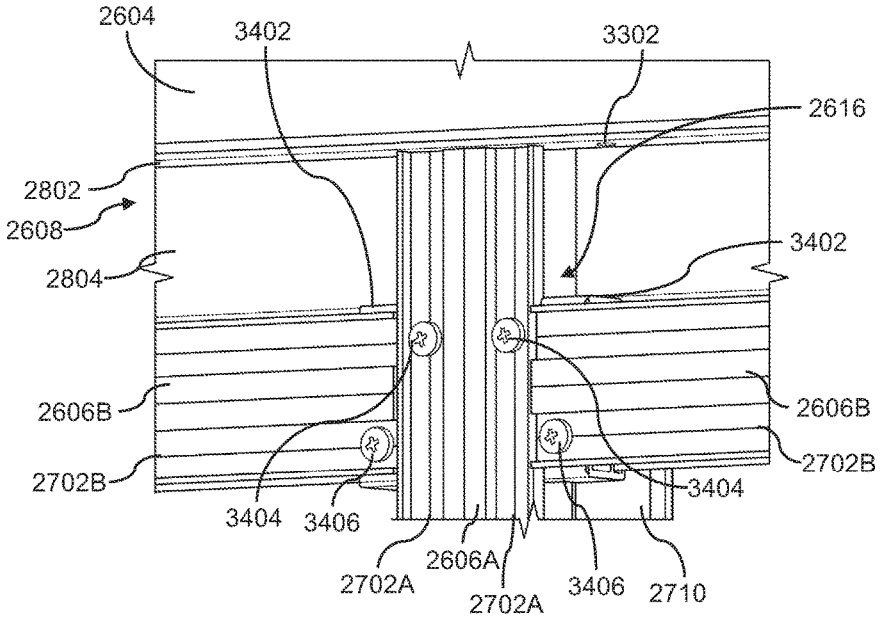
FIG. 34 is a perspective view of a top joint of the framing system, in accordance with an embodiment of the present disclosure.

FIG. 34 illustrates a detailed view of the top joint 2616 of the framing system 2600 (shown in FIG. 26), in accordance with an aspect of the present disclosure. A pair of connector sleeves 3402 may connect respective horizontal elongate profiles 2606B to one of the vertical elongate profiles 2606A. In an exemplary embodiment, first fasteners 3404 may couple the vertical elongate profile 2606A to the connector sleeves 3402. Further, second fasteners 3406 may couple the respective horizontal elongate profiles 2606B to the respective connector sleeves 3402. In an embodiment, the first and second fasteners 3404 and 3406 may be pan head drilling screws for metal joints. In another embodiment, the vertical elongate profile 2606A may also be coupled to the angled profile 2608 by various methods, such as, but not limited to, welding, adhesives, brazing, mechanical joints, fasteners, and so forth.

As illustrated in FIG. 34, the first fasteners 3404 are inserted at respective screw locator grooves 2702A of the vertical elongate profile 2606A. Similarly, each of the second fasteners 3406 is inserted at a screw locator groove 2702B of the corresponding horizontal elongate profile 2606B.

Figure 35:
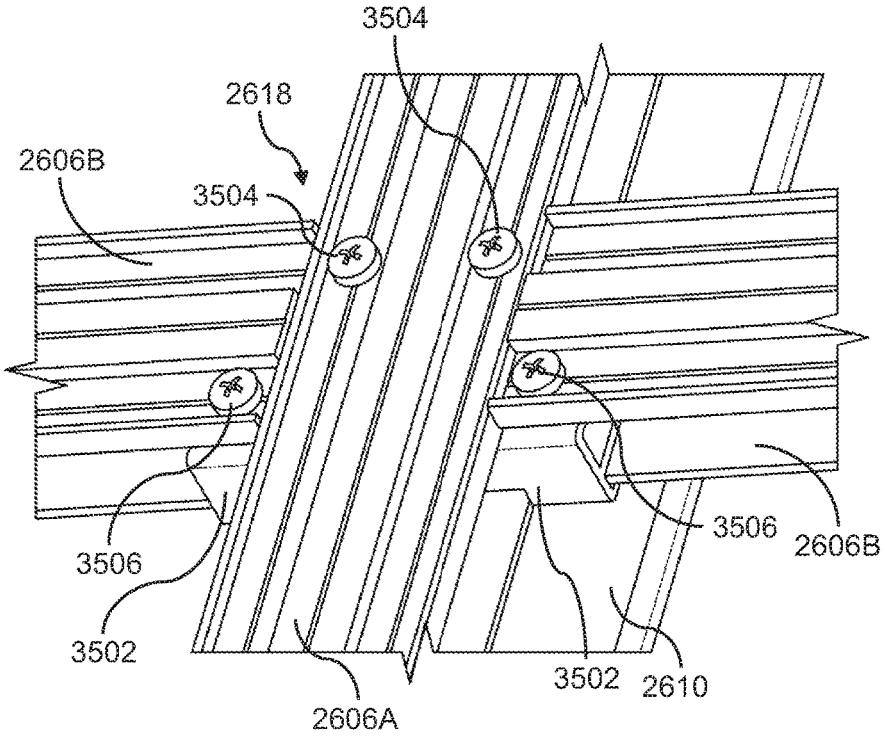
FIG. 35 is a perspective view of a middle joint of the framing system, in accordance with an embodiment of the present disclosure.

FIG. 35 illustrates a detailed view of the middle joint 2618 of the framing system 2600 (shown in FIG. 26), in accordance with an aspect of the present disclosure. A pair of connector sleeves 3502 may connect the respective horizontal elongate profiles 2606B to the vertical elongate profile 2606A. A pair of first fasteners 3504 may couple the vertical elongate profile 2606A to the respective connector sleeves 3502. Further, second fasteners 3506 may couple the respective horizontal elongate profiles 2606B to the respective connector sleeves 3502. In an embodiment, the first fasteners 3504 and the second fasteners 3506 may be pan head drilling screws for metal joints.

Figure 36:
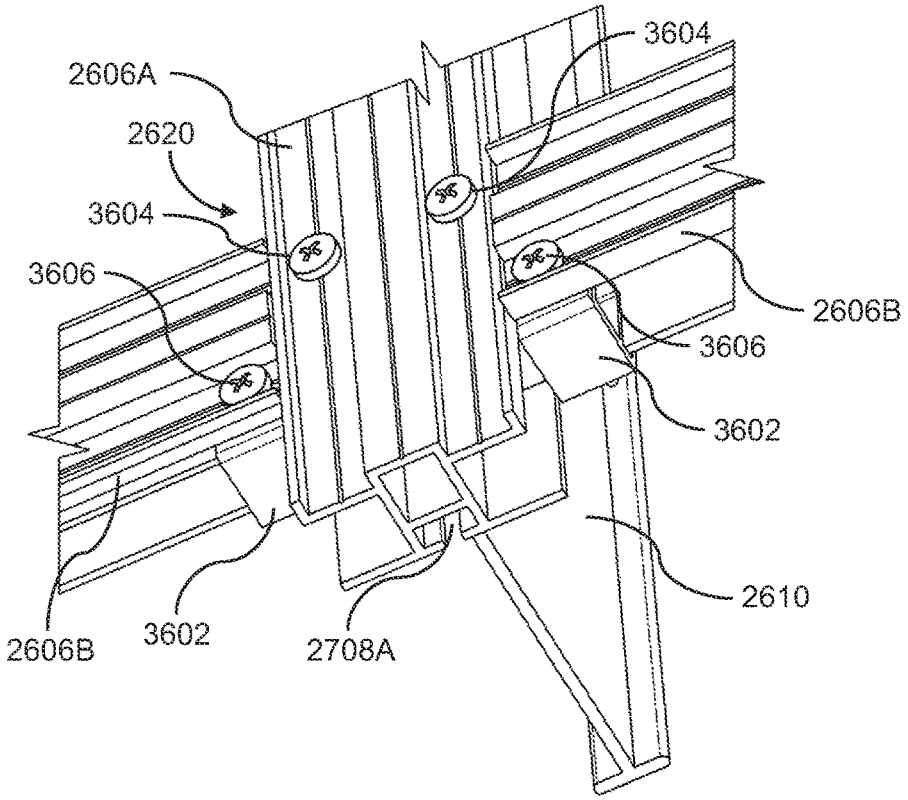
FIG. 36 is a perspective view of a bottom joint of the framing system, in accordance with an embodiment of the present disclosure.

FIG. 36 illustrates a detailed view of the bottom joint 2620 of the framing system 2600 (shown in FIG. 26), in accordance with an aspect of the present disclosure. A pair of connector sleeves 3602 may connect the respective horizontal elongate profiles 2606B to the vertical elongate profile 2606A. A pair of first fasteners 3604 may couple the vertical elongate profile 2606A to the respective connector sleeves 3602. Further, second fasteners 3606 may couple the respective horizontal elongate profiles 2606B to the respective connector sleeves 3602. In an embodiment, the first fasteners 3604 and the second fasteners 3606 may be pan head drilling screws for metal joints. Further, the beam 2610 may be slidably received within a central channel 2708A of the vertical elongate profile 2606A.

Figure 37:
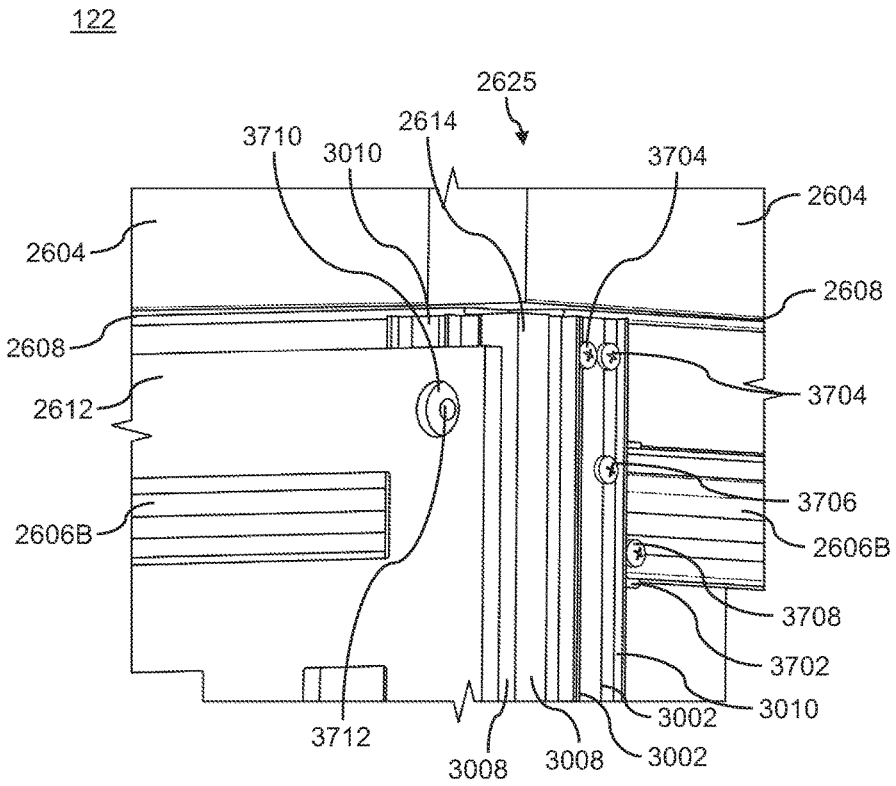
FIG. 37 is a perspective view of a corner joint of the framing system, in accordance with an embodiment of the present disclosure.

FIG. 37 illustrates a detailed view of the corner joint 2622 of the framing system 2600 (shown in FIG. 26), in accordance with an aspect of the present disclosure. A pair of corner connector sleeves 3702 (only one shown) may connect the respective horizontal elongate profiles 2606B to the corner bracket 2614. The corner connector sleeve 3702 may be interchangeably referred to as the corner sleeve 3702. In an embodiment, the corner sleeve 3702 may be similar to the connector sleeve 3100 (shown in FIG. 31). In an exemplary embodiment, the corner sleeve 3702 may include a pair of projecting portions (not shown), similar to the pair of projecting portions 3102 of the connector sleeve 3100. Each of the pair of corner channels 3006 (not shown in FIG. 37) of the corner bracket 2614 receives at least partially therein the pair of projecting portions of the respective corner sleeve 3702. Further, each of the pair of projecting portions of the corner sleeve 3702 is at least partially received within the corresponding horizontal lateral channel of the horizontal elongate profile 2606B. In an embodiment, each of the corner channels 3006 is attachable to the corresponding horizontal elongate profile 2606B using the corresponding corner sleeve 3702. A pair of fasteners 3704 may couple the attachment portion 3010 of the corner bracket 2614 to the angled profile 2608 and/or the post 2602 (shown in FIG. 26) located in the intersection 2625. Further, a fastener 3706 may couple the attachment portion 3010 of the corner bracket 2614 to the corner sleeve 3702 and/or the post 2602. The fasteners 3704 and 3706 are inserted at the respective screw locator grooves 3002 of the corner bracket 2614. Further, a fastener 3708 may attach the horizontal elongate profile 2606B to the corner sleeve 3702 and/or the post 2602. In an embodiment, the fasteners 3704, 3706 and 3708 may be pan head drilling screws for metal joints. In an embodiment, the lattice panel 2612 may be coupled to the exposed surface 3008 of the corner bracket 2614. The lattice panel 2612 includes an indentation 3710 at a corner for indicating a recommended fastener location. For installation, a hole 3712 may be drilled in the center of the indentation 3710. A fastener (not shown) may be inserted through the hole 3712 and an aligned hole (not shown) in the corner bracket 2614 in order to secure the lattice panel 2612 to the corner bracket 2614. The fastener may be a screw. A fastener cover (not shown) may be placed over the indentation 3710 to hide the fastener. In an embodiment, the fastener may extend into the angled profile 2608 and/or the post 2602 for improved retention of the lattice panel 2612.

Similar indentations 3710 are provided on other corners of the lattice panel 2612 for securing the lattice panel 2612 to other components, for example, the vertical elongate profile 2606A (shown in FIG. 26), the horizontal elongate profile 2606B, and so forth. The installation process may be similar to the one described above with reference to the corner bracket 2614.

Figure 38:
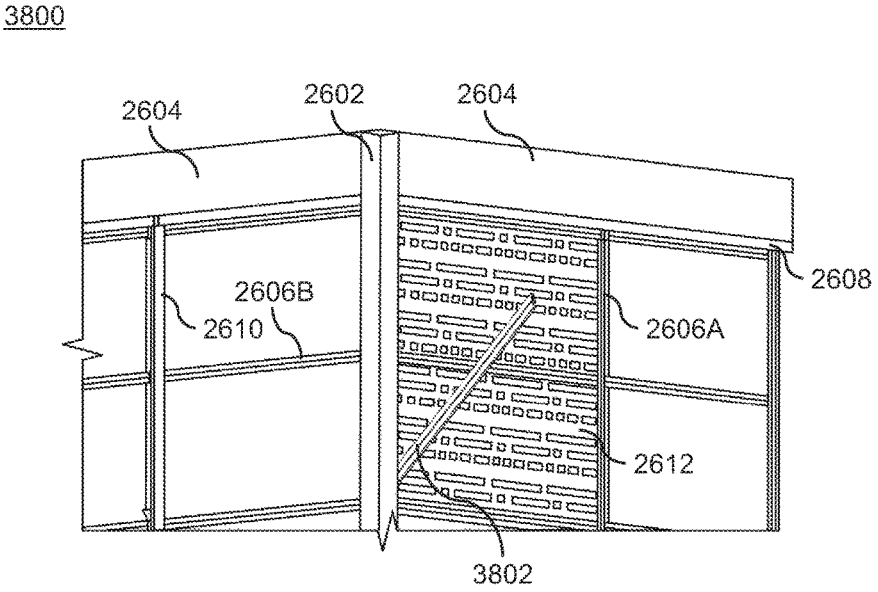
FIG. 38 is a partial perspective view of a framing system including an inclined elongate profile, in accordance with an embodiment of the present disclosure.
Figure 39A:
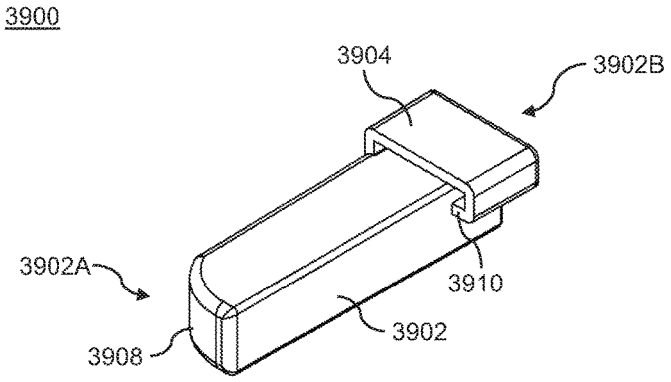
FIGS. 39A to 39E are different views of a long inclined connector sleeve for use with the framing system, in accordance with an embodiment of the present disclosure.
Figure 39B:
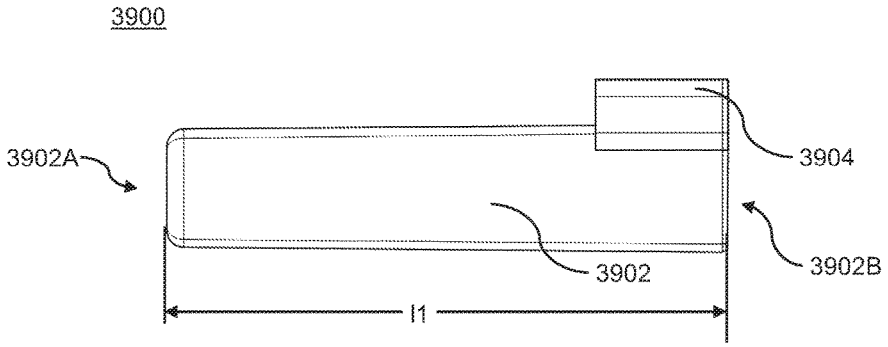
Figure 39C:
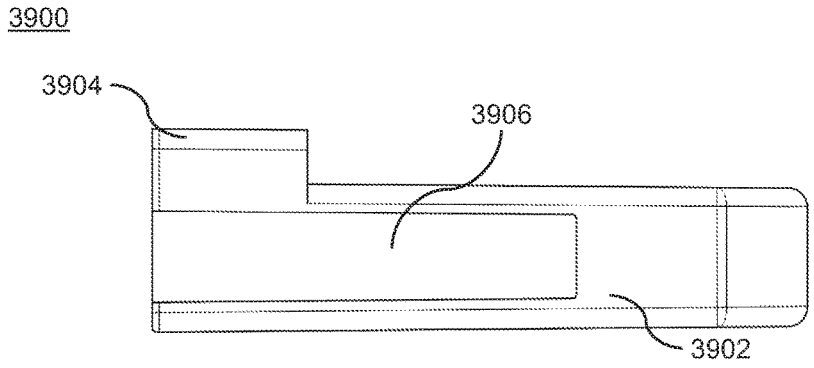
Figure 39D:
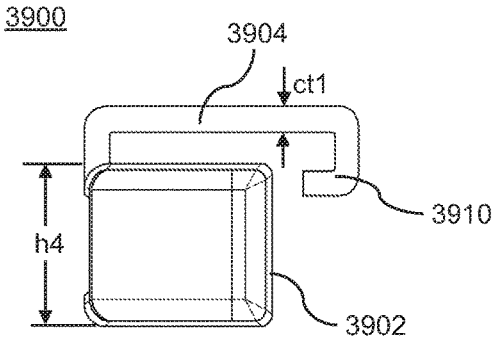
Figure 39E:
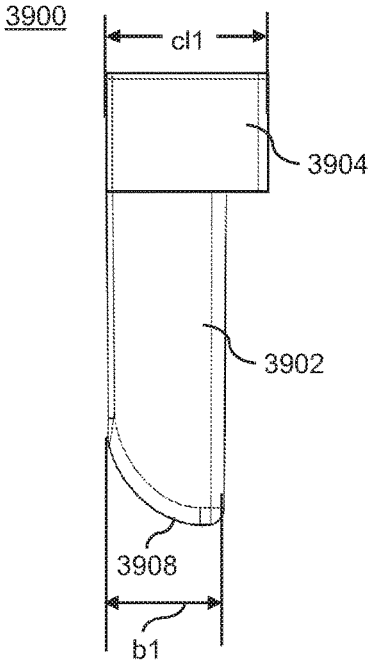

FIG. 38 is a partial perspective of a framing system 3800, in accordance with an aspect of the present disclosure. The framing system 3800 is similar to the framing system 2600 of FIG. 1, except for the presence of an inclined elongate profile 3802. The inclined elongate profile 3802 may be inclined at an oblique angle relative to the horizontal elongate profile 2606B and/or the vertical elongate profile 2606A. The inclined elongate profile 3802 may provide additional rigidity to the framing system 3800. In an embodiment, the inclined elongate profile 3802 includes a pair of lateral channels 3804 (shown in FIG. 40). In a further embodiment, the inclined elongate profile 3802 may have a configuration similar to the elongate profile 2606, shown in FIG. 2. Therefore, the lateral channels 3804 may be similar to the lateral channels 2706 of the elongate profile 2606. The inclined elongate profile 3802 may also include a pair of lower flanges 3812 (shown in FIG. 40) and a central channel 3814 (shown in FIG. 40) similar to the pair of lower flanges 2712 and the central channel 2708, respectively, of the elongate profile 2606. In an exemplary embodiment, the inclined elongate profile 3802 may be connected to a respective vertical elongate profile, a respective horizontal elongate profile and/or a corner bracket (not shown in FIG. 38) by at least one inclined connector sleeve (not shown in FIG. 38). In other embodiments, the inclined elongate profile 3802 may be coupled to the respective vertical elongate profile 2606A, the respective horizontal elongate profile 2606B, the corner bracket 2614 and/or the respective angled profile 2608 by various methods, such as, but not limited to, welding, adhesives, brazing, mechanical joints, fasteners, and so forth.

FIGS. 39A-39E illustrate various views of a long inclined connector sleeve 3900 (interchangeably referred to as "the inclined connector sleeve 3900"), in accordance with an aspect of the present disclosure. The inclined connector sleeve 3900 includes a body 3902 and a clip portion 3904 (interchangeably referred to as "clip 3904") extending from the body 3902. The body 3902 may include a slot 3906 that extends at least partly along a length of the body 3902. Further, the body 3902 has a substantially rectangular shape with a rounded portion 3908 at a first end 3902A. In an exemplary embodiment, the body 3902 is configured to be at least partially received within one of the pair of lateral channels 3804 of the at least one inclined elongate profile 3802 (shown in FIG. 38). The rounded portion 3908 of the body 3902 is configured to be received within one of the pair of vertical lateral channels of the at least one vertical elongate profile 2606B (shown in FIG. 26). In some embodiments, the rounded portion 3908 of the body 3902 may allow angular adjustment of the at least one inclined elongate profile 3802 with respect to the at least one vertical elongate profile 2606A and/or the at least one horizontal elongate profile 2606B.

In some embodiments, the clip 3904 may be connected to the body 3902 adjacent to a second end 3902B opposite to the first end 3902A. In an exemplary embodiment, the clip 3904 may be configured to secure the body 3902 to the at least one inclined elongate profile 3802 (shown in FIG. 38). In an exemplary embodiment, the clip 3904 may have a hook 3910 at one end. The hook 3910 may be configured to securely retain the inclined connector sleeve 3900 with the inclined elongate profile 3802. In an embodiment, the inclined connector sleeve 3900 may be slidably inserted within one of the pair of lateral channels 3804 of the inclined elongate profile 3802 from the second end 3902B. In some embodiments, the hook 3910 may be inserted within the central channel 3814 of the inclined elongate profile 3802. Further, one of the pair of lower flanges 3812 of the inclined elongate profile 3802 may be at least partially received within a gap 3912 between the clip 3904 and the body 3902 of the inclined connector sleeve 3900.

The body 3902 may have a length "l1". In an embodiment, the length "l1" may lie within a range from about 1 to 3 inches. In an exemplary embodiment, the length "l1" may be about 2.13 inches. In an embodiment, the length "l1" may be greater than the width "wc1" of the lateral channel 2706 of the elongate profile 2606 (shown in FIG. 27). In some embodiments, the body 3902 may have a width "b1". In an embodiment, the width "b1" may lie within a range from about 0.4 to 0.8 inches. In an exemplary embodiment, the width "b1" may be about 0.58 inches. The width "b1" may be greater than or equal to the width "wc1" of the lateral channel 2706 of the elongate profile 2606. In some embodiments, the body 3902 may have a height "h4". In an embodiment, the height "h4" may lie within a range from about 0.2 to 0.6 inches. In an exemplary embodiment, the height "h4" may be about 0.48 inches. The height "h4" may be lesser than or equal to the height "h1" of the lateral channel 2706 of the elongate profile 2606. In an embodiment, a length "cl1" of the clip 3904 may lie in a range from about 0.5 to 1 inches. In an exemplary embodiment, the length "cl1" may be about 0.86 inches. In a further embodiment, the length "cl1" may be greater than or equal to the length "l11" of each of the lower flanges 2712 of the elongate profile 2606. In an embodiment, a thickness "ct1" of the clip 3904 may lie in a range from about 0.05 to 0.1 inches. In an exemplary embodiment, the thickness "ct1" may be about 0.08 inches. In a further embodiment, the thickness "ct1" may be lesser than or equal to the distance "d1" between the lower flanges 2712 of the elongate profile 2606. This may enable the hook 3910 of the clip 3904 to be insertable within the central channel 2708 of the elongate profile 2606.

In an embodiment, the inclined connector sleeve 3900 may be made of a rigid plastic material that is formulated for outdoor Ultraviolet (UV) light exposure. In a further embodiment, the material of the inclined connector sleeve 3900 may include Polyvinyl Chloride (PVC).

Figure 40:
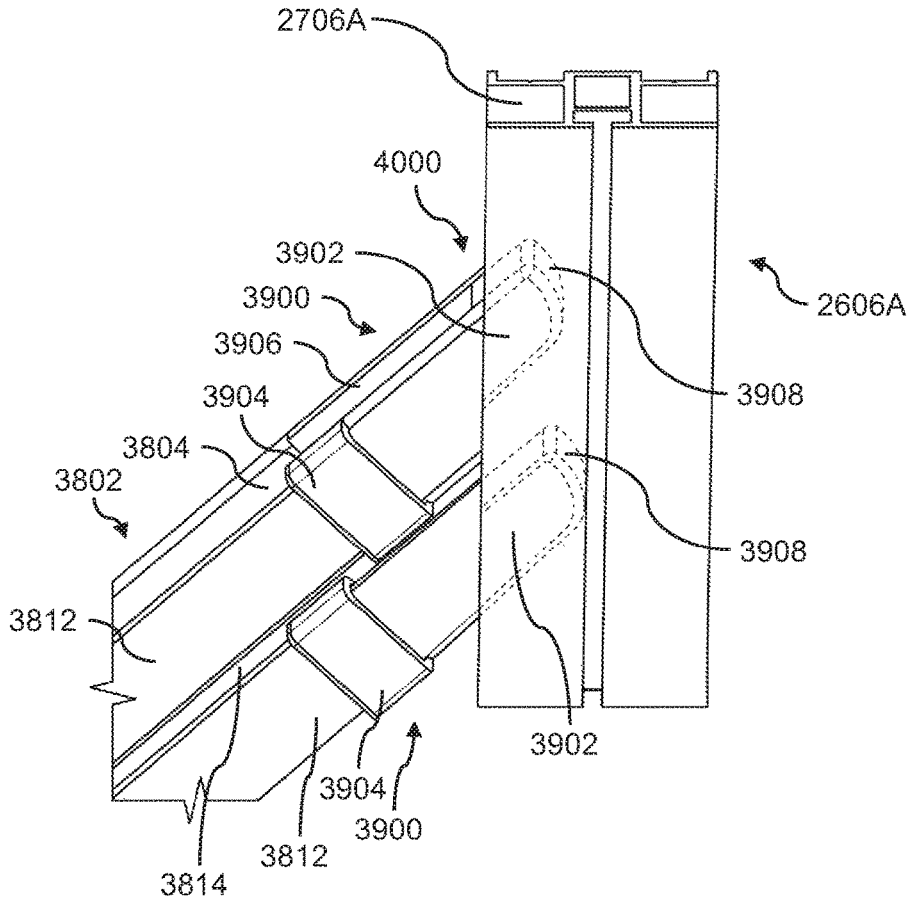
FIG. 40 is a perspective view of the long inclined connector sleeve used for connecting two elongate profiles, in accordance with an embodiment of the present disclosure.
Figure 41A:
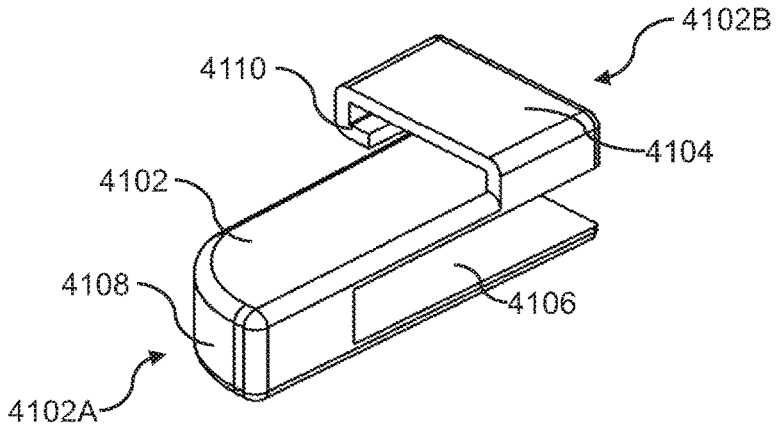
FIGS. 41A to 41E are different views of a short inclined connector sleeve for use with the framing system, in accordance with an embodiment of the present disclosure.
Figure 41B:
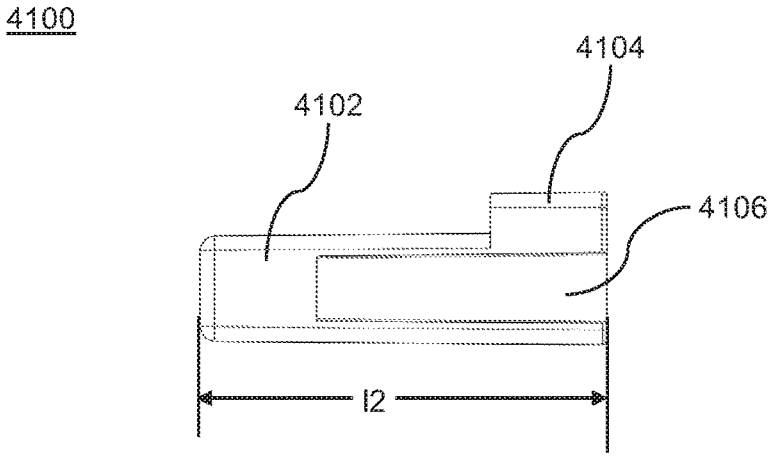
Figure 41C:
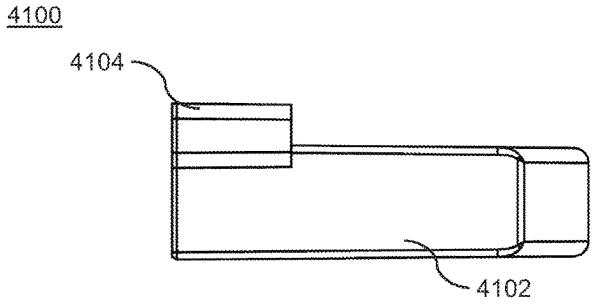
Figure 41D:
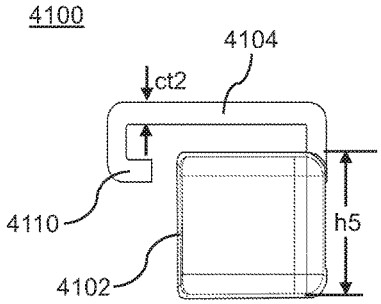
Figure 41E:
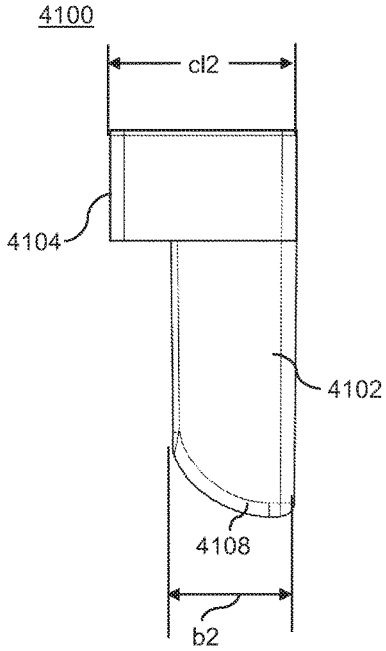

FIG. 40 illustrates a joint 4000 between the vertical elongate profile 2606A and the inclined elongate profile 3802 using a pair of the inclined connector sleeves 3900. The inclined connector sleeves 3900 may act as an adapter clip that secures the vertical elongate profile 2606A to the inclined elongate profile 3802. The bodies 3902 of the inclined connector sleeves 3900 are partially inserted within one of the vertical lateral channels 2706A of the vertical elongate profile 2606A. Further, the rounded portions 3908 of the inclined connector sleeves 3900 are disposed within the vertical lateral channel 2706A of the vertical elongate profile 2606A. The rounded portions 3908 may allow angular adjustment of the inclined elongate profile 3802 during assembly. The bodies 3902 of the inclined connector sleeves 3900 are also partially received within the respective lateral channels 3804 (one shown in FIG. 40) of the inclined elongate profile 3802. Further, the slots 3906 (one shown in FIG. 40) of the inclined connector sleeves 3900 are disposed within the respective lateral channels 3804 of the inclined elongate profile 3802. Moreover, the clip 3904 may secure the inclined connector sleeve 3900 to the inclined elongate profile 3802. Specifically, the hook 3910 (not shown in FIG. 40) is slidably inserted within the central channel 3814 of the inclined elongate profile 3802 to secure the inclined connector sleeve 3900 to the inclined elongate profile 3802.

In other embodiments, the inclined connector sleeve 3900 may be coupled to the vertical elongate profile 2606A and/or the inclined elongate profile 3802 by various methods, such as, but not limited to, welding, adhesives, brazing, mechanical joints, fasteners, and so forth. In alternative embodiments, the inclined connector sleeve 3900 may also be used to connect the vertical elongate profile 2606A with one of the horizontal elongate profiles 2606B.

FIGS. 41A-41E illustrate various views of a short inclined connector sleeve 4100 (interchangeably referred to as "the inclined connector sleeve 4100"), in accordance with an aspect of the present disclosure. The inclined connector sleeve 4100 includes a body 4102 and a clip portion 4104 (interchangeably referred to as "the clip 4104") extending from the body 4102. The body 4102 may include a slot 4106 that extends at least partly along a length of the body 4102. Further, the body 4102 has a substantially rectangular shape with a rounded portion 4108 at one end. In an exemplary embodiment, the body 4102 is configured to be at least partially received within one of the pair of lateral channels 3804 of the at least one inclined elongate profile 3802 (shown in FIG. 38). The rounded portion 4108 of the body 4102 is configured to be received within one of the pair of vertical lateral channels of the at least one vertical elongate profile 2606B (shown in FIG. 26). In some embodiments, the rounded portion 4108 of the body 4102 may allow angular adjustment of the at least one inclined elongate profile 3802 with respect to the at least one vertical elongate profile 2606A and/or the at least one horizontal elongate profile 2606B.

In some embodiments, the clip 4104 may be connected to the body 4102 adjacent to a second end 1602B opposite to the first end 1602A. In an exemplary embodiment, the clip 4104 may be configured to secure the body 4102 to the at least one inclined elongate profile 3802 (shown in FIG. 38). In an exemplary embodiment, the clip 4104 may have a hook 4110 at one end. The hook 4110 may be configured to securely retain the inclined elongate profile 3802 with the inclined connector sleeve 4100. In an embodiment, the inclined connector sleeve 4100 may be slidably inserted within one of the pair of lateral channels 3804 of the inclined elongate profile 3802 from the second end 1602B. In some embodiments, the hook 4110 may be inserted within the central channel 3814 of the inclined elongate profile 3802. Further, one of the pair of lower flanges 3812 may be at least partially received within a gap 4112 between the clip 4104 and the body 4102 of the inclined connector sleeve 4100.

The body 4102 may have a length "12". In an embodiment, the length "12" may lie within a range from about 1 to 2 inches. In an exemplary embodiment, the length "12" may be about 1.75 inches. In an embodiment, the length "12" may be greater than the width "wc1" of the lateral channel 2706 of the elongate profile 2606 (shown in FIG. 27). In some embodiments, the body 4102 may have a width "b2". In an embodiment, the width "b2" may lie within a range from about 0.4 to 0.8 inches. In an exemplary embodiment, the width "b2" may be about 0.58 inches. The width "b2" may be greater than or equal to the width "wc1" of the lateral channel 2706 of the elongate profile 2606. Moreover, the length "12" of the inclined connector sleeve 4100 may be less than the length "11" of the inclined connector sleeve 3900. In some embodiments, the body 4102 may have a height "h5". In an embodiment, the height "h5" may lie within a range from about 0.2 to 0.6 inches. In an exemplary embodiment, the height "h5" may be about 0.48 inches. The height "h5" may be lesser than or equal to the height "h1" of the lateral channel 2706 of the elongate profile 2606. In an embodiment, a length "cl2" of the clip 4104 may lie in a range from about 0.5 to 1 inches. In an exemplary embodiment, the length "cl2" may be about 0.86 inches. In a further embodiment, the length "cl2" may be greater than or equal to the length "111" of each of the lower flanges 2712 of the elongate profile 2606. In an embodiment, a thickness "ct2" of the clip 4104 may lie in a range from about 0.05 to 0.1 inches. In an exemplary embodiment, the thickness "ct2" may be about 0.08 inches. In a further embodiment, the thickness "ct2" may be lesser than or equal to the distance "d1" between the lower flanges 2712 of the elongate profile 2606. This may enable the hook 4110 of the clip 4104 to be insertable within the central channel 2708 of the elongate profile 2606.

In an embodiment, the inclined connector sleeve 4100 may be made of a rigid plastic material that is formulated for outdoor Ultraviolet (UV) light exposure. In a further embodiment, the material of the short connector sleeve 4100 may include Polyvinyl Chloride (PVC).

In other embodiments, the inclined connector sleeve 4100 may be coupled to the vertical elongate profile 2606A and/or the inclined elongate profile 3802 by various methods, such as, but not limited to, welding, adhesives, brazing, mechanical joints, fasteners, and so forth. Further, the inclined connector sleeve 4100 may also be used to connect the vertical elongate profile 2606A with one of the horizontal elongate profiles 2606B.

Figure 42:
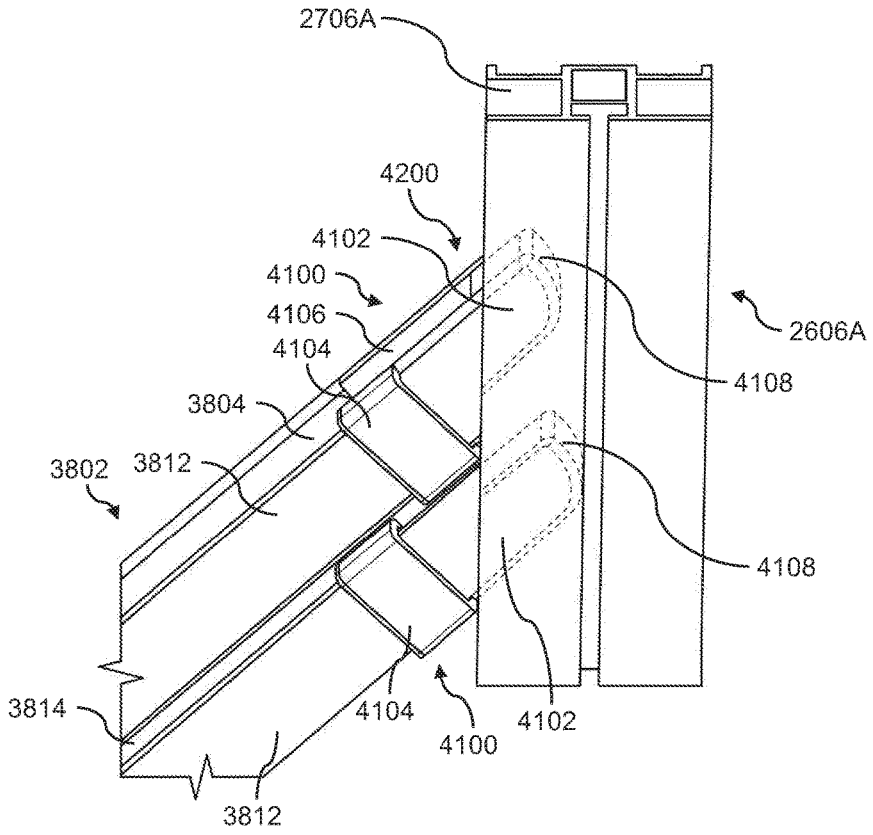
FIG. 42 is a perspective view of the short inclined connector sleeve used for connecting two elongate profiles, in accordance with an embodiment of the present disclosure.

FIG. 42 illustrates a joint 4200 between the vertical elongate profile 2606A and the inclined elongate profile 3802 using a pair of the inclined connector sleeves 4100. The inclined connector sleeves 4100 may act as an adapter clip that secures the vertical elongate profile 2606A to the inclined elongate profile 3802. The bodies 4102 of the inclined connector sleeves 4100 are partially inserted within one of the vertical lateral channels 2706A of the vertical elongate profile 2606A. Further, the rounded portions 4108 of the inclined connector sleeves 4100 are disposed within the vertical lateral channel 2706A of the vertical elongate profile 2606A. The rounded portions 3908 may allow angular adjustment of the inclined elongate profile 3802 during assembly. The bodies 4102 of the inclined connector sleeves 4100 are also partially received within the respective channels 3804 (one shown in FIG. 42) of the inclined elongate profile 3802. Further, the slots 4106 (one shown in FIG. 42) of the inclined connector sleeves 4100 are disposed within the respective lateral channels 3804 of the inclined elongate profile 3802. Moreover, the clip 4104 may secure the inclined connector sleeve 4100 to the inclined elongate profile 3802. Specifically, the hook 4110 (not shown in FIG. 42) is slidably inserted within the central channel 3814 of the inclined elongate profile 3802 to secure the inclined connector sleeve 4100 to the inclined elongate profile 3802.

Figure 43:
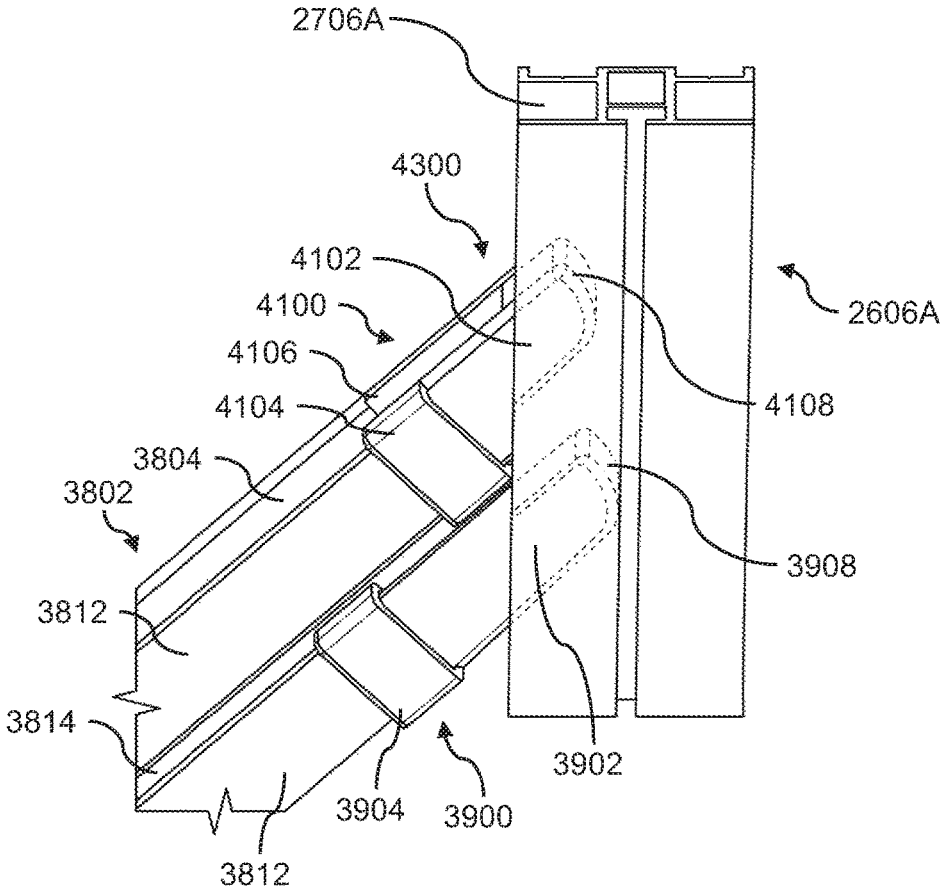
FIG. 43 is a perspective view of the short inclined connector sleeve and the long inclined connector sleeve used for connecting two elongate profiles, in accordance with an embodiment of the present disclosure.

FIG. 43 illustrates a joint 4300 between the vertical elongate profile 2606A and the inclined elongate profile 3802 using the inclined connector sleeve 3900 and the inclined connector sleeve 4100. As illustrated in FIG. 42, one of lateral channels 3804 of the inclined elongate profile 3802 may at least partially receive therein the inclined connector sleeve 4100, while the other lateral channel (not shown in FIG. 43) may at least partially receive therein the inclined connector sleeve 3900. The difference in the lengths "11", "12" between the inclined connector sleeves 3900, 4100 may allow the inclined elongate profile 3802 to be orientated at various angles with respect to the vertical elongate profile 2606B.

Figure 44:
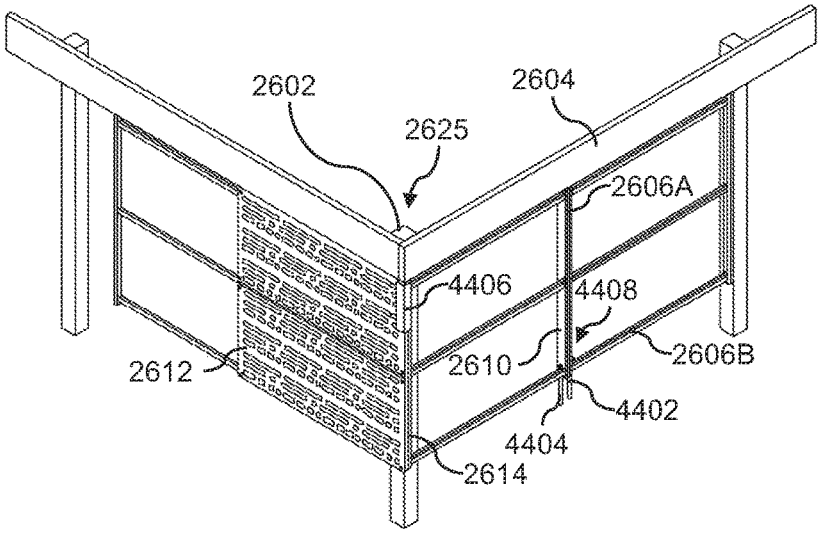
FIG. 44 is a perspective view of a framing system, in accordance with another embodiment of the present disclosure.

FIG. 44 is a partial perspective of a framing system 4400, in accordance with an aspect of the present disclosure. The framing system 4400 is similar to the framing system 2600 of FIG. 1, except for the presence of spade feet 4402 and 1904, and a corner cover 4406. The spade feet 4402 and 1904 may be coupled to the vertical elongate profile 2606A, the horizontal elongate profile 2606B, and/or the beam 2610 by various methods, such as, but not limited to, welding, adhesives, brazing, mechanical joints, fasteners, and so forth. Each of the spade feet 4402 and 1904 may be stakes with a pointed or tapered end to facilitate insertion within the ground. The spade feet 4402 and 1904 may provide additional stability to the framing system 4400. The spade feet 4402 and 1904 may be attached to the framing system 4400 at a bottom joint 4408.

In an embodiment, the corner cover 4406 may be slidably received on the corner bracket 2614. In a further embodiment, the corner cover 4406 may extend along a length of the corner bracket 2614. In an exemplary embodiment, the corner cover 4406 may be attached to the exposed surfaces 3008 (shown in FIG. 30) of the corner bracket 2614. In some embodiments, the corner cover 4406 may be coupled to the exposed surfaces 3008 by various methods, such as, but not limited to, welding, adhesives, brazing, mechanical joints, fasteners, and so forth.

Figure 45:
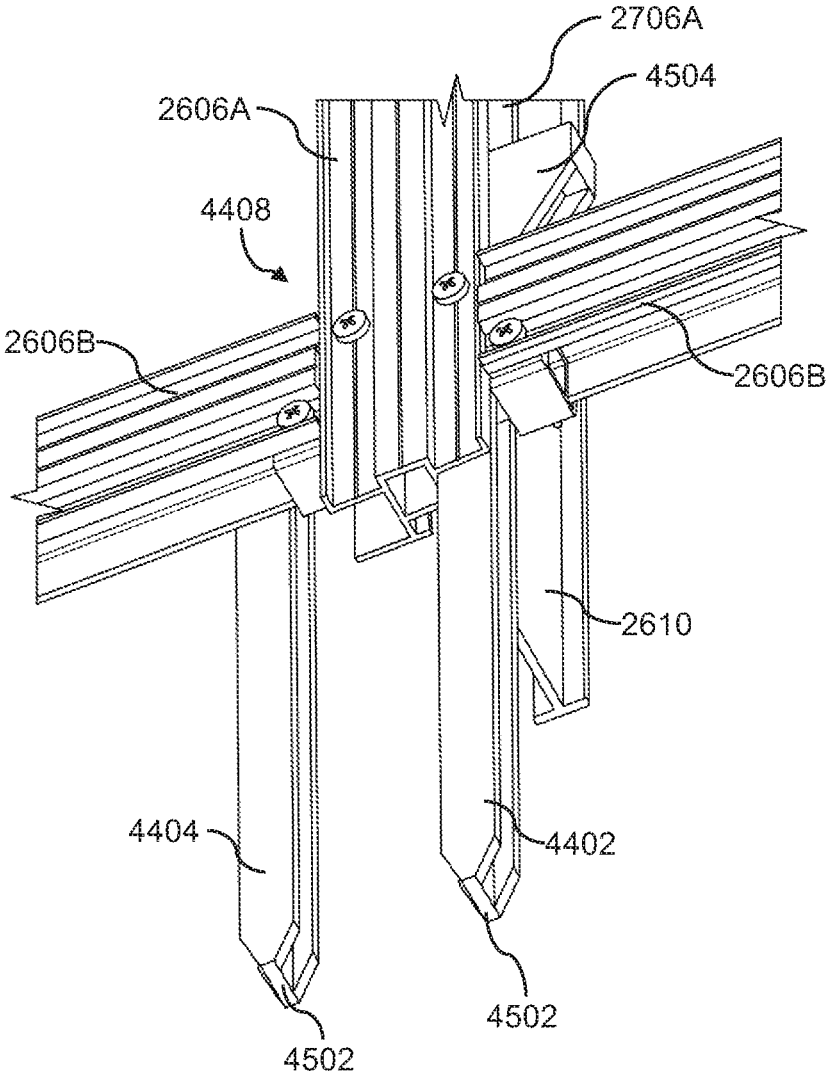
FIG. 45 is a perspective view of a bottom joint of the framing system, in accordance with another embodiment of the present disclosure.
Figure 46A:
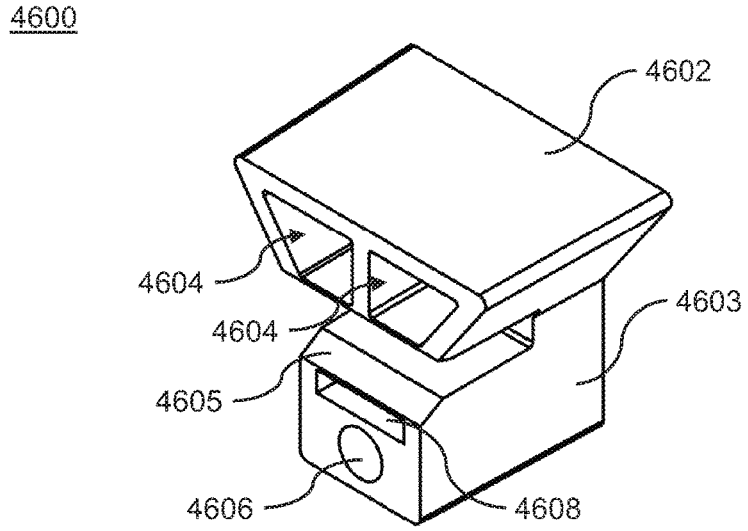
FIGS. 46A to 46E are different views of a stake adapter for use with the framing system, in accordance with an embodiment of the present disclosure.
Figure 46B:
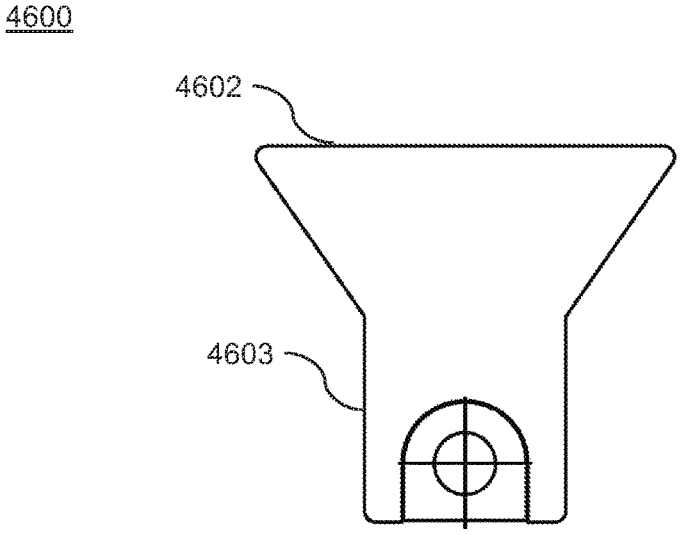
Figure 46C:
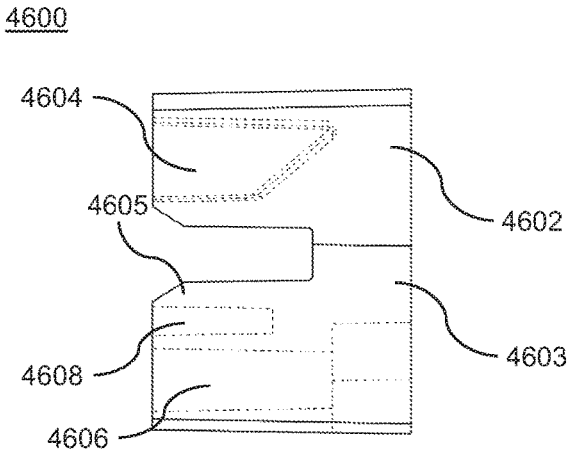
Figure 46D:
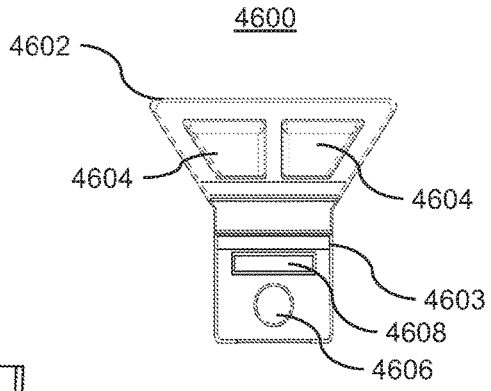
Figure 46E:
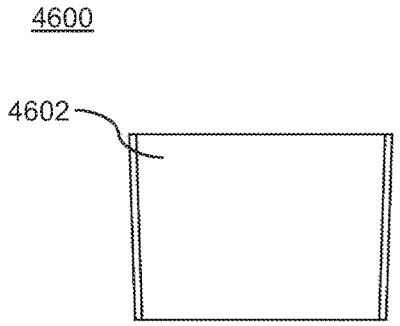

FIG. 45 illustrates a perspective view of the bottom joint 4408 of the framing system 4400 (shown in FIG. 44), in accordance with an aspect of the present disclosure. The spade foot 4402 is slidably received within the lateral channel 2706A of the vertical elongate profile 2606A. Each of the spade feet 4402 and 1904 includes a tapered end 4502 to facilitate insertion within the ground. The spade foot 4402 further includes a connecting portion 4504. In an embodiment, the connecting portion 4504 may be configured for connection with a stake adapter (not shown in FIG. 45). In an embodiment, each of the spade feet 4402 and 1904 may be coupled to the vertical elongate profile 2606A, the horizontal elongate profile 2606B and/or the beam 2610 by various methods, such as, but not limited to, welding, adhesives, brazing, mechanical joints, fasteners, and so forth.

FIGS. 46A to 46E illustrate various view of a stake adapter 4600, in accordance with an aspect of the present disclosure. The stake adapter 4600 includes an upper part 4602 and a lower part 4603 connected to the upper part 4602. The upper part 4602 has a tapered shape and includes two attachment openings 4604. The attachment openings 4604 may be blind openings. Further, each of the attachment openings 4604 may have a tapered shape. In an embodiment, each of the attachment openings 4604 may be configured to receive a corresponding portion of a spade foot or stake (not shown in FIGS. 46A-46E).

The lower part 4603 has a substantially rectangular shape with a chamfer 4605. Further, the lower part 4603 includes a hole 4606 and a recess 4608. The hole 4606 may be a circular blind hole. The hole 4606 may allow the stake adapter 4600 to be coupled to another component via a fastener. Further, the recess 4608 may be rectangular.

In an embodiment, the stake adapter 4600 may be made of a die cast alloy with a coating. In an embodiment, the stake adapter 4600 may be coupled to one or more components of the framing system 4400 (shown in FIG. 44), such as the vertical elongate profile 2606A, the horizontal elongate profile 2606B and/or the beam 2610, by various attachment methods. The attachment methods may include, but not limited to, welding, adhesives, brazing, mechanical joints, fasteners, and so forth.

Figure 47:
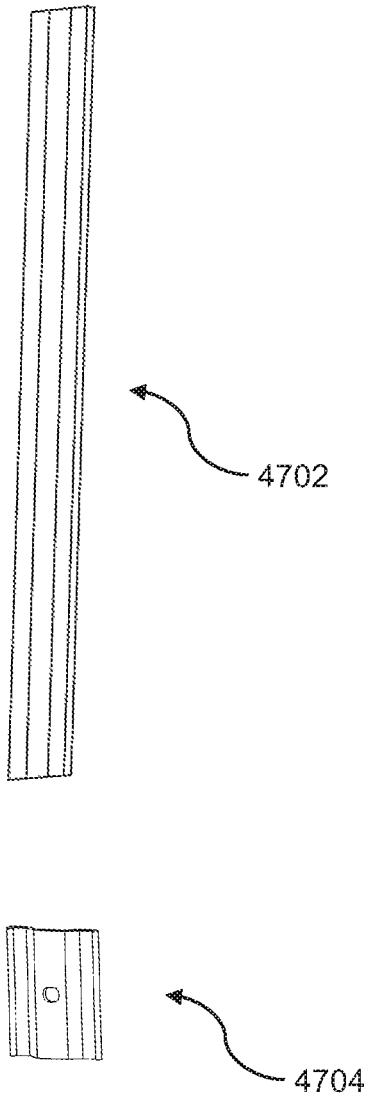
FIG. 47 is a perspective view of a fill member and a clip member, in accordance with an embodiment of the present disclosure.

FIG. 47 illustrates a perspective view of a fill member 4702 and a clip member 4704, in accordance with an aspect of the present disclosure. The fill member 4702 may have a substantially rectangular shape. The fill member 4702 may be used to prevent sliding movement of various components of the framing system 2600 (shown in FIG. 26). Further, multiple such fill members 4702 may be arranged adjacent to one another to fill a portion, beneath the top member 2604, that is not occupied by the lattice panels 2612. In an embodiment, the clip member 4704 may be used for connecting at least two fill members 4702 to each other. In another embodiment, the clip member 4704 may be used for connecting the fill member 4702 to the vertical elongate profile 2606A and/or the horizontal elongate profile 2606B.

Figure 48:
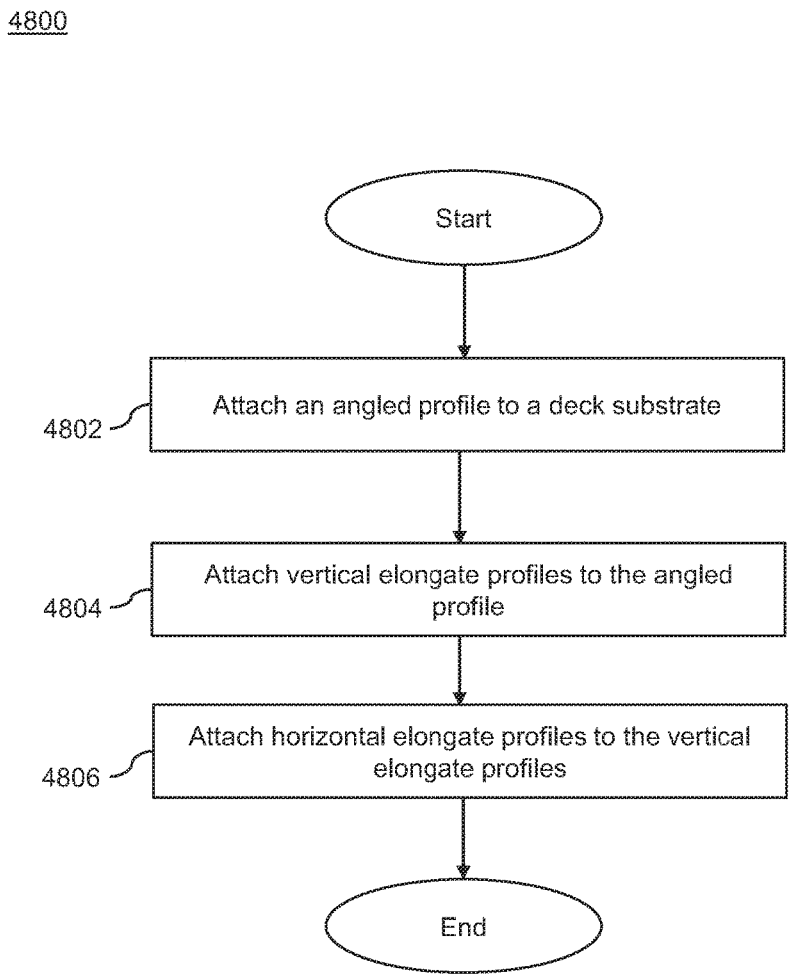
FIG. 48 illustrates a method of assembling a framing system, in accordance with an embodiment of the present disclosure.

FIG. 48 illustrates a method 4800 of assembling a framing system, in accordance with an aspect of the present disclosure. Though the method 4800 is described with reference to the framing system 2600 of FIG. 1, the method 4800 may also be implemented with the framing system 3800 (shown in FIG. 38) or the framing system 4400 (shown in FIG. 44). Reference will also be made to FIGS. 27-37.

At step 4802, the angled profile 2608 is attached to a deck substrate or frame. In an embodiment, the angled profile 2608 may be attached to the top member 2604 which is a part of the deck substrate. In another embodiment, the angled profile 2608 may be pre-fixed with the top member 2604 which is then attached to the deck substrate. The angled profile 2608 may be attached to the top member 2604 by various methods, such as, but not limited to, welding, adhesives, brazing, mechanical joints, fasteners, and so forth.

At step 4804, one or more vertical elongate profiles 2606A are attached to the angled profile 2608. The one or more elongate profiles 2606A may be attached to the angled profile 2608 by various methods, such as, but not limited to, welding, adhesives, brazing, mechanical joints, fasteners, and so forth.

At step 4806, the horizontal elongate profiles 2606B are attached to the respective vertical elongate profiles 2606A. The horizontal elongate profiles 2606B may be attached to the respective vertical elongate profile 2606B by various methods, such as, but not limited to, welding, adhesives, brazing, mechanical joints, fasteners, and so forth. In an embodiment, the connector sleeves 3100 (shown in FIGS. 31A-31D) may be used for connecting the horizontal elongate profiles 2606B to the respective vertical elongate profiles 2606A. The vertical and horizontal elongate profiles 2606A, 2606B may define a grid having the rectangular sections 2626. Each rectangular section 2626 may be configured to receive one of the lattice panels 2612. The lattice panels 2612 may be coupled to the rectangular sections 2626 by various methods, such as, but not limited to, welding, adhesives, brazing, mechanical joints, fasteners, and so forth.

Figure 49:
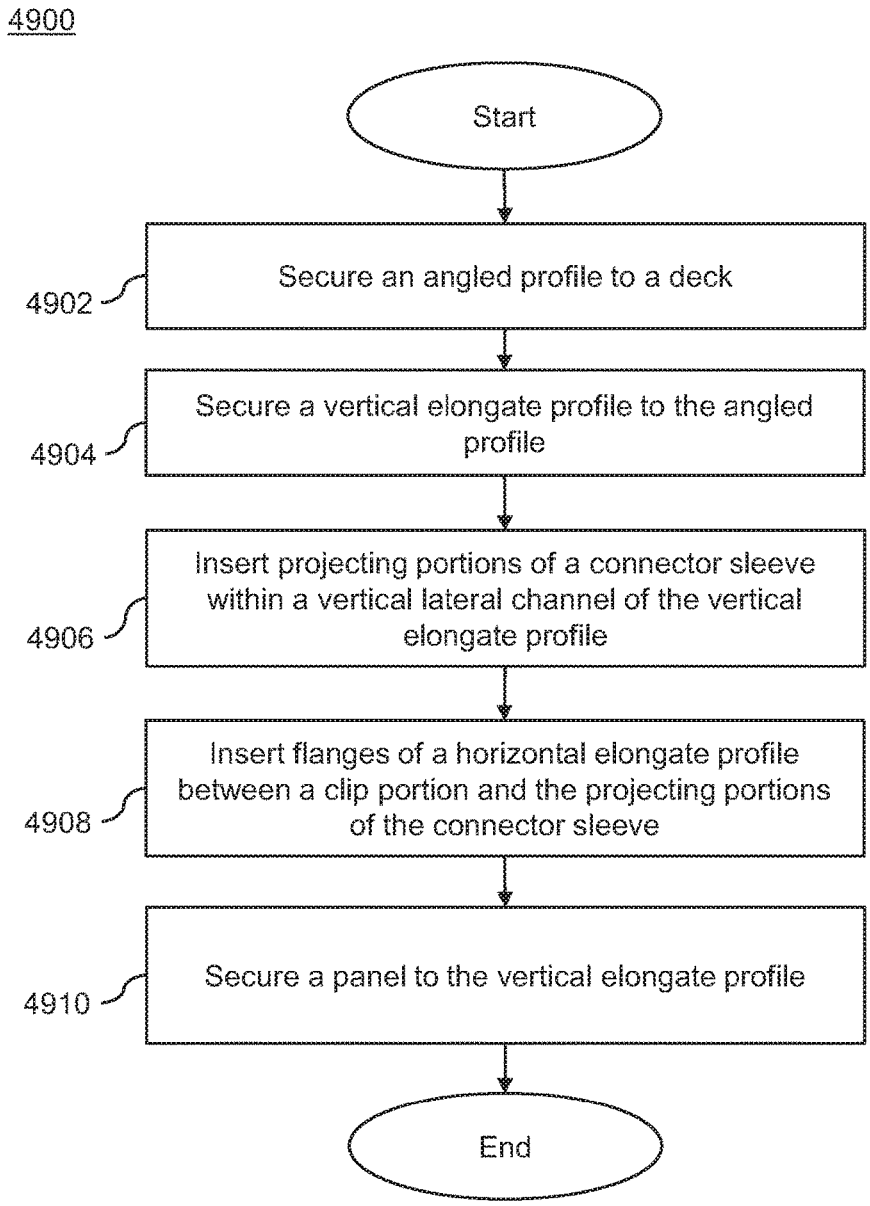
FIG. 49 illustrates another method of assembling a framing system, in accordance with an embodiment of the present disclosure.

FIG. 49 illustrates a method 4900 of assembling a framing system, in accordance with an aspect of the present disclosure. Though the method 4900 is described with reference to the framing system 2600 of FIG. 26, the method 4800 may also be implemented with the framing system 3800 (shown in FIG. 38) or the framing system 4400 (shown in FIG. 44). Reference will also be made to FIGS. 27-37.

At step 4902, the angled profile 2608 is secured to a deck. In some embodiments, the deck may include the top member 2604 and the angled profile 2608 may be secured to the top member 2604. In an exemplary embodiment, the first portion 2802 of the angled profile 2608 may be secured to the top member 2604 via a plurality of fasteners. The first portion 2802 includes the plurality of apertures 3302 to receive the plurality of fasteners. In alternative embodiments, the first portion 2802 may be coupled to the top member 2604 by various methods, such as, but not limited to, welding, adhesives, brazing, mechanical joints, and so forth.

Next at step 4904, at least one vertical elongate profile 2606A is secured to the angled profile 2608. The at least one vertical elongate profile 2606A includes the pair of vertical lateral channels 2706A. In an embodiment, the at least one vertical elongate profile 2606A may be secured to the second portion 2804 of the angled profile 2608 by various methods, such as, but not limited to, welding, adhesives, brazing, mechanical joints, fasteners, and so forth. In alternative embodiments, the at least one vertical elongate profile 2606A may be secured to the first portion 2802 of the angled profile 2608.

Further at step 4906, the pair of projecting portions 3102 of the connector sleeve 3100 is at least partially inserted within one of the pair of vertical lateral channels 2706A of the vertical elongate profile 2606A. In an embodiment, the at least one vertical elongate profile 2606A may be secured to the connector sleeve 3100 via the at least one first fastener 3404 (shown in FIG. 34). In alternative embodiments, the at least one vertical elongate profile 2606A may be secured to the connector sleeve 3100 via any other attachment methods such as, but not limited to, adhesives, brazing, welding or a combination thereof.

At step 4908, the pair of lower flanges of the horizontal elongate profile 2606B is at least partially inserted between the clip portion 3104 and the pair of projecting portions 3102 of the connector sleeve 3100. The clip portion 3104 may secure the horizontal elongate profile 2606B to the connector sleeve 3100. In an exemplary embodiment, the at least one horizontal elongate profile 2606B may be secured to the connector sleeve 3100 via the at least one second fastener 3406. In alternative embodiments, the at least one horizontal elongate profile 2606B may be secured to the connector sleeve 3402 via any other attachment methods such as, but not limited to, adhesives, brazing, welding or a combination thereof.

Next at step 4910, the method 4800 includes securing the panel 2612 to the at least one vertical elongate profile 2606A. In some embodiments, holes may be drilled in the center of the indentation 3710 of the panel 2612. In an embodiment, fasteners may be inserted within the holes to secure to the panel 2612 to the at least one vertical elongate profile 2606A. In alternative embodiments, the panel 2612 may be secured to the horizontal elongate profile 2606B. In an embodiment, fasteners may pass through the vertical elongate profile 2606A and the horizontal elongate profile 2606B to secure the panel 2612 within a grid formed by the vertical elongate profiles 2606A and the horizontal elongate profiles 2606B. In some embodiments, the transverse portion 2908 of the beam 2610 may be slidably inserted within the central channel 2708A of the at least one vertical elongate profile 2606A.

Though the above embodiments are described with reference to a under deck framing system and assembly, embodiments of the present disclosure are intended to cover any framing system having one or more adapter clips to couple elongate profiles with each other. The adapter clips may be easily coupled with the corresponding elongate profiles, thereby enabling quick and simple assembly of the framing system.

Although the invention has been described with reference to exemplary embodiments, it is not limited thereto. Those skilled in the art will appreciate that numerous changes and modifications may be made to the preferred embodiments of the invention and that such changes and modifications may be made without departing from the true spirit of the invention. It is therefore intended that the appended claims be construed to cover all such equivalent variations as fall within the true spirit and scope of the invention.

The exemplary embodiments of this present invention have been described in relation to a framing system. However, to avoid unnecessarily obscuring the present invention, the preceding description omits a number of known structures and devices. This omission is not to be construed as a limitation of the scope of the present invention. Specific details are set forth by use of the embodiments to provide an understanding of the present invention. It should however be appreciated that the present invention may be practiced in a variety of ways beyond the specific embodiments set forth herein.

A number of variations and modifications of the present invention can be used. It would be possible to provide for some features of the present invention without providing others.

The present invention, in various embodiments, configurations, and aspects, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The foregoing discussion of the present invention has been presented for purposes of illustration and description. It is not intended to limit the present invention to the form or forms disclosed herein. In the foregoing Detailed Description, for example, various features of the present invention are grouped together in one or more embodiments, configurations, or aspects for the purpose of streamlining the disclosure. The features of the embodiments, configurations, or aspects may be combined in alternate embodiments, configurations, or aspects other than those discussed above.

This method of disclosure is not to be interpreted as reflecting an intention the present invention requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate embodiment of the present invention.

Moreover, though the description of the present invention has included description of one or more embodiments, configurations, or aspects and certain variations and modifications, other variations, combinations, and modifications are within the scope of the present invention, e.g., as may be within the skill and knowledge of those in the art, after understanding the present disclosure. It is intended to obtain rights which include alternative embodiments, configurations, or aspects to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A framing system for a deck having a first joist, a second joist and a corner post, the framing system comprising:

a corner bracket including:

a first planar portion;

a second planar portion extending from and perpendicular to the first planar portion, wherein the first planar portion and the second planar portion are configured to at least partially receive the corner post therebetween;

a first attachment portion extending from and perpendicular to the first planar portion, the first attachment portion defining a first slot configured to receive a first fastener therethrough to couple the first attachment portion to the first joist of the deck; and a second attachment portion extending from and perpendicular to the second planar portion, the second attachment portion defining a second slot configured to receive a second fastener therethrough to couple the second attachment portion to the second joist of the deck;

a corner profile including:

a first elongate portion attachable to the first planar portion of the corner bracket and the corner post; and a second elongate portion extending from and perpendicular to the first elongate portion, wherein the second elongate portion is attachable to the second planar portion of the corner bracket and the corner post;

at least one horizontal profile attachable to the first elongate portion of the corner profile; and at least one panel attachable to the corner profile.

2. The framing system of claim 1, wherein the at least one horizontal profile is coupled to the first elongate portion of the corner profile via a pair of fasteners.

3. The framing system of claim 1, further comprising:

at least one main bracket attachable to the first joist of the deck, the main bracket including:

a first section defining a pair of slots, wherein each of the pair of slots is configured to receive a fastener therethrough to couple the first section to the first joist; and a second section extending from and perpendicular to the first section; and at least one vertical profile attachable to the second section of the at least one main bracket, the at least one horizontal profile and the at least one panel.

4. The framing system of claim 3, wherein the at least one horizontal profile is coupled to the at least one vertical profile via a pair of fasteners.

5. The framing system of claim 3, wherein the at least one panel is coupled to the corner profile and the at least one vertical profile via a plurality of fasteners.

6. The framing system of claim 3, wherein the at least one vertical profile is coupled to the second section of the at least one main bracket via a pair of fasteners.

7. The framing system of claim 3, further comprising a beam attachable to the at least one vertical profile.

8. The framing system of claim 1, further comprising at least one stake adapter configured to couple a stake to the at least one horizontal profile, wherein the stake is insertable into ground.

9. The framing system of claim 8, wherein the at least one stake adapter includes:

a coupling portion defining a hole configured to receive a fastener therethrough to couple the stake adapter, the stake and the at least one horizontal profile to each other; and a pair of angled portions inclined at an angle relative to the coupling portion, wherein the pair of angled portions and the at least one horizontal profile are configured to at least partially receive the stake therebetween.

10. A framing system for a deck having a first joist, a second joist and a corner post, the framing system comprising:

a corner bracket including:

a first planar portion;

a second planar portion extending from and perpendicular to the first planar portion, wherein the first planar portion and the second planar portion are configured to at least partially receive the corner post therebetween;

a first attachment portion extending from and perpendicular to the first planar portion, the first attachment portion defining a first slot configured to receive a first fastener therethrough to couple the first attachment portion to the first joist of the deck; and a second attachment portion extending from and perpendicular to the second planar portion, the second attachment portion defining a second slot configured to receive a second fastener therethrough to couple the second attachment portion to the second joist of the deck;

a corner profile including:

a first elongate portion attachable to the first planar portion of the corner bracket and the corner post; and a second elongate portion extending from and perpendicular to the first elongate portion, wherein the second elongate portion is attachable to the second planar portion of the corner bracket and the corner post;

at least one horizontal profile attachable to the first elongate portion of the corner profile;

at least one main bracket attachable to the first joist of the deck, the main bracket including:

a first section defining a pair of slots, wherein each of the pair of slots is configured to receive a fastener therethrough to couple the first section to the first joist; and a second section extending from and perpendicular to the first section;

at least one vertical profile attachable to the second section of the at least one main bracket and the at least one horizontal profile; and at least one panel attachable to the corner profile and the at least one vertical profile.

11. The framing system of claim 10, wherein the at least one horizontal profile is coupled to the first elongate portion of the corner profile via a pair of fasteners.

12. The framing system of claim 10, wherein the at least one horizontal profile is coupled to the at least one vertical profile via a pair of fasteners.

13. The framing system of claim 10, wherein the at least one vertical profile is coupled to the second section of the at least one main bracket via a pair of fasteners.

14. The framing system of claim 10, further comprising a beam attachable to the at least one vertical profile.

15. The framing system of claim 10, further comprising at least one stake adapter configured to couple a stake to the at least one horizontal profile, wherein the stake is insertable into ground.

16. The framing system of claim 15, wherein the at least one stake adapter includes:

a coupling portion defining a hole configured to receive a fastener therethrough to couple the stake adapter, the stake and the at least one horizontal profile to each other; and a pair of angled portions inclined at an angle relative to the coupling portion, wherein the pair of angled portions and the at least one horizontal profile are configured to at least partially receive the stake therebetween.

17. A framing system for a deck having a first joist, a second joist and a corner post, the framing system comprising:

a corner bracket including:

a first planar portion;

a second planar portion extending from and perpendicular to the first planar portion, wherein the first planar portion and the second planar portion are configured to at least partially receive the corner post therebetween;

a first attachment portion extending from and perpendicular to the first planar portion, the first attachment portion defining a first slot configured to receive a first fastener therethrough to couple the first attachment portion to the first joist of the deck; and a second attachment portion extending from and perpendicular to the second planar portion, the second attachment portion defining a second slot configured to receive a second fastener therethrough to couple the second attachment portion to the second joist of the deck;

a corner profile defining a longitudinal axis, the corner profile including:

a first elongate portion attachable to the first planar portion of the corner bracket and the corner post; and a second elongate portion extending from and perpendicular to the first elongate portion, wherein the second elongate portion is attachable to the second planar portion of the corner bracket and the corner post;

at least one horizontal profile attachable to the first elongate portion of the corner profile, wherein the at least one first horizontal profile is oriented perpendicularly with respect to the longitudinal axis;

an inclined profile spaced apart from the at least one horizontal profile and attachable to the first elongate portion of the corner profile, wherein the inclined profile is oriented at an oblique angle with respect to the longitudinal axis;

at least one main bracket attachable to the first joist of the deck, the main bracket including:

a first section defining a pair of slots, wherein each of the pair of slots is configured to receive a fastener therethrough to couple the first section to the first joist; and a second section extending from and perpendicular to the first section;

at least one vertical profile attachable to the second section of the at least one main bracket and the at least one horizontal profile; and at least one panel attachable to the corner profile and the at least one vertical profile, wherein the at least one panel includes an edge that is oriented at the oblique angle relative to the longitudinal axis.

18. The framing system of claim 17, further comprising a beam attachable to the at least one vertical profile.

19. The framing system of claim 17, further comprising a stake adapter configured to couple a stake to the inclined profile, wherein the stake is insertable into ground.

20. The framing system of claim 19, wherein the stake adapter includes:

a coupling portion defining a hole configured to receive a fastener therethrough to couple the stake adapter, the stake and the inclined profile to each other; and a pair of angled portions inclined at an angle relative to the coupling portion, wherein the pair of angled portions and the inclined profile are configured to at least partially receive the stake therebetween.

* * * * *